US011089846B2

(12) United States Patent
Sho et al.

(10) Patent No.: US 11,089,846 B2
(45) Date of Patent: Aug. 17, 2021

(54) SLIDE FASTENER-ATTACHED PRODUCT, ELEMENT MEMBER AND MANUFACTURING METHOD OF SLIDE FASTENER-ATTACHED PRODUCT

(71) Applicant: YKK Corporation, Tokyo (JP)

(72) Inventors: Yoshiyuki Sho, Toyama (JP); Makoto Saito, Toyama (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 16/476,754

(22) PCT Filed: Oct. 6, 2017

(86) PCT No.: PCT/JP2017/036533
§ 371 (c)(1),
(2) Date: Jul. 9, 2019

(87) PCT Pub. No.: WO2018/142671
PCT Pub. Date: Aug. 9, 2018

(65) Prior Publication Data

US 2019/0357638 A1 Nov. 28, 2019

(30) Foreign Application Priority Data

Feb. 2, 2017 (WO) ..... PCT/JP2017/003840

(51) Int. Cl.
*A44B 19/40* (2006.01)
*A44B 19/38* (2006.01)
(Continued)

(52) U.S. Cl.
CPC ..... *A44B 19/403* (2013.01); *A44B 19/08* (2013.01); *A44B 19/26* (2013.01); *A44B 19/28* (2013.01); *A44B 19/38* (2013.01)

(58) Field of Classification Search
CPC ..... A44B 19/08; A44B 19/26; A44B 19/28; A44B 19/38; A44B 19/403; A44B 19/60
See application file for complete search history.

(56) References Cited

U.S. PATENT DOCUMENTS 1,813,434 A 7/1931 Bennett
2,067,734 A 1/1937 Silberman
(Continued)

FOREIGN PATENT DOCUMENTS

CN 2688116 Y 3/2005
CN 1275555 C 9/2006
(Continued)

OTHER PUBLICATIONS

Office Action, Chinese Patent Application No. 201711285372.3, dated Apr. 3, 2020.
(Continued)

*Primary Examiner* — Robert Sandy
*Assistant Examiner* — David M Upchurch
(74) *Attorney, Agent, or Firm* — Kilpatrick Townsend & Stockton LLP

(57) ABSTRACT

A slide fastener-attached product includes a pair of element members and a fastener attached member having a pair of element attaching edge portions to which the element members are attached at positions. A fixing member includes an element holding portion and an extending portion extending further in one direction of a length direction than the element holding portion. The element member is fixed to the element attaching edge portion of the fastener attached member with a sewn portion for fixing of a sewing thread, and the extending portion of the fixing member is fixed to the element attaching edge portion with the sewn portion for fixing. A member attaching portion to which a component part of a separable rear end stop is attached is formed of a
(Continued)

part including the extending portion. Thereby, a weight reduction and improvement of flexibility can be attained.

20 Claims, 22 Drawing Sheets

(51) Int. Cl.
*A44B 19/28* (2006.01)
*A44B 19/08* (2006.01)
*A44B 19/26* (2006.01)

(56) References Cited

U.S. PATENT DOCUMENTS

| | | | | | |
|---|---|---|---|---|---|
| 2,858,592 | A | | 11/1958 | Schwartz | |
| 3,132,398 | A | * | 5/1964 | Schwendt et al. | A44B 19/403 24/408 |
| 3,302,259 | A | | 2/1967 | Waides | |
| 3,503,102 | A | * | 3/1970 | Inazawa | A44B 19/38 24/391 |
| 3,696,473 | A | * | 10/1972 | Jones | A44B 19/403 24/408 |
| 3,750,260 | A | | 8/1973 | Jakob | |
| 3,849,841 | A | | 11/1974 | Borzner | |
| 3,874,038 | A | | 4/1975 | Takamatsu | |
| 3,955,247 | A | | 5/1976 | Takamatsu | |
| 3,977,053 | A | | 8/1976 | Takamatsu | |
| 4,033,014 | A | | 7/1977 | Manning | |
| 4,134,184 | A | | 1/1979 | Motta | |
| 4,175,104 | A | | 11/1979 | Moertel | |
| 4,187,791 | A | | 2/1980 | Moertel | |
| 4,291,440 | A | * | 9/1981 | Yoshida | A44B 19/14 24/408 |
| 4,297,770 | A | | 11/1981 | Wulz | |
| 4,418,449 | A | | 12/1983 | Heimberger et al. | |
| 4,425,683 | A | | 1/1984 | Hata | |
| 4,425,684 | A | | 1/1984 | Akashi et al. | |
| 4,425,685 | A | | 1/1984 | Ogihara | |
| 4,458,391 | A | * | 7/1984 | Scarpini | A44B 19/346 24/403 |
| 4,485,532 | A | | 12/1984 | Yoshida et al. | |
| 4,490,890 | A | | 1/1985 | Yoshida et al. | |
| 4,495,679 | A | * | 1/1985 | Scarpini | A44B 19/34 24/403 |
| 4,639,981 | A | | 2/1987 | Yoshida et al. | |
| 4,922,584 | A | | 5/1990 | Funakawa et al. | |
| 5,008,988 | A | | 4/1991 | Laudet et al. | |
| 5,297,319 | A | | 3/1994 | Akashi et al. | |
| 5,469,605 | A | | 11/1995 | Horikawa | |
| 5,678,285 | A | * | 10/1997 | Germani | A44B 19/08 24/403 |
| 6,065,192 | A | * | 5/2000 | Wang | A44B 19/08 24/396 |
| 6,352,044 | B1 | | 3/2002 | Peng | |
| 8,572,813 | B2 | | 11/2013 | Dono et al. | |
| 2002/9100148 | | | 8/2002 | Tominaga et al. | |
| 2004/0181919 | A1 | | 9/2004 | Mizuhara et al. | |
| 2004/9181919 | | | 9/2004 | Mizuhara et al. | |
| 2005/0034284 | A1 | | 2/2005 | Yu | |
| 2005/0235466 | A1 | | 10/2005 | Segawa et al. | |
| 2005/0257350 | A1 | * | 11/2005 | Takamatsu | A44B 19/60 24/436 |
| 2009/0013505 | A1 | | 1/2009 | Hasegawa et al. | |
| 2011/0005042 | A1 | | 1/2011 | Thomas et al. | |
| 2012/0110795 | A1 | | 5/2012 | Daijogo | |
| 2012/0246888 | A1 | | 10/2012 | Matsushima et al. | |
| 2013/0133161 | A1 | | 5/2013 | Ren | |
| 2015/0033512 | A1 | * | 2/2015 | Kojima | A44B 19/06 24/430 |
| 2016/0095405 | A1 | | 4/2016 | Wang | |
| 2016/0206054 | A1 | | 7/2016 | Ni | |
| 2017/0235605 | A1 | | 9/2017 | Davis | |
| 2017/0280832 | A1 | * | 10/2017 | Kojima | A44B 19/403 |
| 2019/0357638 | A1 | | 11/2019 | Sho et al. | |

FOREIGN PATENT DOCUMENTS

| | | | |
|---|---|---|---|
| CN | 103153122 | A | 6/2013 |
| CN | 103269616 | A | 8/2013 |
| CN | 104334785 | A | 2/2015 |
| CN | 108236164 | A | 7/2018 |
| EP | 0107113 | A1 | 5/1984 |
| EP | 1459643 | A2 | 9/2004 |
| EP | 2764790 | A1 | 8/2014 |
| FR | 2247999 | A1 | 5/1975 |
| GB | 2083548 | A | 3/1982 |
| GB | 2319806 | A | 6/1998 |
| JP | 40-13870 | A | 5/1965 |
| JP | 52-141747 | A | 11/1977 |
| JP | 56-089204 | A | 7/1981 |
| JP | 62-299205 | A | 12/1987 |
| JP | 2004-283300 | A | 10/2004 |
| TW | 201609016 | A | 3/2016 |
| WO | 2010/032331 | A1 | 3/2010 |
| WO | 2011/077534 | A1 | 6/2011 |
| WO | 2012/090276 | A1 | 7/2012 |
| WO | 2014/102941 | A1 | 7/2014 |

OTHER PUBLICATIONS

Office Action, Chinese Patent Application No. 201810120807.7, dated Mar. 23, 2020.
Office Action, Chinese Patent Application No. 201810090675.8, dated Mar. 27, 2020.
PCT International Application No. PCT/JP2017/036534, International Search Report dated Dec. 12, 2017.
PCT International Application No. PCT/JP2017/036535, International Search Report dated Dec. 12, 2017.
U.S. Appl. No. 16/480,508, Non-Final Office Action, dated Aug. 13, 2020, 7 pages.
Office Action, Japanese Patent Application No. 2018-565923, dated Mar. 10, 2020.
Office Action, Japanese Patent Application No. 2018-565922, dated Mar. 10, 2020.
Office Action, Japanese Patent Application No. 2018-565921, dated Mar. 10, 2020.
International Search Report, PCT Application No. PCT/JP2017/036533, dated Dec. 12, 2017.
International Search Report, PCT Application No. PCT/JP2017/003840, dated Apr. 25, 2017.
European Supplementary Search Report, European Patent Application No. 17894796.6, dated Oct. 6, 2020, 10 pages.
European Supplementary Search Report, European Patent Application No. 17894731.3, dated Oct. 8, 2020, 9 pages.
Office Action, Chinese Patent Application No. 201810120807.7, dated Sep. 30, 2020, 34 pages.
U.S. Appl, No. 16/480,430, Non-Final Office Action, Nov. 9, 2020, 13 pages.
Office Action, Chinese Patent Application No. 201810120863.0, dated Apr. 17, 2021, 17 pages.
Office Action, Taiwanese Patent Application No. 106119596, dated Nov. 27, 2017, 17 pages.
Office Action, Chinese Patent Application No. 201810120807.7, dated Mar. 2, 2021, 43 pages.
U.S. Appl. No. 16/480,508 , Non-Final Office Action, dated Jan. 6, 2021, 15 pages.
U.S. Appl. No. 16/480,508 , Notice of Allowance, dated Dec. 2, 2020, 7 pages.
U.S. Appl. No. 16/480,508 , Notice of Allowance, dated Feb. 24, 2021, 7 pages.
European Patent Application No. 17894888 1 , Extended European Search Report, dated Dec. 1, 2020, 9 pages.
Office Action, Chinese Patent Application No. 201810120863.0, dated Apr. 17, 2020, 17 pages.

* cited by examiner

SLIDE FASTENER-ATTACHED PRODUCT, ELEMENT MEMBER AND MANUFACTURING METHOD OF SLIDE FASTENER-ATTACHED PRODUCT

TECHNICAL FIELD

The present invention relates to a slide fastener-attached product formed by attaching right and left element members in which a plurality of fastener elements are attached to a fixing member at regular intervals and a separable rear end stop capable of disengaging and separating the right and left fastener attached members to which the right and left element members are respectively attached directly to a product such as clothing items, the element member used for the slide fastener-attached product, and a manufacturing method of the slide fastener-attached product.

BACKGROUND ART

Generally, slide fasteners are often used as an opening and closing tool for products such as clothing items, commodity goods and industrial materials, and for products such as various seats in cars, trains and airplanes. Such a slide fastener used for various products as above generally has a right and left pair of fastener stringers in which element rows are formed at tape side edge parts of fastener tapes and a slider sliding along the right and left element rows.

Examples of general fastener stringers include a fastener stringer formed by molding a thermoplastic resin monofilament in a coil shape or a zigzag shape to form continuous fastener elements, and sewing the continuous fastener elements onto a tape side edge part of the fastener tape to form an element row. Another example is a fastener stringer in which an element row is formed by a plurality of independent fastener elements being formed at predetermined intervals by directly injection-molding synthetic resin to a tape side edge part of a fastener tape, or die-casting a metal.

In Japanese Utility Model publication No. 40-13870 (Patent Document 1), a slide fastener 100 formed by sewing an element member 103 in which a plurality of fastener elements 101 are connected with a support string 102 to an edge of a fastener tape 104 with overlock stitches (over-edge chain stitch) is disclosed, as shown in FIG. 30, for example.

In a case that the element member 103 is sewn to the fastener tape 104 with the overlock stitches as above by using an overlock sewing machine, for example, a sewing thread (needle thread) 105 disposed on a tape top surface side of the fastener tape 104 is disposed so as not to overlap the fastener elements 101. While a sewing thread (looper thread) disposed on a tape back surface side is likely to overlap the fastener elements 101 on the tape back surface side due to a movement of a looper of the overlock sewing machine. Therefore, when a fastener stringer is formed by using the overlock stitches as in Patent Document 1, high technology is required so that the looper thread does not overlap the fastener elements 101.

In conventional slide fasteners and fastener stringers, continuous fastener elements in a coil shape or injection-molded synthetic resin fastener elements are attached to a tape side edge part of a fastener tape to form an element row at the tape side edge part. When the slide fastener is attached to a fastener attached member such as clothing items, generally a part (generally called as a tape main body portion) except the tape side edge part of the fastener tape is put on a fastener attaching portion of the fastener attached member, and the both are sewn together with a sewing machine. Accordingly, in general slide fasteners, fastener tapes are commonly used as an essential member (component) to form a slide fastener.

In contrast, Japanese Patent publication No. 62-299205 A (Patent Document 2) discloses that, when a cloth of a product is woven or knitted, an element member in which continuous fastener elements or a plurality of fastener elements are fixed to a core string is directly woven-fixed or knitted-fixed to the cloth in order to improve an appearance (outer appearance quality) such as color and to attain weight reduction and the like in the products to which the slide fastener is attached. Thereby, the fastener elements can be attached directly to the cloth of the product without a fastener tape.

In a case that the fastener elements are woven or knitted directly to the cloth of the product as in Patent Document 2, operation processes can be reduced in manufacturing a slide fastener-attached product, compared to a case of manufacturing a slide fastener-attached product that a slide fastener is first manufactured, and thereafter, a fastener tape of the slide fastener is sewn to the cloth of the product. Therefore, effects such as speeding up the manufacturing line and a reduction in cost can be expected.

Further, since the fastener elements can be woven-fixed or knitted-fixed directly to the cloth of the product, the fastener tape as an essential component of the slide fastener is not required. Therefore, weight reduction or improvement of flexibility of the slide fastener-attached product can also be expected.

Meanwhile, as a type of slider fasteners, slide fasteners in which a separable rear end stop is provided at one end part of a fastener stringer in order that right and left fastener stringers themselves can also be uncoupled and separated each other when right and left element rows are uncoupled are known.

In this case, as a separable rear end stop for the slide fasteners, generally known is a type at least including an insert pin formed on a fastener tape of one fastener stringer and a box body formed on a fastener tape of the other fastener stringer and having an insert pin accommodating portion capable of inserting and accommodating the insert pin (type with a box body portion). Also generally known is a type including an insert pin formed on a fastener tape of one fastener stringer and a box pin formed on a fastener tape of the other fastener stringer, and two sliders are attached to an element row in a posture that rear mouths of the sliders oppose each other (reverse opening type or type without a box body portion).

A slide fastener having a separable rear end stop with a box body portion, for example, is described in International publication 2014/102941 A (Patent Document 3). The two types of the separable rear end stops described above are required to be provided with an insert pin at one end part of at least one fastener tape and a box body or a box pin at one end part of the other fastener tape in both types. In this case, the insert pin and the box body or the box pin are required to be provided with at predetermined positions with a high degree of accuracy with respect to each right and left element row in order that the element rows couple and uncouple smoothly.

PRIOR ART DOCUMENTS

Patent Documents

Patent Document 1: JPU-40-13870-A
Patent Document 2: JP-62-299205-A

Patent Document 3: WO2014/102941A

SUMMARY OF INVENTION

Problems to be Solved by the Invention

Recently, in products such as clothing like clothes, bags and shoes, additional values are enhanced by improving properties or applying various functions depending on their use. For the clothes and bags used ordinarily, for example, further weight reduction and improvement of flexibility has been demanded.

However, in the conventional slide fasteners including the slide fasteners described in Patent Document 1 and Patent Document 3 as mentioned above, a fastener tape is essential as a component part of the slide fasteners. Therefore, there is a limit to the weight reduction of the slide fastener in a case of the slide fastener-attached product to which the conventional general slide fastener is attached. Further, since the fastener tape is attached to a fastener attaching portion of the product by sewing process or the like with a sewing machine, flexibility of the product may lower.

Meanwhile, as described in Patent Document 2, for example, when a slide fastener-attached product is manufactured by woven-fixing or knitted-fixing fastener elements or an element member directly to a cloth of a product, the fastener tape is not required as mentioned above. Therefore, weight reduction of the slide fastener-attached product can be realized more easily.

However, in order to fix the fastener elements by weaving or knitting directly to the cloth of the product, high technology and exclusive facilities are needed. As a result, it leads to increase in facility cost, and ensuring and training skilled engineers are needed. Further, since a separable rear end stop is not described in Patent Document 2, it has not been easy to manufacture the slide fastener-attached product without a fastener tape and with a separable rear end stop by using the technology described in Patent Document 2.

Further, depending on the use and the like of the product, a desired function is applied to the cloth by coating the cloth of the product with synthetic resin in some cases. However, when the fastener elements are fixed by weaving or knitting directly at the time of weaving or knitting the cloth of the product as in Patent Document 2, it may be difficult to apply the desired function to the cloth by coating the cloth with synthetic resin.

The present invention has been made in view of the above conventional problems, and a specific object of the invention is to provide a slide fastener-attached product which enables to attach a plurality of fastener elements and a separable rear end stop to a fastener attached member of the product directly and easily, and to expect weight reduction and improvement of flexibility compared with those of conventional general slide fastener-attached products, an element member used for the slider fastener-attached product, and a manufacturing method of the slide fastener-attached product.

Means for Solving the Problems

In order to achieve the above object, the slide fastener-attached product provided by the present invention includes, as the most principal configuration, a pair of element members in which fastener elements are attached to a fixing member and a fastener attached member having a pair of element attaching edge portions to which the element member is attached at positions facing to each other, being characterized in that, in a length direction of the element member, the fixing member includes an element holding portion to which the fastener elements are attached and an extending portion extending further in one direction of the length direction than an end part fastener element disposed on one end part of the fastener elements in the length direction, the element member is fixed to the element attaching edge portion of the fastener attached member with a sewn portion for fixing of a sewing thread, the extending portion of the fixing member is fixed to the element attaching edge portion with the sewn portion for fixing, and a member attaching portion to which at least one component part forming a separable rear end stop of a slide fastener is attached is formed of a part including the extending portion.

Particularly, it is preferable that the member attaching portion is formed of the extending portion and at least a part of the element attaching edge portion.

In the slide fastener-attached product according to the present invention, it is preferable that the sewn portion for fixing pierces the element attaching edge portion and that the sewing thread of the sewn portion for fixing holds the fixing member such that the element member including the extending portion of the fixing member is directly fixed to the element attaching edge portion at a position along the element attaching edge portion on an outside of the element attaching edge portion in a width direction of the element member.

In this case, it is especially preferable that a position in which the sewn portion for fixing pierces the element attaching edge portion is apart from the fastener elements of the element member in a width direction of the element member to be inside of the element attaching edge portion.

It is also preferable that the sewn portion for fixing is formed to be bent in a zigzag shape with respect to a length direction of the element member with lock stitches.

Further, it is preferable that the sewn portion for fixing is formed by repeating a predetermined stitching pattern of the sewing thread in each fastener element and that the extending portion of the fixing member is fixed to the element attaching edge portion by repeating the stitching pattern of the sewn portion for fixing.

In the slide fastener-attached product according to the present invention, it is preferable that the component part of the separable rear end stop is fixed by sewing to the member attaching portion.

Particularly, it is preferable that a pair of the member attaching portions is formed at positions facing to each other, an insert pin member forming an insert pin portion of the separable rear end stop is fixed to one of the member attaching portions as the component part, and a box member forming a box portion of the separable rear end stop is fixed to the other of the member attaching portions as the component part.

In this case, it is preferable that the insert pin member includes an insert pin main body portion along the fixing member to wrap the fixing member and a first insert pin fin portion extending in a width direction from the insert pin main body portion and disposed on a first surface of the element attaching edge portion, in which the first insert pin fin portion is sewn to the element attaching edge portion with an insert pin side sewn portion, and that the box member includes a box main body portion along the fixing member to wrap the fixing member and a first box fin portion extending in a width direction from the box main body portion and disposed on a first surface of the element attaching edge portion, in which the first box fin portion is sewn to the element attaching edge portion with a box side sewn portion.

It is preferable that the insert pin member includes a second insert pin fin portion extending in a width direction from the insert pin main body portion and disposed on a second surface of the element attaching edge portion, in which the second insert pin fin portion is sewn to the element attaching edge portion with the insert pin side sewn portion, and that the box member includes a second box fin portion extending in a width direction from the box main body portion and disposed on a second surface of the element attaching edge portion, in which the second box fin portion is sewn to the element attaching edge portion with the box side sewn portion.

Further in this case, it is particularly preferable that an accommodating concave groove portion accommodating the insert pin side sewn portion is disposed along a length direction on the first insert pin fin portion and the second insert pin fin portion of the insert pin member and that an accommodating concave groove portion accommodating the box pin side sewn portion is disposed along a length direction on the first box fin portion and the second box fin portion of the box member.

In the slide fastener-attached product according to the present invention, it is preferable that at least one anchor element positioning the component part is disposed on the extending portion of the fixing member, the anchor element has a shape bulging from the fixing member in an orthogonal direction with respect to a length direction of the fixing member, and at least one anchor accommodating hole portion or anchor accommodating concave portion capable of inserting and accommodating the anchor element is disposed on the component part.

Further, it is preferable that the anchor element has a columnar, spherical or hemispherical shape centered on a central axis along a length direction of the fixing member, or a shape combining at least two of them.

In the present invention, it is preferable that the box portion includes and at least a box body main body portion having an insert pin accommodating portion capable of inserting and accommodating the insert pin portion and stopping a slider by contacting, in which the slider is attached slidably to an element row formed of a plurality of the fastener elements in a posture that a rear mouth of the slider faces to the box body main body portion.

In the present invention, a first slider and a second slider may be slidably attached to an element row formed of a plurality of the fastener elements in a posture that rear mouths of each slider face to each other. The box portion may have a box pin main body portion disposed continuously to the element row and a stopper portion disposed integrally on the box pin main body portion and stopping by contacting one of the first slider and the second slider.

Next, an element member provided by the present invention has, as the most principal characteristic, fastener elements are attached to a fixing member, the fixing member includes an element holding portion to which the fastener elements are attached and an extending portion extending further in one direction of the length direction than an end part fastener element disposed on one end part of the fastener elements in the length direction in a length direction of the element member, in which the extending portion includes an exposed portion where the fixing member is exposed.

In the element member of the present invention, it is preferable that a dimension of the extending portion including the exposed portion in a length direction is set to be larger than that of an attaching pitch of the fastener elements in a length direction.

Further, it is preferable that at least one anchor element positioning a component part to be attached to the extending portion is disposed on the extending portion of the fixing member and that the anchor element has a shape bulging from the fixing member in an orthogonal direction with respect to a length direction of the fixing member.

Next, a manufacturing method according to the present invention has, as the most important characteristic, in a manufacturing method of manufacturing a slide fastener-attached product, forming an element member in which fastener elements are attached to a fixing member, and which has, in the length direction, an element holding portion to which the fastener elements are attached and an extending portion extending further in one direction of the length direction than an end part fastener element disposed on one end part of the fastener elements in the length direction, forming a fastener attached member including an element attaching edge portion, and forming a sewn portion for fixing by conducting a sewing process on the fastener attached member and the element member using a sewing machine and fixing at least the extending portion of the fixing member to the element attaching edge portion of the fastener attached member with the sewn portion for fixing to form a member attaching portion including the extending portion.

It is preferable that the manufacturing method of the present invention includes fixing a component part which forms a separable rear end stop of a slide fastener to the member attaching portion.

Effects of the Invention

The slide fastener-attached product according to the present invention includes an opening and closing portion capable of opening or closing by sliding a slider, and a separable rear end stop at least including an insert pin portion and a box portion is formed to be attachable on one end part of the opening and closing portion in a length direction. It should be noted that, in the present invention, a box body portion having an insert pin accommodating portion, a box pin portion in which the insert pin accommodating portion is not provided while a stopper portion for stopping the slider is provided and a box body portion with a box pin in which a box pin portion is integrally formed on a box body portion are collectively called as a box portion. A box member, described later, includes a box body member forming a box body portion, a box pin member forming a box pin portion, and a box body member with a box pin forming a box body portion to which a box pin is integrated.

The slide fastener-attached product according to the present invention includes a right and left pair of element members provided with a plurality of independent fastener elements attached to a fixing member at regular intervals and a fastener attached member provided with a pair of element attaching edge portions to which the element member can be attached at positions facing to each other in the above-mentioned opening and closing portion.

In the slide fastener-attached product according to the present invention, the fixing member is formed of a flexible string-like member, for example. The fixing member includes, in a length direction of the element member, an element holding portion to which the plurality of fastener elements are attached and an extending portion extending further in one direction of the length direction than an end part fastener element disposed at one end part of the plurality of fastener elements in the length direction. That is, the extending portion of the fixing member extends continuously along a length direction from at least one end of the element holding portion of the fixing member.

In the present invention, the element member is fixed by being attached directly to the element attaching edge portion of the fastener attached member with the sewn portion for fixing of a sewing thread. The extending portion to which the fastener elements of the fixing member are not attached is fixed directly to the element attaching edge portion of the fastener attached member with the same sewn portion for fixing of the sewing thread. Further, a member attaching portion to which at least one component part such as an insert pin member and a box member forming a separable rear end stop of a slide fastener is to be attached is formed of a part including the extending portion of the fixing member fixed to the element attaching edge portion.

Particularly in the present invention, the member attaching portion to which at least one component part such as the insert pin member and the box member forming the separable rear end stop of the slide fastener is to be attached is formed of the extending portion of the fixing member fixed to the element attaching edge portion and at least a part of the element attaching edge portion.

According to the slide fastener-attached product of the present invention as above, the element member is easily and stably fixed to the fastener attached member with the sewn portion for fixing. Also a fixing state of the element member with respect to the fastener attached member is maintained stably.

Further, in the slide fastener-attached product of the present invention, the slide fastener can be configured without a fastener tape which is an essential component part in the conventional and general slide fasteners. Also component part configuring the separable rear end stop can be firmly and stably attached to the member attaching portion formed on a predetermined position of the product.

Therefore, in the slide fastener-attached product of the present invention, weight reduction and improvement of flexibility of the slide fastener-attached product can be achieved by making a fastener tape unnecessary. In addition, right and left fastener attached members can be easily uncoupled and separated by an arrangement of the separable rear end stop.

In the present invention, for a fastener attached member to which a desired function such as waterproofness is applied, the element member can be directly fixed afterward. Also the separable rear end stop can be attached after fixing the element member. Therefore, it is also possible to manufacture a slide fastener-attached product in which the fastener attached member (cloth) has a special function as well as the separable rear end stop easily and at a low cost.

Accordingly, in the slide fastener-attached product of the present invention, usability and convenience of the slide fastener can be substantially improved. Therefore, the product of the present invention is favorably used for articles of daily use such as clothes, shoes, and bags, and for industrial materials, seats for automobiles and airplanes other than articles of daily use.

In the above-mentioned slide fastener-attached product of the present invention, the sewn portion for fixing formed of the sewing thread pierces the element attaching edge portion, and the sewing thread holds the fixing member. Particularly, the sewing thread of the sewn portion for fixing holds the fixing member so as to wrap it while contacting with an outer peripheral surface of the fixing member in the element member. Thus, the element member including the extending portion of the fixing member is directly fixed along the element attaching edge portion easily and stably with the sewn portion for fixing to a position along the element attaching edge portion on an outside of element attaching edge portion in a width direction of the element member.

In this case, a position in which the sewn portion for fixing pierces the element attaching edge portion is apart from the fastener elements of the element member in a width direction of the element member to be inside of the element attaching edge portion. In other words, in the width direction of the element member, a predetermined interval is formed between the position where the sewn portion for fixing pierces the fastener attached member and the element of the element member. This makes it less possible to incur damages such as cutting at the element attaching edge portion of the fastener attached member with the thread of the sewn portion for fixing which fixes the element member.

In the present invention, the sewn portion for fixing is formed to be bent in a zigzag shape with respect to a length direction of the element member with lock stitches. For such a slide fastener-attached product, it is possible to sew the element member to the element attaching edge portion of the fastener attached member easily and stably using a zigzag stitch sewing machine, for example. Therefore, the slide fastener-attached product of the present invention can be manufactured stably and at a low cost without introducing an expensive and exclusive facility.

In the present invention, the sewn portion for fixing is formed by repeating the predetermined stitching pattern of the sewing thread in each fastener element. In this case, also the extending portion of the fixing member is fixed to the element attaching edge portion by repeating the same stitching pattern of the sewn portion for fixing. Thereby, the element member is attached to the element attaching edge portion of the fastener attached member smoothly and stably. Also the extending portion of the fixing member of the element member can be attached to the element attaching edge portion smoothly and stably. In a case that an anchor element, described later, is provided on the extending portion of the fixing member, the extending portion can be attached to the element attaching edge portion of the fastener attached member stably without interference of (or less interference of) a sewing needle with the anchor element.

In the slide fastener-attached product of the present invention, the extending portion of the fixing member is fixed to the element attaching edge portion of the fastener attached member to form the member attaching portion, and the component part of the separable rear end stop is fixed to the member attaching portion by sewing. Particularly in the present invention, a pair of the member attaching portions is formed at positions facing to each other. The insert pin member forming the insert pin portion of the separable rear end stop is fixed to one member attaching portion as a component part. The box member forming the box portion (box body portion or box pin portion and the like) of the separable rear end stop is fixed to the other member attaching portion as a component part. In this case, the box portion of the separable rear end stop may be formed to include at least the box body portion provided with the insert pin accommodating portion capable of inserting and accommodating the insert pin (a type with a box body portion) or, may be formed to include the box pin portion and the stopper portion for the sliders integrally formed on the box pin portion (a type without a box body portion).

Since the component part of the separable rear end stop are fixed to the member attaching portion provided on the predetermined position of the element member as above, the insert pin portion and the box portion is provided on the predetermined position stably. Therefore, the separable rear end stop can be formed easily on the slide fastener-attached products and a stable operation and function of the separable rear end stop can be secured. In addition, as the component part of the separable rear end stop are sewn to the member attaching portion of the cloth, especially by using a sewing machine, the component part can be fixed easily and stably. Also the component part can be fixed to the member attaching portion firmly.

In the present invention, it is preferable that the component part of the separable rear end stop is fixed to the member attaching portion of the cloth with the sewn portion of the sewing thread formed by a sewing machine as mentioned above. However in the present invention, as a means for fixing the component part of the separable rear end stop to the member attaching portion of the cloth, adhesion by adhesive agent or welding by heating or ultrasonic wave can be used instead of the sewn portion of the sewing thread. In the present invention, component part of the separable rear end stop can be formed by injection-molding directly to the element attaching portion of the cloth. Further in the present invention, in a case that the component part of the separable rear end stop are formed of metal, the component part can be fixed to the member attaching portion of the cloth by pressing and plastic deforming (as it is called, swaging) a part of the metal component part.

In the present invention, the insert pin member includes at least the insert pin main body portion along the fixing member to wrap the fixing member and a first insert pin fin portion extending in a width direction from the insert pin main body portion and disposed on a first surface of the element attaching edge portion. The first insert pin fin portion of the insert pin member is sewn to the element attaching edge portion with the insert pin side sewn portion. While the box member includes the box main body portion along the fixing member to wrap the fixing member and the first box fin portion extending in a width direction from the box main body portion and disposed on a first surface of the element attaching edge portion. The first box fin portion of the box member is sewn to the element attaching edge portion with a box side sewn portion. Therefore, the insert pin member and the box member can be fixed to each member attaching portion of the slide fastener-attached products easily and stably with a sewing machine.

Further in this case, the insert pin member includes the second insert pin fin portion extending in a width direction from the insert pin main body portion and disposed on a second surface of the element attaching edge portion. The second insert pin fin portion is sewn to the element attaching edge portion together with the first insert pin fin portion with the insert pin side sewn portion. Therefore, the insert pin member can be firmly fixed to the member attaching portion of the slide fastener-attached product with a sewing machine. Furthermore, the box member includes the second box fin portion extending in a width direction from the box main body portion and disposed on a second surface of the element attaching edge portion. The second box fin portion is sewn to the element attaching edge portion together with the first box fin portion with the box side sewn portion. Therefore, the insert pin member can be firmly fixed to the member attaching portion of the slide fastener-attached product with a sewing machine.

It should be noted that, in the present invention, the fixing member is wrapped by the insert pin main body portion or the box main body portion means that the insert pin member or the box member is attached to the above-mentioned member attaching portion in a state that the insert pin main body portion or the box main body portion covers at least a part of an outer peripheral surface of the fixing member. In this case, it is sufficient that at least a part of the outer peripheral surface of the fixing member is wrapped by the insert pin main body portion or the box main body portion. The present invention includes a case in which only a part of the outer peripheral surface of the fixing member is wrapped as well as a case in which the entire outer peripheral surface of the fixing member is wrapped completely.

The box member of the present invention includes a box body member in Embodiments 1-3, described later, and the box pin member in Embodiment 4, described later. In a case that a box member is a box body member, the box body member includes at least a box body main body portion and a first box fin portion, preferably a box body main body portion, a first box fin portion, and a second box fin portion. In a case that a box member is a box pin member, the box pin member includes at least a box pin main body portion and a first box fin portion, preferably a box pin main body portion, a first box fin portion, and a second box fin portion.

Further in this case, the accommodating concave groove portion accommodating the above-mentioned insert pin side sewn portion is disposed along a length direction on the first insert pin fin portion and the second insert pin fin portion of the insert pin member. The accommodating concave groove portion accommodating the above-mentioned box side sewn portion is disposed along a length direction on the first box fin portion and the second box fin portion of the box member. Thereby, the insert pin member and the box member can be sewn stably to the slide fastener-attached product at a predetermined position with a sewing machine. Further, since a thickness (a dimension of a height direction) of each fin portion in each accommodating concave groove portion of the insert pin member and the box member becomes thin, a sewing needle can easily pierce with respect to the insert pin member and the box member. This makes it possible to conduct a sewing operation easily and smoothly, at the same time, to prevent or suppress breakage from occurring in the insert pin member and the box member due to the piercing of the sewing needle.

In the slide fastener attached product of the present invention, at least one anchor element positioning component part is disposed on the extending portion of the fixing member. The anchor element has a shape bulging from the fixing member in an orthogonal direction with respect to a length direction of the fixing member. At least one anchor accommodating hole portion or anchor accommodating concave portion capable of inserting and accommodating the anchor element is disposed on the component part of the separable rear end stop.

Since the aforementioned anchor element is disposed, positioning of the component part with respect to the member attaching portion can be easily conducted when the component part such as the insert pin member or the box member are attached to the member attaching portion of the slide fastener-attached products. Further, an attaching strength of the component part attached to the member attaching portion can be enhanced. This makes it less possible that the component part is separated from the member attaching portion.

In this case, the anchor element has a columnar, spherical or hemispherical shape centered on a central axis along a length direction of the fixing member, or a shape by combining at least two of them. Thereby, even when the fixing member is twisted when attaching the element member to the fastener attached member, for example, and the anchor element rotates in any direction about the axis of the fixing member due to the twist of the fixing member, the anchor element itself maintains the same shape. Therefore, the element can be designed not to be affected by the twist of the fixing member. That is, in the case of the anchor element having the above-described shape, even when the anchor element rotates about an axis of the fixing member in attaching the component part of the separable rear end stop, the above described effect (function) of the anchor element can be stably exhibited.

In the present invention, the box portion is provided with the insert pin accommodating portion capable of inserting and accommodating the insert pin portion and includes at least a box body main body portion stopping the slider by contacting. In addition, the slider is slidably attached to the element row formed of the plurality of fastener elements in a posture in which the rear mouth of the slider faces to the box body main body portion. That is, according to the present invention, it is possible to provide the separable rear end stop of the type having at least the insert pin portion and the box body portion (a type having a box body portion) in the slide fastener-attached product without a fastener tape. In this case, as a box portion, only a box body portion may be formed or a box body portion with a box pin in which a box pin portion is integrally formed on the box body portion may be formed.

Further, in the present invention, the first slider and the second slider are attached slidably to the element row formed of the plurality of fastener elements in a posture that the rear mouth of each slider faces to each other. At the same time, the box portion may include the box pin main body portion disposed continuously on the element row and the stopper portion provided integrally with the box pin main body portion and stopping one of the first slider and the second slider by contacting. That is, in the present invention, a reverse opening type separable rear end stop (a type without a box body portion) in which the insert pin portion and the box pin portion are disposed so as to face to each other and the box body portion is not provided can also be provided on the slide fastener-attached product without a fastener tape.

Next, the element member according to the present invention is formed such that the fastener elements are attached to the fixing member, and preferably, the plurality of independent fastener elements is attached to the fixing member at regular intervals. In this case, it is preferable that each fastener element is attached so as to cover entire outer periphery of the fixing member. Further, the fixing member includes, in a length direction of the element member, the element holding portion to which the plurality of fastener elements are attached and the extending portion extending further in one direction of the length direction than the end part fastener element disposed on one end part of the plurality of fastener elements of the length direction addition, the extending portion of the fixing member includes the exposed portion in which the fixing member is exposed.

Such an element member of the present invention can be directly fixed to the element attaching edge portion of the fastener attached member using a sewing machine. In this case, the element holding portion of the fixing member is directly fixed to the element attaching edge portion of the fastener attached member with the sewn portion for fixing of the sewing thread formed by sewing with the sewing machine. Also the extending portion of the fixing member to which the fastener elements are not attached and the exposed portion is disposed on at least one part is directly fixed to the element attaching edge portion of the fastener attached member. As a result, the member attaching portion to which at least one component part of the separable rear end stop is to be attached can be stably formed of the portion including the extending portion of the fixing member fixed to the element attaching edge portion. Particularly in this case, since the exposed portion is formed at the extending portion of the fixing member, the exposed portion can be stably held with the sewing thread of the sewn portion for fixing. Thus, the extending portion can be fixed firmly to the element attaching edge portion of the fastener attached member.

Therefore, the slide fastener-attached product using the element member of the present invention as described above is manufactured, thereby, the slide fastener can be configured without using a fastener tape which is an essential component, part in the conventional general slide fastener. In addition, it is possible to stably attach the insert pin member and the box member to the above-mentioned formed member attaching portion, thereby it is possible to stably form the separable rear end stop including the insert pin portion and the box portion can be formed stably in a predetermined position.

In the element member of the present invention as described above, a dimension in a length direction of the extending portion including the above-mentioned exposed portion as a whole is larger than a size of the attaching pitch in a length direction of the fastener elements, and it is preferably set larger than twice the size of the attaching pitch. This makes it possible to easily and stably fix the extending portion of the element member to the element attaching edge portion of the fastener attached member with the sewn portion for fixing.

In the element member of the present invention, at least one anchor element positioning a component part to be attached to the extending portion is disposed on the extending portion of the fixing member. Further, the anchor element has a shape bulging from the fixing member in an orthogonal direction with respect to a length direction of the fixing member.

Thereby, it is possible to easily and reliably position the component part with respect to the member attaching portion when attaching the component part such as the insert pin member or the box member to the member attaching portion including the extending portion of the element member. Further, since the attaching strength of the component part attached to the member attaching portion can be increased, it makes less possible that the component part is detached from the member attaching portion.

Next, in the manufacturing method of the slide fastener-attached product according to the present invention, first, the element member to which the fastener elements having a predetermined shape are attached is produced, for example, by injection-molding synthetic resin to a fixing member. At this time, the element member to be produced has, in the length direction, the element holding portion to which the fastener elements are attached, and the extending portion extending further in one direction of the length direction than the end part fastener element disposed on one end part of the fastener elements of the length direction. In addition to the element member, the fastener attached member having the element attaching edge portion is formed.

Subsequently, the sewn portion for fixing is formed by performing a sewing process on the produced fastener attached member and the element member using a sewing machine, while at least the extending portion of the fixing member is fixed to the element attaching edge portion of the fastener attached member with the sewn portion for fixing to form the member attaching portion as described above. Thereby, the slide fastener-attached products without using a fastener tape can be easily manufactured. As a result, reduction in manufacturing cost, weight reduction, and improvement of flexibility in the slide fastener-attached products can be achieved. Furthermore, since the member attaching portion is formed at a predetermined position of the slide fastener-attached product, it is possible to firmly and stably attach the component parts constituting the separable rear end stop to the member attaching portion.

In the manufacturing method of the present invention, the component part forming the separable rear end stop of the slide fastener is fixed to the above-mentioned member attaching portion including the extending portion of the fixing member, thereby, the separable rear end stop provided with the insert pin portion and the box portion can be formed stably at a predetermined position. In addition, since stable operation and function of the separable rear end stop to be formed can be secured, it is possible to easily uncouple and separate the right and left fastener attached members. Particularly in this case, the component part of the separable rear end stop is fixed to the member attaching portion with a sewing machine, thereby, it is possible to fix the component part easily and stably, and to fix the component part to the member attaching portion firmly.

MODES FOR CARRYING OUT THE INVENTION

Hereinafter, preferred embodiments of the present invention will be described in detail showing embodiments with reference to the drawings. It should be noted that the present invention is not limited to Embodiments explained as below, and various changes can be made as long as having a substantially same structure and similar functional effects to the present invention.

For example, in each of the following embodiments, the case in which a slide fastener-attached product is a slide fastener-attached clothing item will be described. However, the slide fastener-attached product according to the present invention is not limited to clothing item (clothes), daily goods such as shoes and bags, products such as industrial materials, various kinds of products such as automobiles, trains, aircrafts and the like are included.

In addition, in the separable rear end stop described in each of the following embodiments, the insert pin portion is disposed on the left side when the clothing item as a product is viewed from the front side, and the box portion such as the box body portion or the box pin portion is disposed on the right side. That is, the separable rear end stop is formed as a separable rear end stop for right insertion for operating the insert pin portion with the right hand by a person wearing the clothing item. However, in the present invention, for example, by setting the positional relationship between the insert pin portion and the box portion in the right-left direction opposite to that in the following embodiment, a so-called separable rear end stop for left insertion can be formed on the slide fastener-attached product.

Embodiment 1

Figure 1:
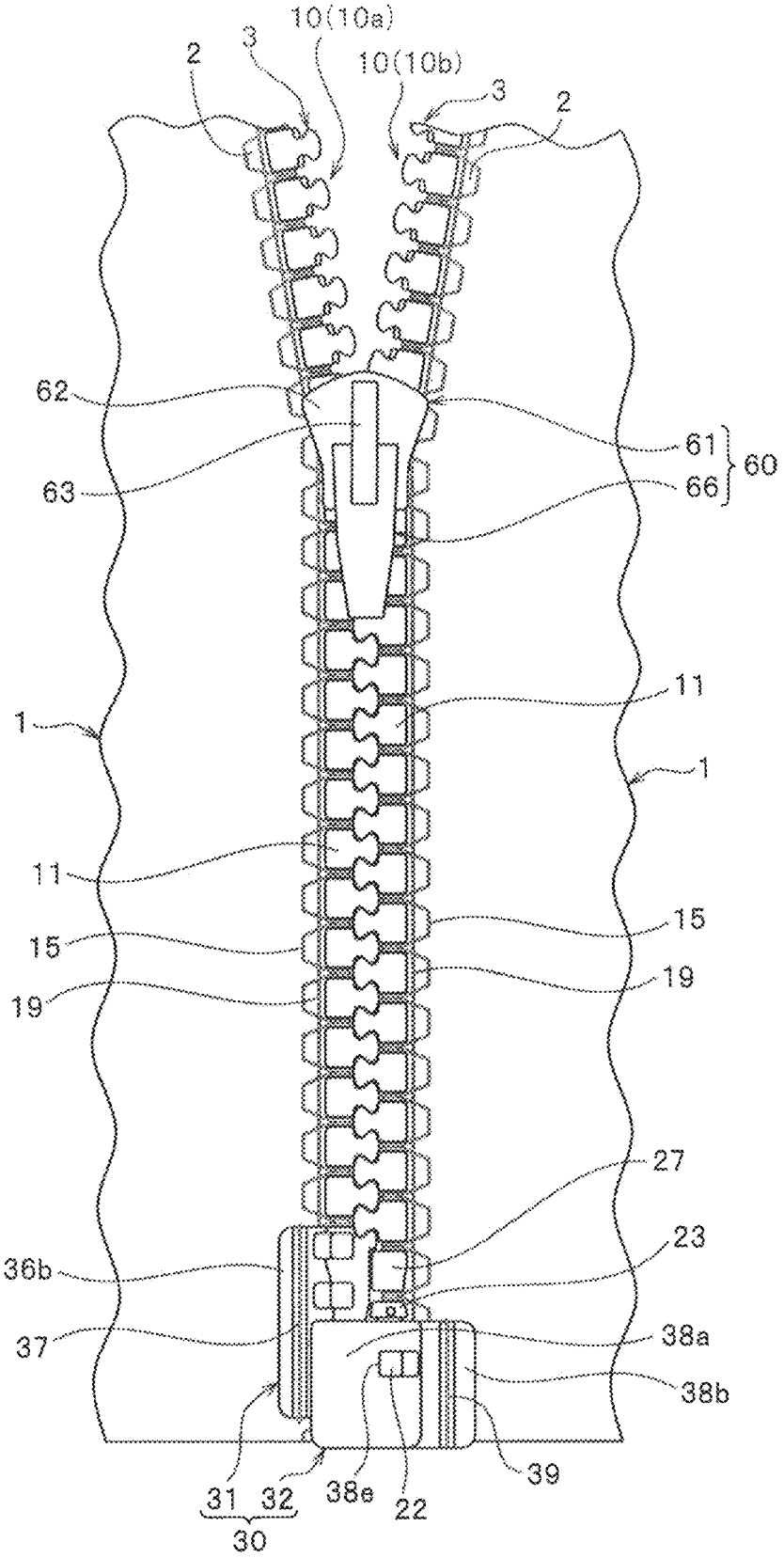
FIG. 1 is a plan view schematically showing a main portion of a slide fastener-attached product (clothing item) according to Embodiment 1 of the present invention.
Figure 2:
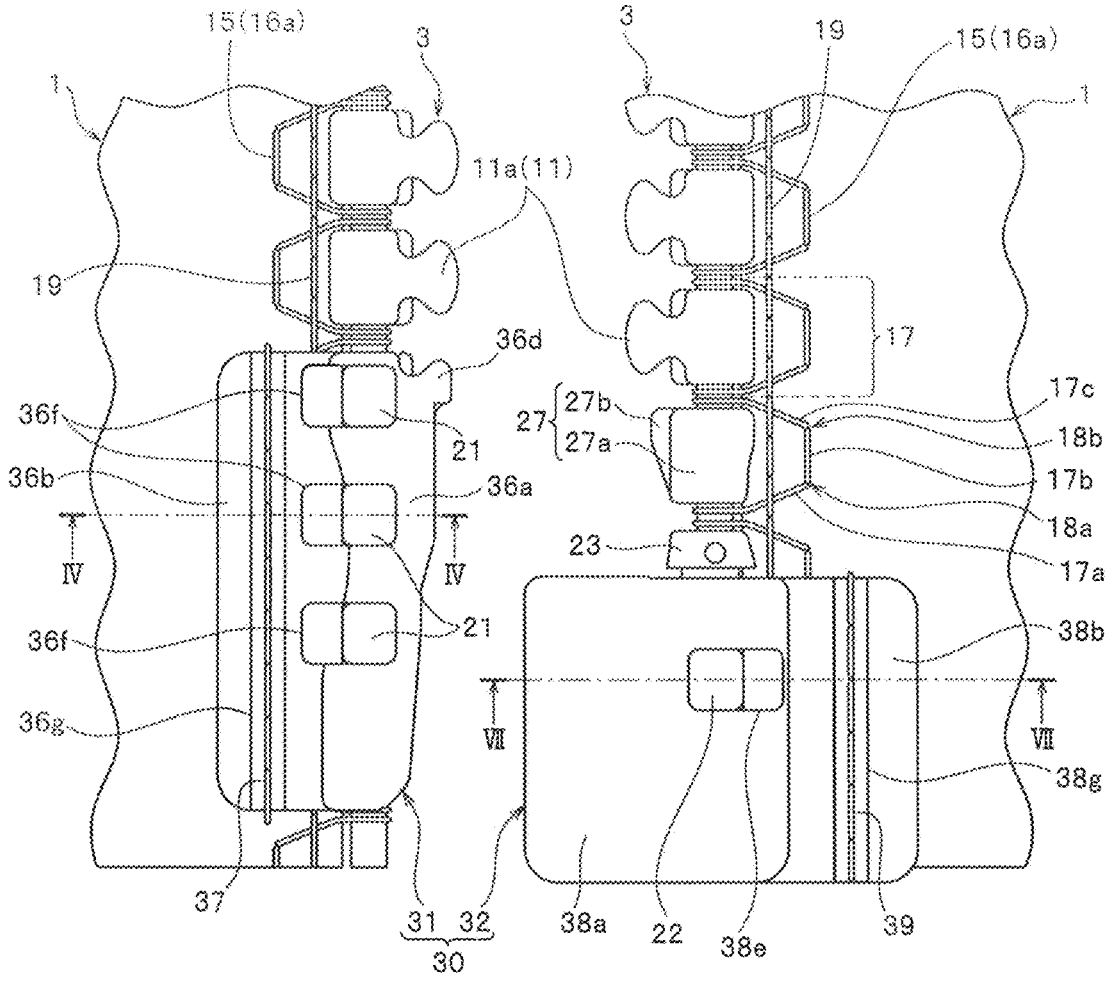
FIG. 2 is a plan view showing the main portion of the slide fastener-attached product (clothing item) in a state that a separable rear end stop is separated.
Figure 3:
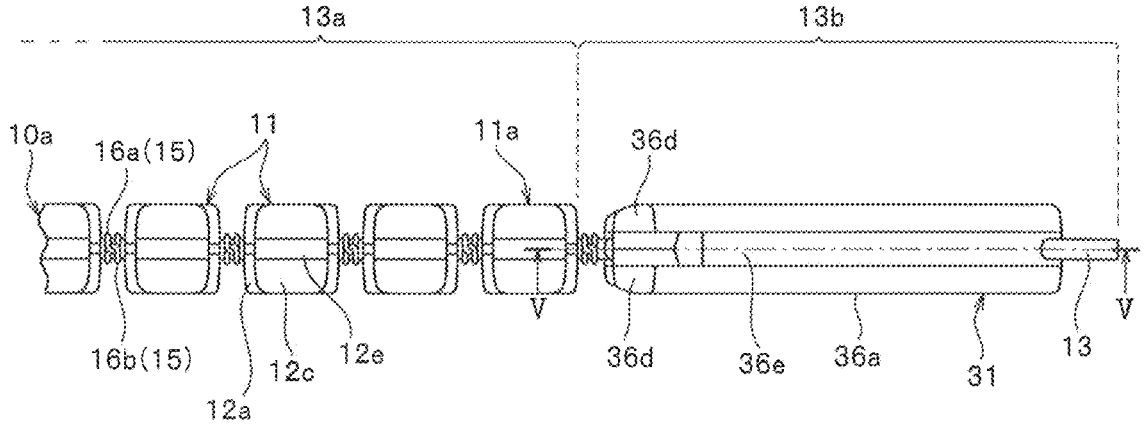
FIG. 3 is a side view of the product on the side where an insert pin portion of the separable rear end stop is provided.
Figure 6:
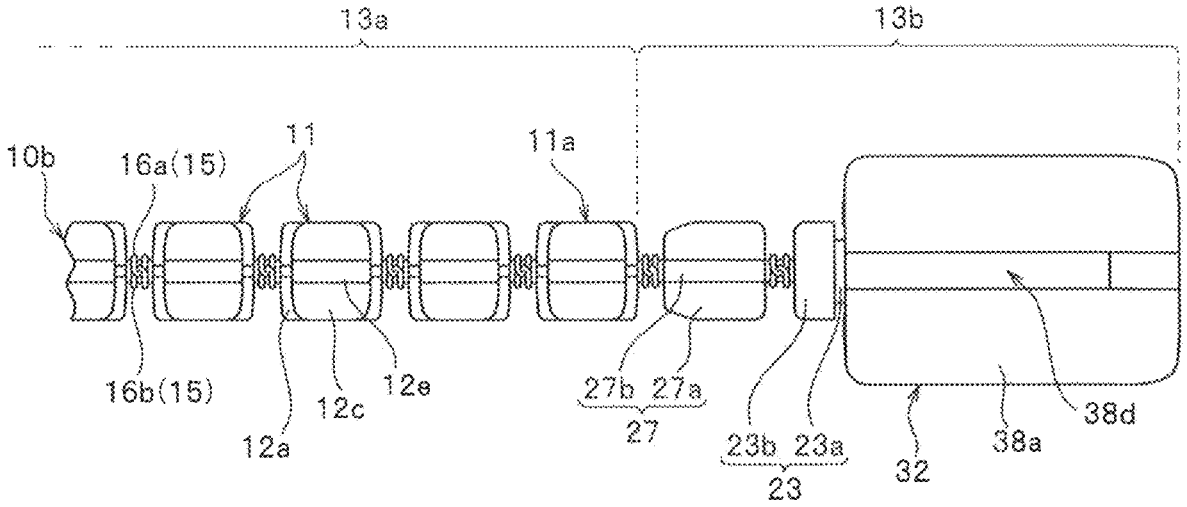
FIG. 6 is a side view of the product on the side where a box body portion of the separable rear end stop is provided.
Figure 7:
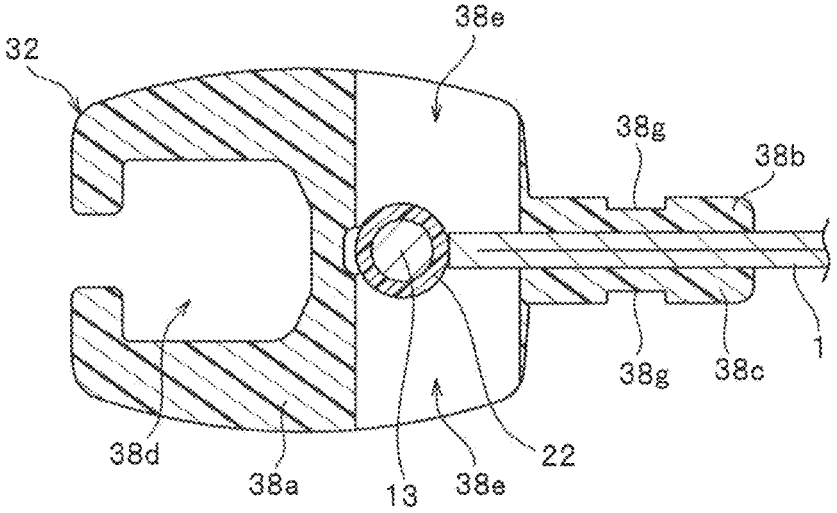
FIG. 7 is a cross sectional view taken along line VII-VII shown in FIG. 2.
Figure 8:
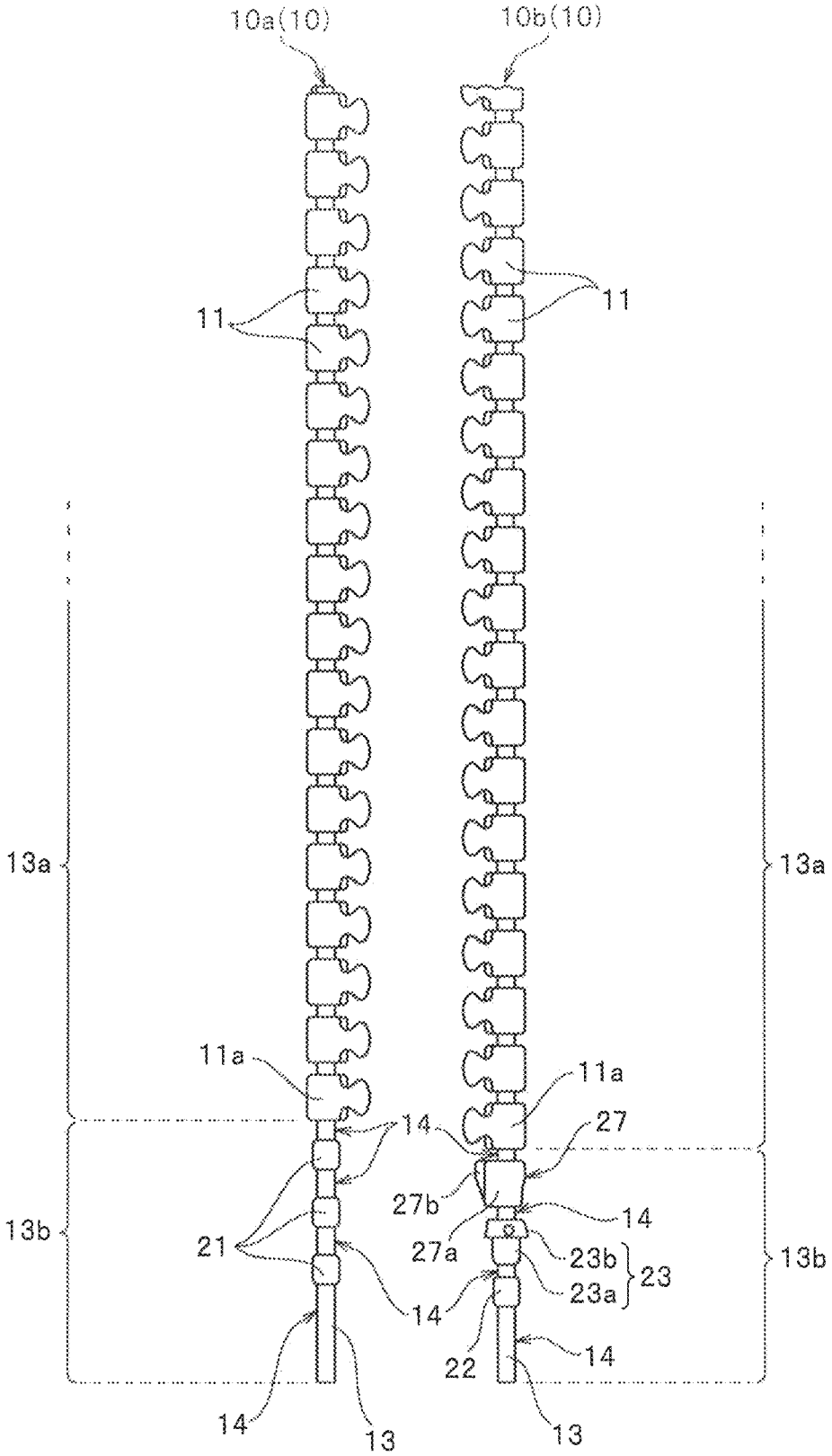
FIG. 8 is a plan view showing right and left element members.

FIG. 1 is a plan view schematically showing a main portion of a slide fastener-attached clothing item according to Embodiment 1, and FIG. 2 is a plan view showing the main portion of clothing item in a state that a separable rear end stop is separated. FIG. 3 and FIG. 6 are side views of a front placket part of the clothing item provided respectively with an insert pin portion and a box body portion of the separable rear end stop viewed from the side of coupling counterparts. FIG. 8 is a plan view showing right and left element members.

In the following description, front-rear direction refers to a length direction of the element member parallel to a sliding direction of a slider. In particular, a direction in which the slider slides so as to couple right and left element rows is defined as frontward, and a direction in which the slider slides so as to uncouple right and left element rows is defined as rearward. In addition, the front direction or the rear direction can be paraphrased as a direction away from the separable rear end stop or a direction approaching the separable rear end stop.

A right-left direction refers to a width direction of the element member (or a width direction of the cloth to be a fastener attached member), and is, for example, the direction orthogonal to the sliding direction of the slider and the direction parallel to a top surface and a back surface of the cloth. A vertical direction refers to a direction orthogonal to the front-rear direction and the right-left direction and refers to a thickness direction of the element member orthogonal to the top surface and the back surface of the cloth, for example. Particularly in the following cases, a direction of a side on which a pull tab of the slider is disposed with respect to the element member is defined as an upper direction, and a direction opposite thereto is defined as a lower direction.

The slide fastener-attached product according to Embodiment 1 is a slide fastener-attached clothing item (clothing item), and right and left element attaching edge portions 2 to which the element member 10 is to be attached is disposed to the cloth 1 forming the front body (particularly, the front placket part) as an opening and closing part of the clothing item. Further, on the right and left element attaching edge portions 2 of the clothing item, the element members 10 are respectively sewn to form right and left element rows 3.

A separable rear end stop 30 having an insert pin portion 31 and a box body portion 32 is attached to a rear end part (a lower end part in FIG. 1) of the right and left element attaching edge portions 2. Furthermore, a single slider 60 is attached to the right and left element rows 3 slidably along the element rows 3. The slider 60 is slid in a front direction or rear direction along the element rows 3, thereby, the front placket part (opening and closing part) of the right and left front body of the clothing item can be closed or opened by coupling or uncoupling of the right and left element rows 3.

In this case, the cloth 1 (also referred to as a garment cloth) constituting the front body of the clothing item forms the fastener attached member to which the element member 10 is attached. Therefore, the slide fastener structured in Embodiment 1 includes a right and left pair of fastener stringers having the element rows 3 formed by directly fixing the element member 10 to the cloth 1 of the clothing item, the slier 60 capable of coupling and uncoupling the element rows 3 of the right and left fastener stringers, and the separable rear end stop 30 disposed adjacent to rear end parts of the right and left element rows 3.

The cloth 1 to be the fastener attached member is provided with the performance and properties (softness, thickness, texture, hue etc.) required for clothing item. In Embodiment 1, the cloth 1 to which the element member 10 is sewn is cut into a predetermined shape and size according to the shape, design, etc. of the clothing item. Here, a thickness of general conventional fastener tapes is from 1.1 mm to 1.5 mm, whereas the cloth 1 which is the fastener attached member used in Embodiment 1 and the other portion of the cloth are formed thin from the viewpoint of weight reduction, and has a thickness of, for example, 0.2 mm or more and 1.0 mm or less, preferably 0.4 mm or more and 0.7 mm or less.

In Embodiment 1, the right and left element attaching edge portions 2 provided on the cloth (fastener attached member) 1 are disposed linearly and continuously at positions facing to each other at the front body of the clothing item (that is, facing edge portions of the front placket part). As will be described later, in Embodiment 1, an extending portion 13*b* of a fixing member 13 in the element member 10 is fixed to the right and left element attaching edge portions 2 to form right and left member attaching portions 5, and these right and left member attaching portions 5 are also disposed to be facing to each other.

Figure 9:
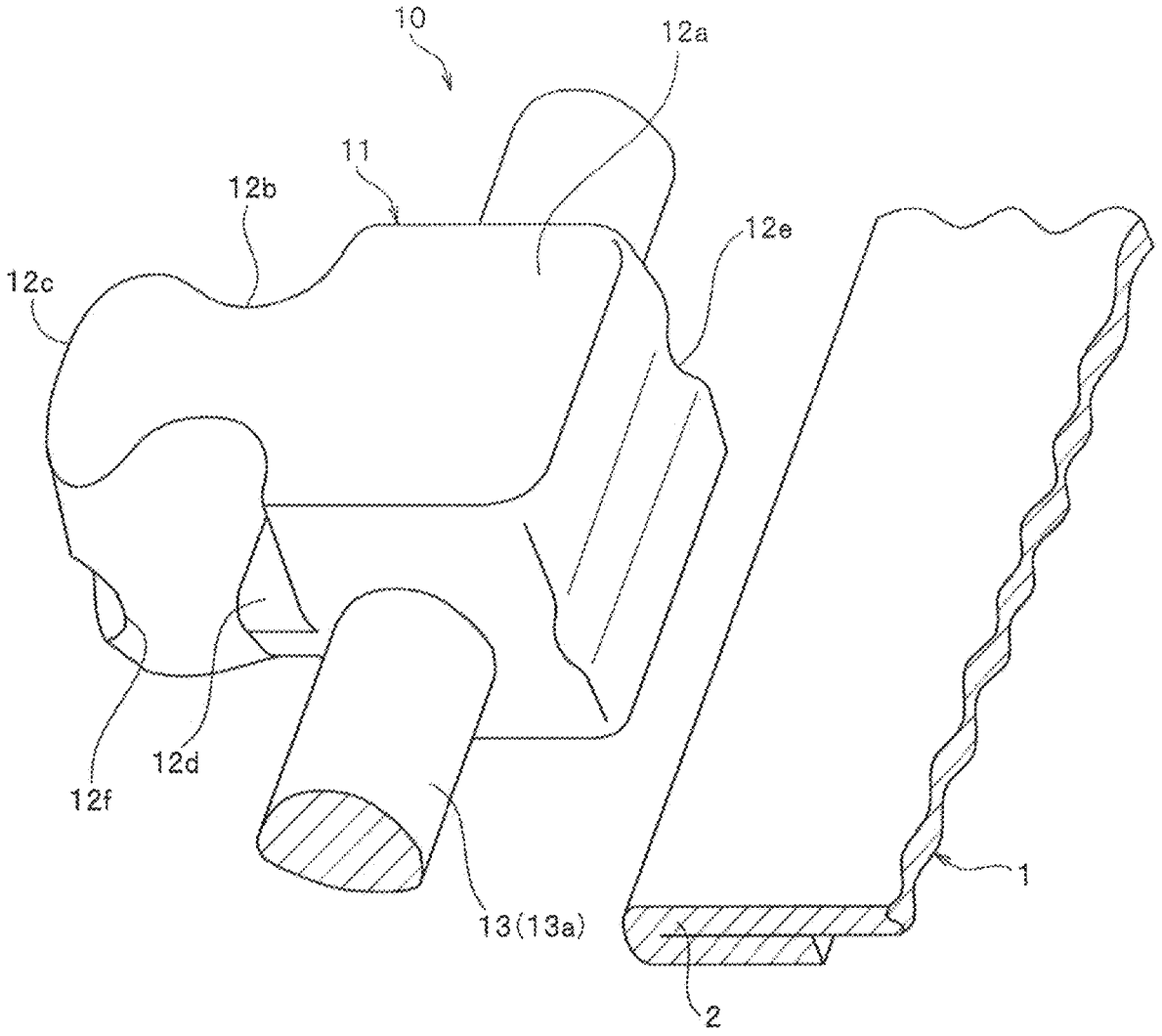
FIG. 9 is an enlarged perspective view showing a state before the element member is attached to the fastener attaching edge portion.

In this case, as shown in FIG. 9, the right and left element attaching edge portions 2 are formed by folding a side edge part, which becomes a cut end part of the cloth 1, in a U shape in a width direction of the element member 10. Since the element attaching edge portion 2 is formed in this manner, the element attaching edge portion 2 is locally thicker than the other parts of the thin cloth 1, so that it is possible to increase the strength of the element attaching edge portion 2. As a result, the element attaching edge portion 2 is less likely cut, and the durability of the element attaching edge portion 2 is enhanced. Further, since the strength of the element attaching edge portion 2 is enhanced, the element member 10 and the separable rear end stop 30 can be firmly fixed to the element attaching edge portion 2.

Furthermore, since the side edge part of the cloth 1 is folded in a U shape, even when the side end edge of the cloth 1 is frayed, for example, its fray is hidden behind a back surface side of the element attaching edge portion 2 so as not to be exposed outside. Thereby, the slide fastener-attached clothing item can be provided with good appearance quality (appearance). In addition, it is possible to prevent that coupling of between the right and left element rows 3 is deteriorated and slidability of the slider 60 from is lowered due to the fray occurring at the side end edge of the cloth 1.

Furthermore, in Embodiment 1, for example, on at least one of the top surface and the back surface of the element attaching edge portion 2, and/or on an inside of the side edge part of the element attaching edge portion 2 folded in a U shape (between upper and lower folded portion), a reinforcing sheet member such as a resin film (not shown) can be affixed, or sewn together with the element member 10. This also makes it possible to effectively reinforce the element attaching edge portion 2. In the present invention, the structure of the cloth 1 of the clothing item is not particularly limited, and can be appropriately changed according to the use of clothing item and the like.

As shown in FIG. 8, for example, the element member 10 according to Embodiment 1 includes a left side element member 10*a* (also referred to as a first element member) provided with the insert pin portion 31 and a right side element member 10*b* (also referred to as a second element member) provided with the box body portion (box portion) 32. The shape of rear end part of the element member 10 is different between the left side element member 10*a* and the right side element member 10*b*. The right and left element members 10*a* and 10*b* will be specifically described below.

The left side element member 10*a* includes a plurality of independent fastener elements 11 (also referred to as single fastener element), a single string-like fixing member 13 connecting the plurality of fastener elements 11 at constant intervals, and three first anchor elements 21 disposed at a rear end part (extending portion 13*b* to be described later) of the fixing member 13.

On the other hand, the right side element member 10*b* includes a plurality of independent fastener elements 11, a single string-like fixing member 13 connecting the plurality of fastener elements 11 at regular intervals, two kinds of a second anchor element 22 and a third anchor element 23 disposed at a rear end part (extending portion 13*b*) of the fixing member 13, and a box body side insertion portion 27 disposed at the rear end part. In this case, although each fastener element 11 disposed on the left side element member 10*a* and each fastener element 11 disposed on the right side element member 10*b* are formed in a bilaterally symmetrical shape, they have substantially the same structure.

The plurality of fastener elements 11 disposed on the respective element members 10*a*, 10*b* are aligned in a row along a length direction of the element member 10 in a state of being connected at equal intervals by the fixing member 13. These fastener elements 11 are formed integrally with the fixing member 13 by injection-molding thermoplastic resin such as polyamide, polyacetal, polypropylene, polybutylene terephthalate or the like into one fixing member 13, and are formed by covering an entire outer periphery of the fixing member 13.

Further, in the present invention, among the plurality of fastener elements 11 disposed on the fixing member 13 of each element member 10, the fastener element 11 disposed at the most end (in the case of Embodiment 1, the rear end) of the side in a length direction where the separable rear end stop 30 is disposed is defined as an end part fastener element 11*a* (sometimes called as a first fastener element).

In the present invention, the material of the fastener element 11 is not limited to the above-mentioned synthetic resin, and the fastener element 11 may be formed of other synthetic resin or metal, for example. Further, the element member 10 of Embodiment 1 is not limited to the one in which the fastener element 11 is formed by injection-molding the thermoplastic resin into the fixing member 13, and includes the one which may be formed by fixing the elements formed in a predetermined shape by injection-molding the thermoplastic resin to the fixing member 13 by welding or adhesion or the like.

Furthermore, the element member 10 of the present invention is not limited to the one in which the injection-molded synthetic resin fastener element 11 as in Embodiment 1 is integrally formed and connected to the fixing member 13. In the element member of the present invention, for example, an element member formed by metal die-casting on a string-like fixing member 13, an element member formed by cutting a wire material having a substantially Y-shaped cross section (so-called Y bar) to form elements and attaching the elements to the fixing member 13 by pressing deformation, and an element member formed by punching a flat plate member in a thin plate shape to manufacture elements and further by attaching the element to the fixing member 13 by pressing deformation are included.

As shown in FIG. 9, the fastener element 11 of Embodiment 1 includes a body portion 12*a* fixed to the fixing member 13, a neck portion 12*b* continuously extending in a width direction of the element member 10 from the body portion 12*a* and having a constricted shape such that a dimension in a length direction becomes narrow, a coupling head portion 12*c* continuously extending in a width direction further from the neck portion 12*b* and exhibiting a substantially oval shape in a plan view, and a protruded piece portion 12*d* (also referred to as a shoulder portion) protruding frontward and rearward from the neck portion 12*b*.

The body portion 12*a* of the fastener element 11 has a substantially rectangular parallelepiped shape having a constant thickness dimension and is formed so as to wrap the fixing member 13 so that the fixing member 13 penetrates therein in a front-rear direction. An insertion concave portion 12*e*, into which a part of the element attaching edge portion 2 of the cloth 1 is inserted, is provided along a length direction of the element member 10 on a side surface part of the body portion 12*a* facing to the cloth 1. The element member 10 is fixed to the element attaching edge portion 2 with a sewn portion for fixing 15 in a state where the element attaching edge portion 2 of the cloth 1 is inserted into the insertion concave portion 12*e*, thereby each fastener element 11 can be firmly and stably fixed to the element attaching edge portion 2 in a predetermined aspect.

Further, in the body portion 12*a*, the fixing member 13 penetrates along a length direction in a state of being wrapped by the body portion 12*a*. In this case, the fixing member 13 is held at a central portion in a thickness direction of the body portion 12*a*.

A concave groove portion 12*f* fitting the protruded piece portion 12*d* of the fastener element 11 on the coupling counterpart side when coupling the right and left element rows 3 is formed along a length direction on a top end part (tip end part) of the coupling head portion 12*c*. In the present invention, the shape of the fastener element 11 is not particularly limited, and can be arbitrarily changed.

The right and left fixing members 13 in Embodiment 1 are formed of a same string-like member having a flexibility and a substantially circular cross section orthogonal to a length direction. In particular, each fixing member 13 is preferably a member having a circular cross section and having a constant cross-sectional area in a length direction. As such a fixing member 13, for example, it is possible to use a monofilament, a twisted yarn (twisted string), or a string body also called as a knit cord) formed by wrapping a core yarn composed of a plurality of aligned multi-filaments with a hollow weave portion knitted with a plurality of knitting yarns.

The fixing member 13 used in the present invention is not particularly limited as long as it can be attach a plurality of elements. Further, the cross sectional shape of the fixing member 13 can be arbitrarily changed as required. Furthermore, the element member 10 of the present invention may be formed by connecting a plurality of elements with two or more string-like fixing members 13.

The fixing member 13 of Embodiment 1 includes, with respect to the length direction of the element member 10, an element holding portion 13*a* to which a plurality of fastener elements 11 are attached at regular intervals and an extending portion 13*b* continuously extending rearward further than the above-described end part fastener element 11*a*. In other words, the extending portion 13*b* of the fixing member 13 continuously extends rearward from the element holding portion 13*a* of the fixing member 13.

In the left side element member 10*a* of Embodiment 1, three first anchor elements 21 used for positioning the insert pin member 36 when attaching an insert pin member 36, described later, are disposed on the extending portion 13*b* of the fixing member 13. A part of the left side extending portion 13*b* where the first anchor elements 21 are not disposed is formed as an exposed portion 14 where the extending portion 13*b* is exposed.

In this case, an overall length dimension of the left side extending portion 13*b* including the exposed portion 14 is larger than an attaching pitch of the plurality of fastener elements 11 attached at regular intervals in a length direction, and preferably is set larger than twice the size of the attaching pitch. Here, the attaching pitch (interval) of the fastener element 11, in the fastener elements 11 adjacent in a length direction, refers to the interval (dimension) in the length direction between predetermined positions (for example, center position) in the length direction of each fastener element 11.

The three first anchor elements 21 of Embodiment 1 are disposed in order from the above-mentioned end part fastener element 11*a* at the same attaching interval as the attaching interval (attaching pitch) of the fastener elements 11 in the left side element member 10*a*. That is, in the left side element member 10*a*, the plurality of fastener elements 11 and the three first anchor elements 21 are intermittently and regularly aligned at constant intervals along a length direction. Also, the exposed portion 14 provided on the left side extending portion 13*b* are also intermittently disposed at constant intervals along a length direction. Since the exposed portion 14 is formed on the extending portion 13*b*, a part of the exposed portion 14 is wrapped and held by the sewing thread of a sewn portion for fixing 15 to be described later, thereby, the left side extending portion 13*b* are stably fixed to the element attaching edge portion 2 of the cloth 1.

Since the three first anchor elements 21 are disposed regularly at predetermined intervals as described above, when the left side element member 10*a* is attached to the element attaching edge portion 2 of the cloth 1 while forming a zigzag-shaped sewn portion for fixing 15 using a zigzag stitch sewing machine, areas of the element holding portion 13*a* and the extending portion 13*b* of the fixing portion 13 are fixed to the element attaching edge portion by sewing with a same stitching pattern without interference of a sewing needle of the zigzag stitch sewing machine with either the fastener elements 11 or the first anchor elements 21. In Embodiment 1, at least one first anchor element 21 may be disposed on the left side element member 10*a*, and the number of the first anchor element 21 to be installed can be arbitrarily changed in accordance with a length dimension of the extending portion 13*b*, for example.

The first anchor element 21 of Embodiment 1 has a columnar shape bulging in a radial direction of the fixing member 13 from the extending portion 13*b* of the fixing member 13 and partially wrapping the extending portion 13*b* of the fixing member 13 from the outside. In particular, the first anchor element 21 has a columnar shape centered on a central axis along a length direction of the fixing member 13 having a circular or substantially circular cross section. Here, the cross section means a section orthogonal to a length direction. Therefore, when viewing the cross section of the first anchor element 21, the first anchor element 21 bulges in a radial direction from the fixing member 13 in a donut shape. The bulging dimension of the first anchor element 21 in a radial direction is a same size in the entire periphery of the first anchor element 21.

The first anchor element 21 of Embodiment 1 may have a spherical or hemispherical shape, or be a combination of at least two of columnar, spherical, or hemispherical shapes. Since the first anchor element 21 has such a shape, even when the fixing member 13 is twisted, a shape (direction) of the first anchor element 21 itself does not change. Therefore, a function of positioning the insert pin member 36 by the first anchor element 21 described later and an effect of improving the attaching strength of the insert pin portion 31 by accommodating the first anchor element 21 in the insert pin portion 31 can be properly and stably exhibited. In the present invention, it is also possible to form the first anchor element 21 in other shapes such as a prismatic shape or the shape of the above-described body portion 12*a* of the fastener element 11.

On the other hand, as shown in FIG. 8, in the extending portion 13*b* of the fixing member 13 in the right side element member 10*b*, a second anchor element 22 on a rear side and a third anchor element 23 on a front side, and a box body side insertion portion 27 disposed between the third anchor element 23 and the end part fastener element 11*a* are provided at predetermined positions, respectively.

In addition, a portion where neither the second anchor element 22 nor the third anchor element 23 is disposed is formed as the exposed portion 14 in the right side extending portion 13*b*, and a part of the exposed portion 14 is wrapped and held by the sewing thread of the sewn portion for fixing 15. Thereby, the right side extending portion 13*b* is stably fixed to the element attaching edge portion 2 of the cloth 1. In this case, an overall length dimension of the right side extending portion 13*b* including the exposed portion 14 is larger than the size of the attaching pitch between the two fastener elements 11 adjacent in a length direction, and preferably is set to be larger than twice of the attaching pitch.

The second anchor element 22 and the third anchor element 23 of Embodiment 1 are used for positioning a box body member 38 when attaching the box body member 38 as a box member, described later. When accommodating the insert pin portion 31 in the box body portion 32 and coupling the right and left element rows 3, the box body side insertion portion 27 is accommodated in an element guide pass (to be described later) of the slider 60, and is inserted in an insert pin side concave portion 36*e* (to be described later) of the insert pin portion 31. Thereby, the positional relationship between the insert pin portion 31 and the box body portion 32 is stabilized.

Here, predetermined positions of the second anchor element 22, the third anchor element 23, and the box body side insertion portion 27 mean a position where the area of the element holding portion 13*a* and the area of the extending portion 13*b* of the fixing member 13 can be sewn with a same stitching pattern without interference of a sewing needle with the second anchor element 22, the third anchor element 23, and the box body side insertion portion 27, when attaching the right side element member 10*b* to the element attaching edge portion 2 of the cloth 1 with the zigzag-shaped sewn portion for fixing 15 in the same manner as in the case of the left side element member 10*a* using a zigzag stitch sewing machine.

Figure 10:
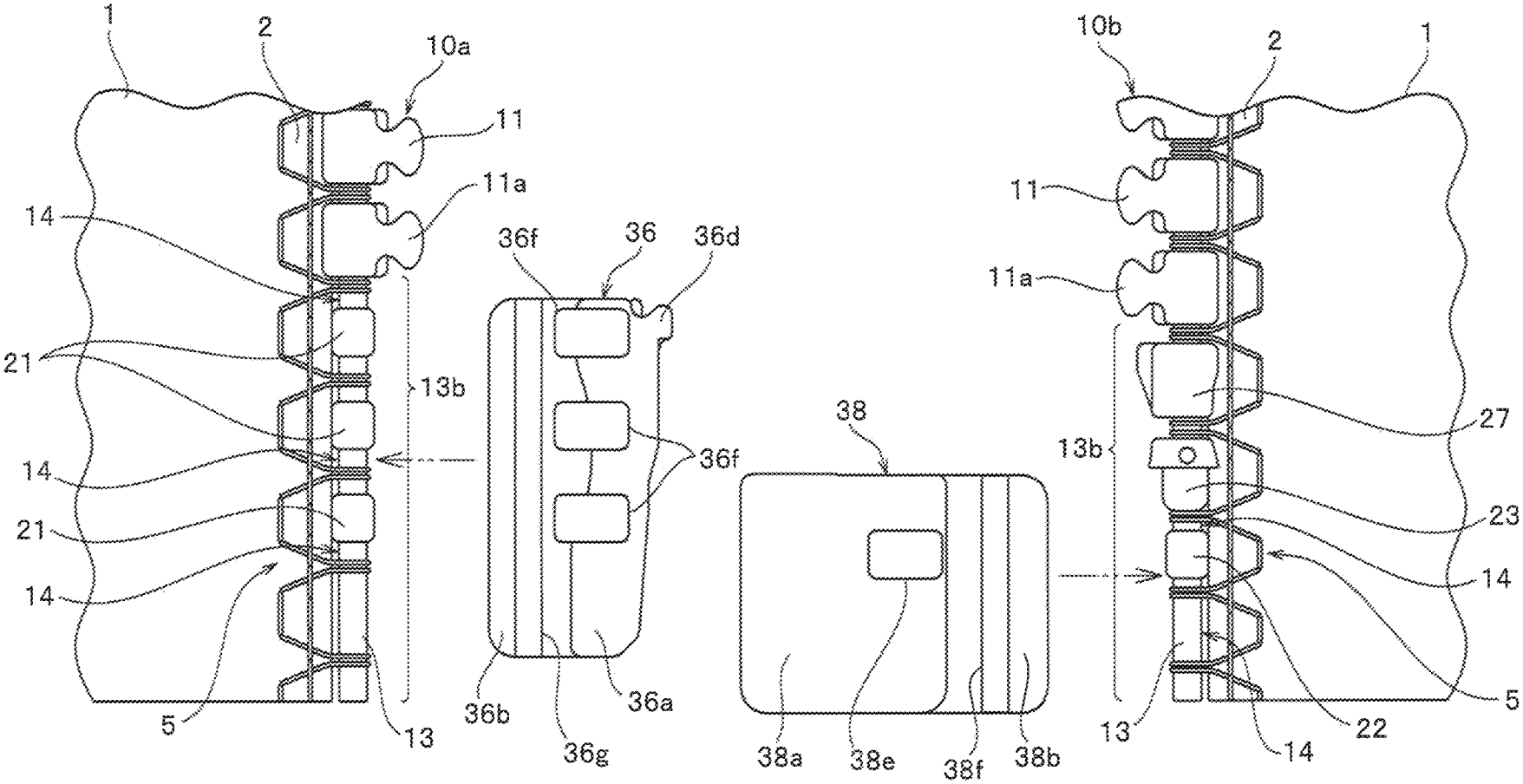
FIG. 10 is a plan view showing a state before an insert pin member and a box body member of the separable rear end stop are attached to right and left member attaching portions.

As shown in FIG. 10, the second anchor element 22 of Embodiment 1 is disposed at a rear end part of the extending portion 13*b* of the fixing member 13. The second anchor element 22 has a columnar shape which bulges in a radial direction of the fixing member 13 from the extending portion 13*b* of the fixing member 13 and wraps around the extending portion 13*b* of the fixing member 13.

The third anchor element 23 is disposed at a position between the second anchor element 22 and the box body side insertion portion 27 in a length direction. The third anchor element 23 has a columnar portion 23*a* having a columnar shape bulging in a radial direction of the fixing member 13 from the extending portion 13*b* of the fixing member 13 and an enlarged diameter portion 23*b* integrally formed with the columnar portion 23*a* in front of the columnar portion 23*a* and having a truncated cone shape which is bulged larger than the columnar portion 23*a* in a radial direction. In this case, the columnar portion of the third anchor element 23 is formed to be slightly narrower than the columnar second anchor element 22. When the box body portion 32 is provided, a part of the columnar portion of the third anchor element 23 is accommodated in the box body portion 32 (specifically, the box body side anchor accommodating concave portion 38*f* of the box body portion 32 to be described later) and not to be seen from the outside.

The second anchor element 22 and the third anchor element 23 of Embodiment 1 may have a spherical or hemispherical shape or be a combination of at least two of columnar, spherical, or hemispherical shapes, and may have other shapes such as a prismatic shape, a shape of the above-mentioned body portion 12*a* of the fastener element 11, and a shape of the entire fastener element 11, as the case may be.

The box body side insertion portion 27 includes a quadrangular prism-shaped fixing portion 27*a* fixed to the fixing member 13 and a thin plate-like insertion piece portion 27*b* protruding in a width direction of the element member 10 from the fixing portion 27*a*. In this case, the insertion piece portion 27*b* has a shape of a substantially trapezoidal shape in a plan view of the element member 10.

The first anchor element 21 to the third anchor element 23 and the box body side insertion portion 27 described above are integrally formed with the fixing member 13 by injection-molding the same thermoplastic resin as the fastener element 11 to the respective fixing members 13. The injection molding of the first anchor element 21 to the third anchor element 23 and the box body side insertion portion 27 may be carried out simultaneously with the injection molding of the fastener element 11 or may be carried out separately from the injection molding of the fastener element 11. The materials of the first anchor element 21 to the third anchor element 23 and the box body side insertion portion 27 are not particularly limited, and these parts may be formed of synthetic resin or a metal different from the fastener element 11. Further, for example, a molded body of the first anchor element 21 to the third anchor element 23 and the box body side insertion portion 27, which are formed by injection-molding a thermoplastic resin in advance to have a predetermined shape, can be fixed to the fixing member 13 by welding or bonding.

The left side element member 10*a* and the right side element member 10*b* in Embodiment 1 as described above are arranged at positions adjacent to an outside of each element attaching edge portion 2 of the right and left cloths 1 respectively in a width direction, and are fixed with a sewn portion for fixing (sewing line for fixing) 15. In this case, the sewn portion for fixing 15 is formed by a sewing of the zigzag stitch sewing machine, and is formed by bending in a zigzag shape with respect to a length direction with lock stitches. The right and left element members 10 are fixed to the element attaching edge portions 2 with the sewn portion for fixing 15 in a state that at least the body portion 12*a* of each fastener element 11 is in contact with the element attaching edge portion 2 of the cloth 1. The extending portion 13*b* of the fixing member 13 is fixed to the element attaching edge portion 2 in a state that at least the respective anchor elements 21, 22, 23 are in contact with the element attaching edge portion 2 of the cloth 1.

Here, the zigzag stitch sewing machine is a sewing machine capable of stitching cloth 1 and the like in a zigzag manner with lock stitches while swinging a sewing needle along a crossing direction which crosses a feeding direction of the sewing machine. The swinging of the sewing needle in the zigzag stitch sewing machine may also be referred to as a zigzag swing. In addition to using such a zigzag stitch sewing machine, coordinate data of the X coordinate (the position in the feeding direction) and the Y coordinate (the position in the crossing direction) which are the needle locations of the sewing needle, for example, is set in the zigzag stitch sewing machine. Thereby, it is possible to easily bend the sewn portion for fixing 15 formed after sewing so as to form a zigzag shape in the above-described crossing direction with respect to the feeding direction of the zigzag stitch sewing machine.

In Embodiment 1, the sewing thread of the sewn portion for fixing 15 formed with lock stitches includes an upper thread (needle thread) 16*a* which runs a top surface (first surface) of the element attaching edge portion 2 and contacts a top surface side half portion of the fixing member 13 and a lower thread (bobbin thread) 16*b* which runs a back surface (second surface) of the element attaching edge portion 2 and contacts a back surface side half portion of the fixing member 13. In this case, since the sewn portion for fixing 15 is formed with lock stitches, the upper thread 16*a* and the lower thread 16*b* are arranged in a plane-symmetrical positional relationship with each other.

In this case, a conventional general sewing thread is used for the upper thread 16*a* and the lower thread 16*b* of the lock stitch. In addition, the upper thread 16*a* and the lower thread 16*b* in the lock stitch cross (interlace) with each other at a piercing position (first piercing position 18*a* and second piercing position 18*b* described later) in which the sewn portion for fixing 15 pierces through the element attaching edge portion 2 and at a position in contact with the outer peripheral surface of the fixing member 13, as shown in FIG. 3 and FIG. 6.

The upper thread 16*a* and the lower thread 16*b* of the sewn portion for fixing 15 cross with each other at a position in a thickness direction between the upper thread 16*a* running on the top surface of the element attaching edge portion 2 and the lower thread 16*b* running on the back surface of the element attaching edge portion 2. In particular, the upper thread 16*a*, and the lower thread 16*b* in Embodiment 1 cross with each other at a position of the center portion in a thickness direction of the element attaching edge portion 2. As a result, the crossing part of the upper thread 16*a* and the lower thread 16*b* at the piercing position can be protected by the element attaching edge portion 2 and can be less visible from the outside. The crossing position of the upper thread 16*a* and the lower thread 16*b* in the thickness direction can be easily changed by controlling tension of the upper thread 16*a* and the lower thread 16*b* in the zigzag stitch sewing machine.

As described above, the sewn portion for fixing 15 of Embodiment 1 is formed of lock stitches for interlacing the upper thread 16*a* and the lower thread 16*b* with a zigzag stitch sewing machine. As a result, it is possible that the sewn portion for fixing 15 pierces the element attaching edge portion 2 of the cloth 1 and supports the fixing member 13 so as to wrap it while the upper thread 16*a* and the lower thread 16*b* are in contact with the outer peripheral surface of the fixing member 13 in the element member 10. Therefore, the element member 10 is easily and stably attached and fixed to the element attaching edge portion 2 of the cloth 1 with the sewn portion for fixing 15.

In addition, by forming the sewn portion for fixing 15 using a zigzag stitch sewing machine, it can be prevented effectively that the upper thread 16*a* and the lower thread 16*b* of the sewn portion for fixing 15 after sewing are disposed overlapping so as to cross on the top surface (upper surface) and the back surface (lower surface) of the fastener element 11. As a result, problems such as slack of the upper thread 16*a* and the lower thread 16*b*, lowering in the smoothness of coupling of the element rows 3 (easiness of coupling), and lowering of the sliding performance of the slider 60 due to the overlapping of the upper thread 16*a* and the lower thread 16*b* of the sewn portion for fixing 15 with the fastener element 11 can be prevented from occurring.

The sewn portion for fixing 15 of Embodiment 1 has a unit running area 17 in which the upper thread 16*a* and the lower thread 16*b* of lock stitches run from an outer peripheral crossing position crossing on an outer peripheral surface of the fixing member 13 to a next outer peripheral crossing position crossing on the outer peripheral surface of the fixing member 13 with respect to one fastener element 11, and stitches of the unit running area are formed by being repeated per fastener element 11 in the length direction. In this case, the stitches of each unit running area 17 forming the sewn portion for fixing 15 of Embodiment 1 has two piercing positions where the sewn portion for fixing 15 pierces the element attaching edge portion 2. In Embodiment 1, the stitching pattern in the unit running area 17 is formed not only in the area where the fastener elements 11 of the element member 10 are disposed, but also the area of the extending portion 13*b* of the fixing member 13 where the fastener elements 11 are not disposed so as to fix the extending portion 13*b* of the fixing member 13 to the element attaching edge portion 2.

Here, the unit running area 17 of the sewn portion for fixing 15 will be described in detail. The upper thread 16*a* and the lower thread 16*b* of the sewn portion for fixing 15 in Embodiment 1 includes a first running portion 17*a* disposed from the outer peripheral crossing position where the upper thread 16*a* and the lower thread 16*b* cross on the outer peripheral surface of the fixing member 13 to the first piercing position 18*a*, a second running portion 17*b* disposed from the first piercing position 18*a* to the next second piercing position 18*b*, and a third running portion 17*c* disposed from the second piercing position 18*b* to the next outer peripheral crossing position in each unit running area.

In this case, the first running portion 17*a* is formed such that the upper thread 16*a* (or the lower thread 16*b*) runs along a width direction (or substantially width direction) from the aforementioned outer peripheral crossing position to a position in a width direction corresponding to a side surface part of the fastener element 11, and further runs obliquely with respect to a width direction to the first piercing position 18*a*. A boundary part of the first running portion 17*a* between a portion running along a width direction and a portion running obliquely with respect to a width direction may be in contact with the body portion 12*a* of the fastener element 11. The second running portion 17*b* is formed such that the upper thread 16*a* (or the lower thread 16*b*) runs along a length direction of the element member 10 between the first piercing position 18*a* and the second piercing position 18*b*. The third running portion 17*c* is formed such that the upper thread 16*a* (or the lower thread 16*b*) runs obliquely with respect to a width direction from the second piercing position 18*b* to a position in a width direction corresponding to a side surface part of the fastener element 11, and further runs along a width direction (or substantially width direction) to an outer peripheral crossing position. In this case, the boundary part of the third running portion 17*c* between a portion running obliquely with respect, to a width direction and a portion running along a width direction may be in contact with the body portion 12*a* of the fastener element 11.

In Embodiment 1, the first piercing position 18*a* and the second piercing position 18*b*, through which the sewn portion for fixing 15 pierces the element attaching edge portion 2 of the cloth 1, are formed to be separated from an inner side surface part of each fastener element 11 toward an inner side of the cloth 1 in a width direction (in other words, a direction opposite to a direction facing to the fastener element 11 on a coupling counterpart side). That is, in a width direction of the element member 10, a constant interval is provided between the first and second piercing positions 18*a*, 18*b* of the sewn portion for fixing 15 and the position of the side surface part of each fastener element 11.

Since the positions of the first and second piercing positions 18*a*, 18*b* of the sewn portion for fixing 15 in this manner, it is possible to prevent the upper thread 16*a* and the lower thread 16*b* of the sewn portion for fixing 15 from overlapping the top surface and the back surface of the fastener element 11 more stably. Further, a large interval in a width direction between the first and second piercing positions 18*a*, 18*b* and a side end edge of the element attaching edge portion 2 can be secured. This makes it easy to stably secure the strength of the element attaching edge portion 2. For example, damages due to rubbing of the cloth 1 by the upper thread 16*a* and the lower thread 16*b*, such as cutting from the first piercing position 18*a* and the second piercing position 18*b* toward a side end edge of the element attaching edge portion 2, can be less likely to occur.

In Embodiment 1, a dimension in a length direction of the unit running area 17 of the sewn portion for fixing 15 is set to be the same size in the region of the element holding portion 13*a* and the region of the extending portion 13*b* of the fixing member 13. However, according to the present invention, by changing the coordinate data set for the zigzag stitch sewing machine, for example, it is possible to make a dimension different in a length direction of the unit running area 17 of the sewn portion for fixing 15 between in the region of the element holding portion 13*a* and in the region of the extending portion 13*b* of the fixing member 13. Furthermore, in the present invention, it is also possible to make a dimension in a length direction different for each unit running area 17 of the sewn portion for fixing 15 in the region of the extending portion 13*b* of the fixing member 13.

In the slide fastener-attached clothing item of Embodiment 1, an auxiliary sewn portion 19 for tightening the upper thread 16*a* and the lower thread 16*b* of the sewn portion for fixing 15 so as not to slack is continuously formed in a region between a position of a side surface part of each fastener element 11 in a width direction and the piercing positions (first piercing position 18*a* and second piercing position 18*b*) of the sewn portion for fixing 15.

In particular, the auxiliary sewn portion 19 of Embodiment 1 is formed linearly along a length direction of the element member 10 with lock stitches for interlacing an auxiliary upper thread (needle thread) and an auxiliary lower thread (bobbin thread) using a sewing machine. Since the auxiliary sewn portion 19 is formed with lock stitches in this manner, the auxiliary sewn portion 19 can be easily and stably formed, and the upper thread 16*a* and the lower thread 16*b* of the sewn portion for fixing 15 are stably pressed (tightened).

In this case, the auxiliary upper thread and the auxiliary lower thread of the auxiliary sewn portion 19 cross (interlace) with each other at a piercing position where the auxiliary sewn portion 19 pierces the element attaching edge portion 2, and at a position of a central portion of the element attaching edge portion 2 in a thickness direction. The crossing position of the auxiliary upper thread and the auxiliary lower thread in the thickness direction can be changed by controlling tension of the auxiliary upper thread and the auxiliary lower thread in the sewing machine. Further, the auxiliary sewn portion 19 of Embodiment 1 is formed such that the auxiliary upper thread crosses on the upper thread 16*a* and the auxiliary lower thread crosses on the lower thread 16*b* of the sewn portion for fixing 15 in a region overlapping the aforementioned first running portion 17*a* and the third running portion 17*c* of the sewn portion for fixing 15.

Since such an auxiliary sewn portion 19 is formed, the upper thread 16*a* and the lower thread 16*b* of the sewn portion for fixing 15 can be pressed toward the element attaching edge portion 2 from above and below by the auxiliary upper thread and the auxiliary lower thread (in other words, toward an inner side in a thickness direction). As a result, the upper thread 16*a* and the lower thread 16*b* of the sewn portion for fixing 15 can be lightened by the auxiliary sewn portion 19 to apply tension. Therefore, even when the upper thread 16*a* and the lower thread 16*b* of the sewn portion for fixing 15 are loosened, looseness thereof can be eliminated. It is also possible to effectively prevent looseness from occurring in the upper thread 16*a* and the lower thread 16*b* of the sewn portion for fixing 15.

Although the auxiliary sewn portion 19 of Embodiment 1 is formed by linear lock stitching along a length direction, in the present invention, the auxiliary sewn portion 19 may be formed with a stitch other than the lock stitch, such as a multi thread chain stitch as long as the upper thread 16*a* and the lower thread 16*b* of the sewn portion for fixing 15 can be pressed by the auxiliary sewn portion 19 toward the element attaching edge portion 2.

The left side element member 10*a* and the right side element member 10*b* are attached to the element attaching edge portions 2 of the right and left cloths 1 respectively with the aforementioned sewn portion for fixing 15 and the auxiliary sewn portion 19, thereby the right and left element rows 3 are formed along the element attaching edge portions 2 of the right and left cloths 1.

Further, the extending portion 13*b* of the fixing member 13 in the left side element member 10*a* is fixed to the element attaching edge portion 2 of the left side cloth 1 with the sewn portion for fixing 15 and the auxiliary sewn portion 19, thereby, at a side edge part on a rear side of the left side cloth 1, a member attaching portion 5 formed of the extending portion 13*b* of the fixing member 13 and a part of the element attaching edge portion 2, and to which the insert pin member 36 of the separable rear end stop 30 is to be attached is formed. Further, the extending portion 13*b* of the fixing member 13 in the right side element member 10*b* is fixed to the element attaching edge portion 2 of the right cloth 1 with the sewn portion for fixing 15 and the auxiliary sewn portion 19, thereby, at a side edge part on a rear side of the right side cloth 1, a member attaching portion 5 formed of the extending portion 13*b* of the fixing member 13 and a part of the element attaching edge portion 2, and to which the box body member 38 as a box member of the separable rear end stop 30 is attached is formed.

The separable rear end stop 30 of Embodiment 1 includes an insert pin portion 31 provided on the member attaching portion 5 of the left side cloth 1, a box body portion 32 provided on the member attaching portion 5 of the right cloth 1, and the above-mentioned box body side insertion portion 27. In the present invention, it is also possible to form a box body portion with a box pin, in which the box pin portion is integrally formed on a box body portion to be described later instead of the box body portion 32 and the box body side insertion portion 27.

The insert pin portion 31 of Embodiment 1 is formed by attaching the insert pin member 36 made of synthetic resin such as nylon to the above-mentioned member attaching portion 5 formed on the rear end part of the left side cloth 1 and on the facing side edge part.

Figure 11:
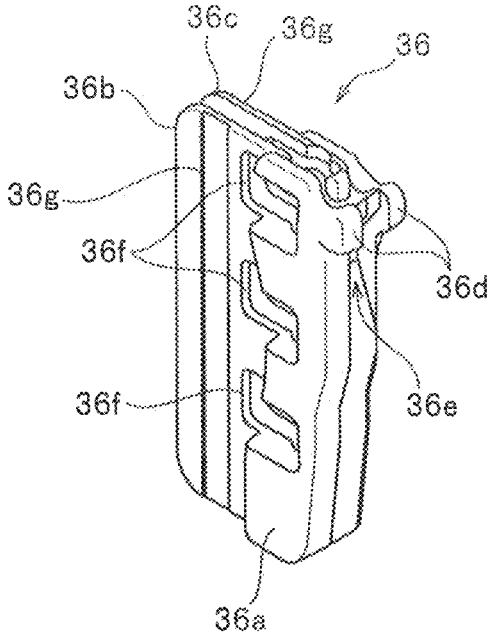
FIG. 11 is a perspective view of the insert pin member.
Figure 12:
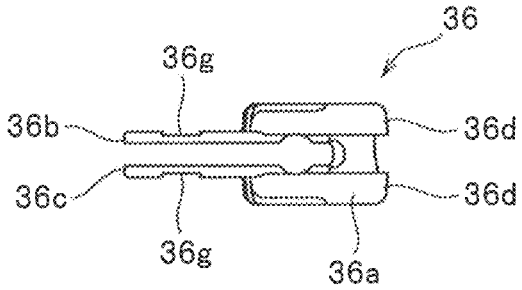
FIG. 12 is a front view of the insert pin member viewed from the front side where the fastener element is disposed.
Figure 13:
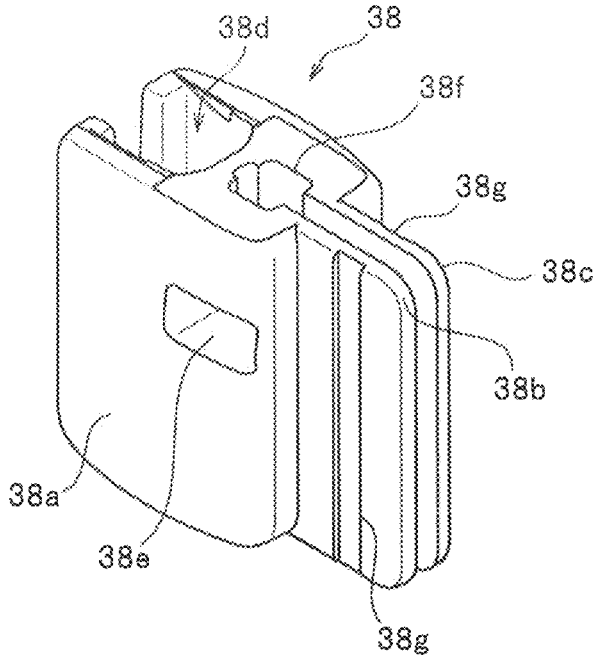
FIG. 13 is a perspective view of the box body member.
Figure 14:
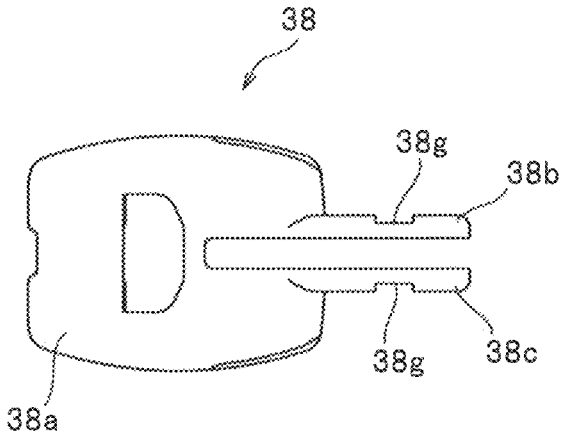
FIG. 14 is a front view of the box body member viewed from the rear side, which is opposite to the side on which the fastener element is disposed.

The insert pin member 36 of Embodiment 1 is one of the component parts forming the separable rear end stop 30. As shown in FIG. 10 to FIG. 12, the insert pin member 36 includes an insert pin main body portion 36*a* wrapping a part of the extending portion 13*b* of the fixing member 13 along the fixing member 13, a first insert pin fin portion 36*b* extending in a width direction from a side edge part of the insert pin main body portion 36*a* and disposed on an upper surface (first surface) of the element attaching edge portion 2, a second insert pin fin portion 36*c* extending in a width direction from a side edge part of the insert pin main body portion 36*a* and disposed on a lower surface (second surface) of the element attaching edge portion 2, and a coupling portion 36*d* integrally provided at a front end part of the insert pin main body portion 36*a* and coupled with the end part fastener element 11*a* of the right side element member 10*b*. In this case, an accommodating holding portion (inner space portion) which accommodates and wraps a part of the member attaching portion 5 formed on the cloth 1 is provided on an inside of the insert pin main body portion 36. A cross section of the insert pin member 36 orthogonal to a length direction has a substantially U shape.

On the facing side surface part of the insert pin main body portion 36*a* facing to the box body portion 32 in the insert pin member 36 of Embodiment 1, an insert pin side concave portion 36*e* into which the box body side insertion portion 27 of the right side element member 10*b* is inserted and accommodated is formed along a length direction.

Figure 4:
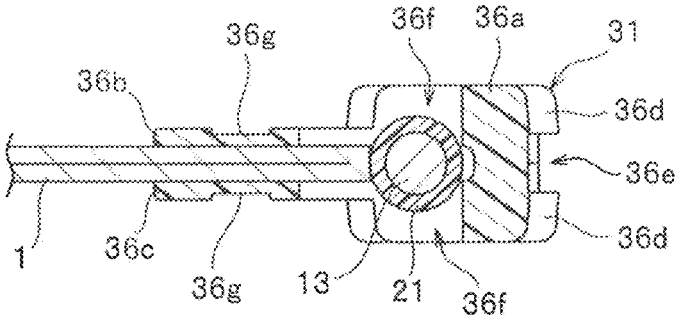
FIG. 4 is a cross sectional view taken along the line IV-IV shown in FIG. 2.
Figure 5:
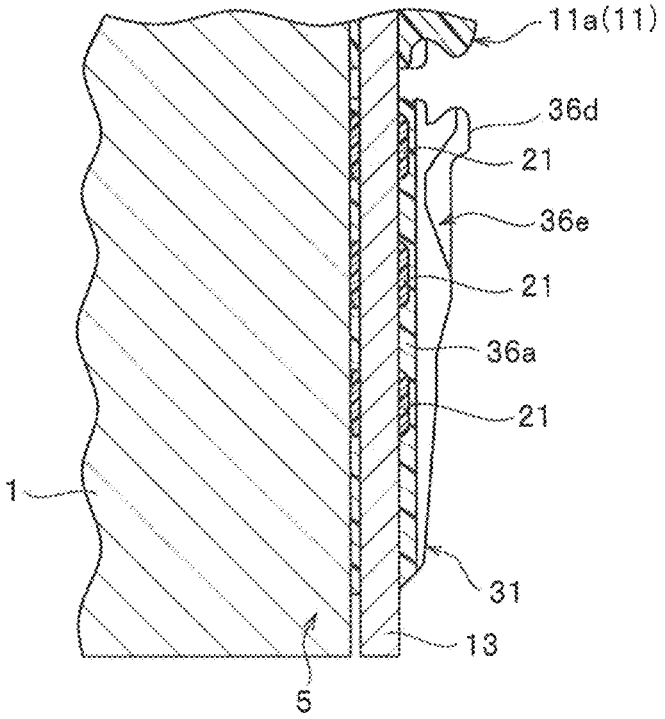
FIG. 5 is a cross sectional view taken along line V-V shown in FIG. 3.

Three upper surface side anchor accommodating hole portions 36*f* accommodating the first anchor elements 21 are provided on a connecting portion where the insert pin main body portion 36*a* and the first insert pin fin portion 36*b* on an upper surface side are connected to each other at predetermined intervals regularly in a length direction. As shown in FIG. 4, for example, three lower surface side anchor accommodating hole portions 36*f* accommodating the first anchor elements 21 are provided on a connecting portion where the insert pin main body portion 36*a* and the second insert pin fin portion 36*c* on a lower surface side are connected to each other in the same manner as the upper surface side anchor accommodating hole portion 36*f*. In the cross sectional views shown in FIGS. 4, 5, 7, and 16, each sewn portion such as the sewn portion for fixing, the auxiliary sewn portion, and the insert pin side sewn portion and the like are not shown in order to easily show the structure of the insert pin member and the like.

In this case, the upper surface side and lower surface side anchor accommodating hole portions 36*f* are disposed at positions corresponding to each other and formed to have a width dimension larger than the width dimension (dimension in the width direction) of the first anchor element 21. By securing the width dimension of the upper surface side and lower surface side anchor accommodating hole portion 36*f* larger than that of the first anchor element 21 as above, in attaching the insert pin member 36 to the member attaching portion 5 of the cloth 1, when the first anchor element 21 is accommodated into the upper surface side and lower surface side anchor accommodating hole portions 36*f* of the insert pin member 36, it is less possible that the upper surface side and lower surface side anchor accommodating hole portions 36*f* of the insert pin member 36 is caught by the first anchor element 21. Therefore, the operation of attaching the insert pin member 36 can be performed smoothly.

Further, on the upper surface of the first insert pin fin portion 36*b* and the lower surface of the second insert pin fin portion 36*c* of the insert pin member 36, an accommodating concave groove portion 36*g* for accommodating an insert pin side sewn portion 37 (described later) to be formed at the time of fixing the insert pin member 36 is provided along a length direction. In this case, the accommodating concave groove portion 36*g* of the first insert pin fin portion 36*b* and the accommodating concave groove portion 36*g* of the second insert pin fin portion 36*c* are formed at corresponding positions of the insert pin member 36 in a width direction. In the present invention, it is also possible to form the insert pin member 36 without providing the accommodating concave groove portions 36*g* on the first insert pin fin portion 36*b* and the second insert pin fin portion 36*c*. In the present invention, it is also possible to form an insert pin member without providing one or both of the first insert pin fin portion 36*b* and the second insert pin fin portion 36*c*. For example, in Embodiment 1, it is also possible to use an insert pin member in which the second insert pin fin portion 36*c* described above are removed from the insert pin member 36.

When the insert pin member 36 of Embodiment 1 is attached to the member attaching portion 5 formed on the left side cloth 1, the insert pin member 36 is first elastically deformed to have a slight interval between the first insert pin fin portion 36*b* and the second insert pin fin portion 36*c*, and covers the member attaching portion 5 of the cloth 1 such that the member attaching portion 5 is inserted between the first insert pin fin portion 36*b* and the second insert pin fin portion 36*c*.

At this time, as the insert pin member 36 elastically restores, the extending portion 13*b* of the fixing member 13 is inserted and accommodated in the aforementioned accommodating holding portion of the insert pin main body portion 36*a*, and the insert pin main body portion 36*a* wraps at least a part of the outer periphery of the extending portion 13*b* of the fixing member 13. The three first anchor elements 21 provided on the extending portion 13*b* of the fixing member 13 are inserted and accommodated into the three upper surface side anchor accommodating hole portions 36*f* formed on the side of the first insert pin fin portion 36*b* of the insert pin member 36 and the three lower surface side anchor accommodating hole portions 36*f* formed on the side of the second insert pin fin portion 36*c*, respectively.

This makes it possible to easily and stably position the insert pin member 36 at a predetermined position with respect to the member attaching portion 5 of the cloth 1 and to prevent the position of the insert pin member 36 from deviating in a length direction and a width direction. At the same time, the insert pin member 36 can be temporarily fixed at the position. Further, in this case, the upper surface side and lower surface side anchor accommodating hole portions 36*f* of the insert pin member 36 are open to an outer surface of the insert pin member 36, and the position of the first anchor element 21 can be visually confirmed via the upper surface side and lower surface side anchor accommodating hole portions 36*f*. Therefore, the above-described positioning of the insert pin member 36 can be easily and quickly performed.

Subsequently, the member attaching portion 5 of the cloth 1 and the insert pin member 36 temporarily fixed to the member attaching portion 5 are sewn together using a sewing machine, so that the insert pin side sewn portion 37 is formed, and the first insert pin fin portion 36*b* and the second insert pin fin portion 36*c* of the insert pin member 36 are sewn and fixed to the member attaching portion 5 of the cloth 1 with the insert pin side sewn portion 37. The insert pin side sewn portion 37 is linearly formed along a length direction of the element member 10 with lock stitches of interlacing an upper thread (needle thread) and a lower thread (bobbin thread). In this case, it is preferable that the insert pin side sewn portion 37 is formed by performing a reverse stitching, which makes less possible that a fray on an end part of the insert pin side sewn portion 37 occurs.

When sewing the insert pin member 36 to the member attaching portion 5 using a sewing machine, a sewing needle is pierced into the accommodating concave groove portions 36*g* of the first insert pin fin portion 36*b* and the accommodating concave groove portion 36*g* of the second insert pin fin portion 36*c*. Thereby, the insert pin side sewn portion 37 can be formed in the accommodating concave groove portion 36*g* of the first insert pin fin portion 36*b* and the accommodating concave groove portion 36*g* of the second insert pin fin portion 36*c*. Since the insert pin member 36 is thinly formed at a portion of the accommodating concave groove portion 36*g* of the first insert pin fin portion 36*b* and the accommodating concave groove portion 36*g* of the second insert pin fin portion 36*c*, even when the insert pin member 36 is pierced with the sewing needle, it is possible to prevent or suppress occurrence of breakage on the insert pin member 36 due to piercing of the sewing needle. The insert pin side sewn portion 37 is accommodated in the accommodating concave groove portion 36*g* of the first insert pin fin portion 36*b* and the accommodating concave groove portion 36*g* of the second insert pin fin portion 36*c*, which makes it less possible for upper and lower flange portions (described later) of the slider 60 to come into contact with the insert pin side sewn portion 37 each other, and makes it less possible for the insert pin side sewn portion 37 to cause yarn breakage.

As described above, the insert pin side sewn portion 37 is formed by the sewing machine to sew the member attaching portion 5 of the cloth 1 and the insert pin member 36 together, thereby the insert pin member 36 is fixed to a predetermined position of the member attaching portion 5 of the cloth 1. Therefore, the insert pin portion 31 formed of the insert pin member 36 can appropriately be provided so as to be adjacent to the end element 11*a* of the left side element row 3 and be continuous from the left side element row 3 along a length direction with respect to the cloth 1 to which the left side element member 10*a* is attached. In particular, in the insert pin portion 31 of Embodiment 1, the three first anchor elements 21 of the element member 10 are accommodated in the insert pin portion 31. Therefore, the attaching strength of the insert pin portion 31 with respect to the cloth 1 increases, and it makes less possible for the insert pin portion 31 to drop off from the cloth 1.

In the insert pin portion 31 of Embodiment 1 thus provided, in a state in which the insert pin member 36 is fixed to the member attaching portion 5, the insert pin main body portion 36*a* is formed to have a height dimension capable of being inserted into an element guide pass (described later) of the slider 60. Particularly in the case of Embodiment 1, a maximum value of a height dimension of the insert pin main body portion 36*a* is set to be the same as the height dimension of the fastener element 11. In the present invention, it is preferable that the height dimension of the insert pin main body portion 36*a* is the same as the height dimension of the fastener element 11, but it is sufficient as long as it is set within a region of ±20% with respect to the height dimension of the fastener element 11.

As described above, the first insert pin fin portion 36*b* on the upper surface side and the second insert pin fin portion 36*c* on the lower surface side are provided on the insert pin portion 31 of Embodiment 1. The first insert pin fin portion 36*b* and the second insert pin fin portion 36*c* are sewn to the member attaching portion 5 of the cloth 1, to thereby protect the member attaching portion 5, which makes less possible to cause fraying in the member attaching portion 5 itself.

In addition, a rigidity of the facing side edge part on the rear end side of the cloth 1 is enhanced by the sewn first insert pin fin portion 36*b* and the second insert pin fin portion 36*c*. This not only makes it easier for the insert pin portion 31 to be held with fingers by the first insert pin fin portion 36*b* and the second insert pin fin portion 36*c*, but also makes it difficult to bend in a top-back direction and a width direction of the cloth 1 when inserting the insert pin portion 31 into the slider 60 and the insert pin accommodating portion 38*d* of the box body portion 32. Therefore, the easiness of insertion of the insert pin portion 31 can be improved.

The upper surface of the first insert pin fin portion 36*b* and the lower surface of the second insert pin fin portion 36*c* are disposed at a height position closer to the cloth 1 than the upper surface and the lower surface of the insert pin main body portion 36*a* via a step. In this case, the height dimension from the upper surface of the first insert pin fin portion 36*b* to the lower surface of the second insert pin fin portion 36*c* in the insert pin portion 31 is set to be a size capable of inserting into an insertion gap formed between the upper and lower flanges of the slider 60. It should be noted that a length dimension (dimension in a length direction) and a width dimension (dimension in a width direction) in the first insert pin fin portion 36*b* and the second insert pin fin portion 36*c* are not limited and can be arbitrarily changed.

The box body portion 32 of Embodiment 1 is formed such that a box body member 38 made of synthetic resin such as nylon is attached to the above-mentioned member attaching portion 5 formed at the rear end part and at the facing side edge part of the right side cloth 1. The box body member 38 of Embodiment 1 is another component part forming the separable rear end stop 30. As shown in FIGS. 7, 10, 13, and 14, the box body member 38 includes a box body main body portion (box main body portion) 38*a* for wrapping the extending portion 13*b* of the fixing member 13 along the fixing member 13, a first box fin portion 38*b* extending along a width direction from a side edge part of the box body main body portion 38*a* toward an inside of the cloth 1 and disposed on an upper surface (first surface) of the element attaching edge portion 2, and a second box fin portion 38*c* extending along a width direction from a side edge part of the box body main body portion 38*a* toward an inside of the cloth 1 and disposed on a lower surface (second surface) of the element attaching edge portion 2.

The box body main body portion 38*a* of Embodiment 1 has a substantially rectangular parallelepiped or cubic outer shape. In a left side half portion of the box body main body portion 38*a* close to the insert pin portion 31, an insert pin accommodating portion 38*d* in which the insert pin main body portion 36*a* of the insert pin portion 31 is inserted and accommodated is provided from a front end edge of the box body main body portion 38*a* rearward. In a right side half portion of the box body main body portion 38*a* close to the member attaching portion 5 of the cloth 1, an accommodating holding portion (space portion) for accommodating and wrapping a part of the member attaching portion 5 formed on the cloth 1, a box body side anchor accommodating hole portion 38*e* accommodating the second anchor element 22, and a box body side anchor accommodating concave portion 38*f* accommodating a part of the third anchor element 23 are provided on each of the upper surface side and the lower surface side of the box body main body portion 38*a*. In this case, the box body side anchor accommodating hole portion 38*e* is formed to have a width dimension larger than that of the second anchor element 22. By thus increasing the width dimension of the box body side anchor accommodating hole portion 38*e* as above, as in the case of the insert pin member 36, when attaching the box body member 38 to the member attaching portion 5 of the cloth 1, it makes less possible for the box body side anchor accommodating hole portion 38*e* of the box body member 38 to be caught by the second anchor element 22. Therefore, the work of attaching the box body member 38 can be performed smoothly.

On an upper surface of the first box fin portion 38*b* and a lower surface of the second box fin portion 38*c* of the box body member 38, accommodating concave groove portions 38*g* for accommodating a box body side sewn portion described later (box side sewn portion) 39 are provided along a length direction, as in the case of the insert pin member 36. In the present invention, it is also possible to form the box body member 38 without providing the accommodating concave groove portion 38*g* on the first box fin portion 38*b* and the second box fin portion 38*c*. In the present invention, it is also possible to form the box body member 38 without providing one or both of the first box fin portion 38*b* and the second box fin portion 38*c*. For example, in Embodiment 1, the box body member in which the second box fin portion 38*c* described above is excluded from the box body member 38 can also be used.

When attaching the box body member 38 of Embodiment 1 to the member attaching portion 5 formed on the right side cloth 1, first, the box body member 38 is elastically deformed to have a slight interval between the first box fin portion 38*b* and the second box fin portion 38*c*, and covers the member attaching portion 5 of the cloth 1 such that the member attaching portion 5 is interposed between the first box fin portion 38*b* and the second box fin portion 38*c*.

At this time, the second anchor element 22 and a part of the third anchor element 23 provided on the extending portion 13*b* of the fixing member 13 are inserted and accommodated into the box body side anchor accommodating hole portion 38*e* and the box body side anchor accommodating concave portion 38*f* of the box body member 38, respectively. This makes it possible to stably position the box body member 38 at a predetermined position with respect to the member attaching portion 5 of the cloth 1, to prevent the position of the box body member 38 from deviating in a length direction and a width direction, and to temporarily fix the box body member 38 at the position.

Subsequently, the member attaching portion 5 of the cloth 1 and the box body member 38 temporarily fixed to the member attaching portion 5 are sewn together using a sewing machine, thereby, the box body side sewn portion 39 is formed as in the case of the aforementioned insert pin side sewn portion 37. At the same time, the first box fin portion 38*b* and the second box fin portion 38*c* of the box body member 38 are sewn and fixed to the box body side sewn portion 39 with the box body side sewn portion 39. At this time, since the box body side sewn portion 39 is formed within the accommodating concave groove portions 36*g* of the first box fin portion 38*b* and the accommodating concave groove portion 36*g* of the second box fin portion 38*c*, it is possible to prevent the box body member 38 from being damaged, as in the case of the insert pin member 36. It also makes less possible that yarn breakage in the box body side sewn portion 39 occurs.

As described above, the box body member 38 is fixed to the predetermined position of the member attaching portion 5 of the cloth 1 with the box body side sewn portion 39, so that the box body portion 32 formed of the box body member 38 can be appropriately provided with respect to the cloth 1 to which the right side element member 10*b* is attached. In this case, since the second anchor element 22 and a part of the third anchor element 23 of the right side element member 10*b* are accommodated in the box body portion 32, the attaching strength of the box body portion 32 is increased, and the box body portion 32 can be made less possible to drop off from the cloth 1.

Furthermore, as in the case of the insert pin portion 31, the first box fin portion 38*b* and the second box fin portion 38*c* are sewn to the box body portion 32 of Embodiment 1, so that it is possible to protect a facing side edge part on a rear end side of the cloth 1 and to have less fray occurred on the cloth 1. A height dimension from the upper surface of the first box fin portion 38*b* to the lower surface of the second box fin portion 38*c* in this box body portion 32 is set to be a size capable of inserting through an insertion gap formed between an upper and lower flanges of the slider 60. A length dimension and a width dimension of the first box fin portion 38*b* and the second box fin portion 38*c* are not limited and can be arbitrarily changed.

As schematically shown in FIG. 1, the slider 60 of Embodiment 1 includes a slider body 61 and a pull tab 66. Since the slider body 61 of Embodiment 1 is formed in substantially the same manner as the conventional general slider body, its detailed structure is not shown. The slider body 61 includes an upper wing plate 62, a lower wing plate disposed apart from and parallel to the upper wing plate 62, a guide post connecting front end parts (shoulder mouth side end parts) of the upper wing plate 62 and the lower wing plate, upper and lower flange portions disposed at right and left side edge parts of the upper wing plate 62 and lower wing plate, and a pull attaching portion 63 disposed on an upper surface of the upper wing plate 62.

In addition, right and left shoulder mouths are formed at a front end part of the slider body 61 with the guide post interposed therebetween, and a rear mouth is formed at a rear end part of the slider body 61. A substantially Y-shaped element guide pass is formed between the upper wing plate 62 and the lower wing plate so as to communicate the right and left shoulder mouths and the rear mouth. Between the upper and lower flange portions of the slider body 61, an insertion gap is formed through which the element attaching edge portion 2 of the cloth 1 is inserted.

Next, a manufacturing method of the slide fastener-attached clothing item of Embodiment 1 having the aforementioned separable rear end stop 30 will be described. First, a cloth 1 for clothing item, right and left element members 10, an insert pin member 36 and a box body member 38 forming the separable rear end stop 30 are respectively prepared. In the left side element member 10*a* of Embodiment 1, as described above, synthetic resin is directly injection-molded to the element holding portion 13*a* of one string-like fixing member 13, and a plurality of fastener elements 11 having a predetermined shape are formed at regular intervals. In addition, synthetic resin is directly injection-molded to an extending portion 13*b* of the same fixing member 13 to form three first anchor elements 21 at predetermined positions. In the right side element member 10*b*, synthetic resin is directly injection-molded to the element holding portion 13*a* of the other fixing member 13 to form a plurality of fastener elements 11, a second anchor element 22 and a third anchor element 23, and a box body side insertion portion 27 respectively at predetermined positions.

Furthermore, apart from the right and left element members 10, the cloth 1 for clothing item to be a fastener attached member is produced by knitting or weaving, and an insert pin member 36 and a box body member 38 having a predetermined shape as described above are formed by injection molding of synthetic resin. At this time, for example, if it is desired to apply waterproofness to the cloth 1, it is possible to coat the knitted or woven cloth 1 with synthetic resin or to affix a resin film. Further, a side edge part, which is a cutting end edge portion of the cut right and left cloths 1, is folded back in a U-shape to form an element attaching edge portion 2. In this case, the element attaching edge portions 2 respectively formed on the right and left pair of front body cloths 1 are provided at positions facing to each other when manufacturing the clothing item.

Next, cloth parts for forming an element member-attached clothing item 1 are produced using the right and left cloths 1 in which the element attaching edge portion 2 is formed after cutting into a predetermined shape.

First, as a first sewing process, a sewing processing is conducted to fix the element member 10 to the element attaching edge portion 2 of the cloth 1 by using a zigzag stitch sewing machine. At this time, by using the zigzag stitch sewing machine with the coordinate data of the needle location set, sewing is conducted by lock stitching so as to bend in a zigzag manner over the entire element holding portion 13*a* and the extending portion 13*b* in a length direction of the fixing member 13 with respect to the element member 10 and the element attaching edge portion 2 of the cloth 1. As a result, the element member 10 can be attached (sewn) and fixed to the element attaching edge portion 2 of the cloth 1 while forming a sewn portion for fixing 15. Further, the extending portion 13*b* of the fixing member 13 is sewn to the element attaching edge portion 2 of the cloth 1 with the sewn portion for fixing 15, so that the member attaching portions 5 for attaching the insert pin member 36 and the box body member 38 respectively are formed on facing side edge parts of rear end parts in the right and left cloths 1.

Next, as a second sewing process, a sewing processing is conducted to form an auxiliary sewn portion 19 by using a single needle lock stitch sewing machine with respect to the element attaching edge portion 2 of the cloth 1 to which the element member 10 is fixed with the sewn portion for fixing 15. This makes it possible to stably form the auxiliary sewn portion 19 composed of the aforementioned linear lock stitch at a predetermined position of the element attaching edge portion 2 on which the sewn portion for fixing 15 is formed. Since an upper thread 16*a* and a lower thread 16*b* of the sewn portion for fixing 15 are pressed toward the element attaching edge portion 2 with the auxiliary sewn portion 19, the element member 10 can be more firmly fixed to the element attaching edge portion 2.

After forming the auxiliary sewn portion 19, the insert pin member 36 and the box body member 38 are attached to the respective member attaching portions 5 formed at the rear end parts of the right and left cloths 1 as described above. That is, in the case of attaching the insert pin member 36, first, the insert pin member 36 is elastically deformed so as to have a slight interval between the first insert pin fin portion 36*b* and the second insert pin fin portion 36*c*, and covers an upper surface (first surface) and a lower surface (second surface) of the member attaching portion 5 of the cloth 1. At this time, the three first anchor elements 21 provided on the extending portion 13*b* of the fixing member 13 are inserted and accommodated in the three upper surface side anchor accommodating hole portions 36*f* and the lower surface side anchor accommodating hole portions 36*f* provided on the insert pin member 36, thereby, the insert pin member 36 can be stably positioned at a predetermined position, Subsequently, sewing is conducted to form an insert pin side sewn portion 37 on the member attaching portion 5 and the insert pin member 36 of the cloth 1 using a single needle lock stitch sewing machine. Thus, while forming the insert pin side sewn portion 37 within the accommodating concave groove portions 36*g* of the first insert pin fin portion 36*b* and the second insert pin fin portion 36*c* in the insert pin member 36, the insert pin member 36 (specifically the first insert pin fin portion 36*b* and the second insert pin fin portion 36*c*) can be sewn and firmly fixed to the member attaching portion 5 of the cloth 1. As a result, an insert pin portion 31 of the separable rear end stop 30 is provided so as to be continuous with the left side element row 3.

Also in the case of attaching the box body member 38, basically the same work as in the case of the insert pin member 36 is conducted. Thus, while forming the box body side sewn portion 39 within the accommodating concave groove portion 36*g* of the box body member 38, the box body member 38 can be sewn and firmly fixed to the member attaching portion 5 of the cloth 1. As a result, a box body portion 32 of the separable rear end stop 30 is provided on a rear side of the right side element row 3.

By conducting the above-described work, right and left cloth parts in which the right and left element members 10*a*, 10*b*, the insert pin member 36, and the box body member 38 are attached to the element attaching edge portions 2 are produced. In Embodiment 1, in addition to the above-described right and left pair of cloth parts, cloth parts and the like (not shown) constituting the right and left sleeves and the back body of the clothing item are prepared.

Thereafter, the produced cloth parts of each part are joined together by sewing or the like to assemble a clothing item. Further, the slider 60 is slidably attached to the element row 3 formed on the element attaching edge portion 2 of the cloth 1, and a stopper (not shown) for preventing the slider 60 from dropping off is provided at front end parts of the right and left element rows 3. As a result, the slide fastener-attached clothing item having the separable rear end stop 30 as shown in FIG. 1 is stably manufactured.

In the slide fastener-attached clothing item of Embodiment 1 thus manufactured, a part of the cloth 1 of the clothing item not only constitutes the clothing item, but also functions as a fastener tape of a conventional slide fastener. Therefore, in this slide fastener-attached clothing item, the function of the slide fastener can be provided in a form omitting a presence of the fastener tape which has been an essential component part in the conventional slide fastener. As a result, it is possible to reduce a manufacturing cost (particularly a material cost) of the slide fastener-attached clothing item. In addition, it is possible to reduce a weight of slide fastener-attached clothing item and to improve a flexibility of the clothing item.

Additionally, the separable rear end stop 30 is formed at the rear end part of the slide fastener, and this separable rear end stop 30 can be operated in the same manner as the conventional general separable rear end stop. For example, by separating the right and left element rows 3 in the slide fastener and by removing the insert pin portion 31 from the box body portion 32, it is possible to uncouple and separate the right and left front portions of the clothing item. Thereafter, the insert pin portion 31 of the separable rear end stop 30 is inserted into the box body portion 32 via the element guide pass of the slider 60, and then the slider 60 is slid frontward (in the closing direction), thereby the right and left element rows 3 can be smoothly coupled.

Furthermore, in the case of Embodiment 1, for example, after applying desired functions such as waterproofness and water repellency to the cloth 1, the element member 10, the insert pin member 36 and the box body member 38 can be directly attached to the cloth 1. Therefore, it is also possible to easily manufacture high quality slide fastener-attached clothing item with waterproofness and water repellency.

Embodiment 2

Figure 15:
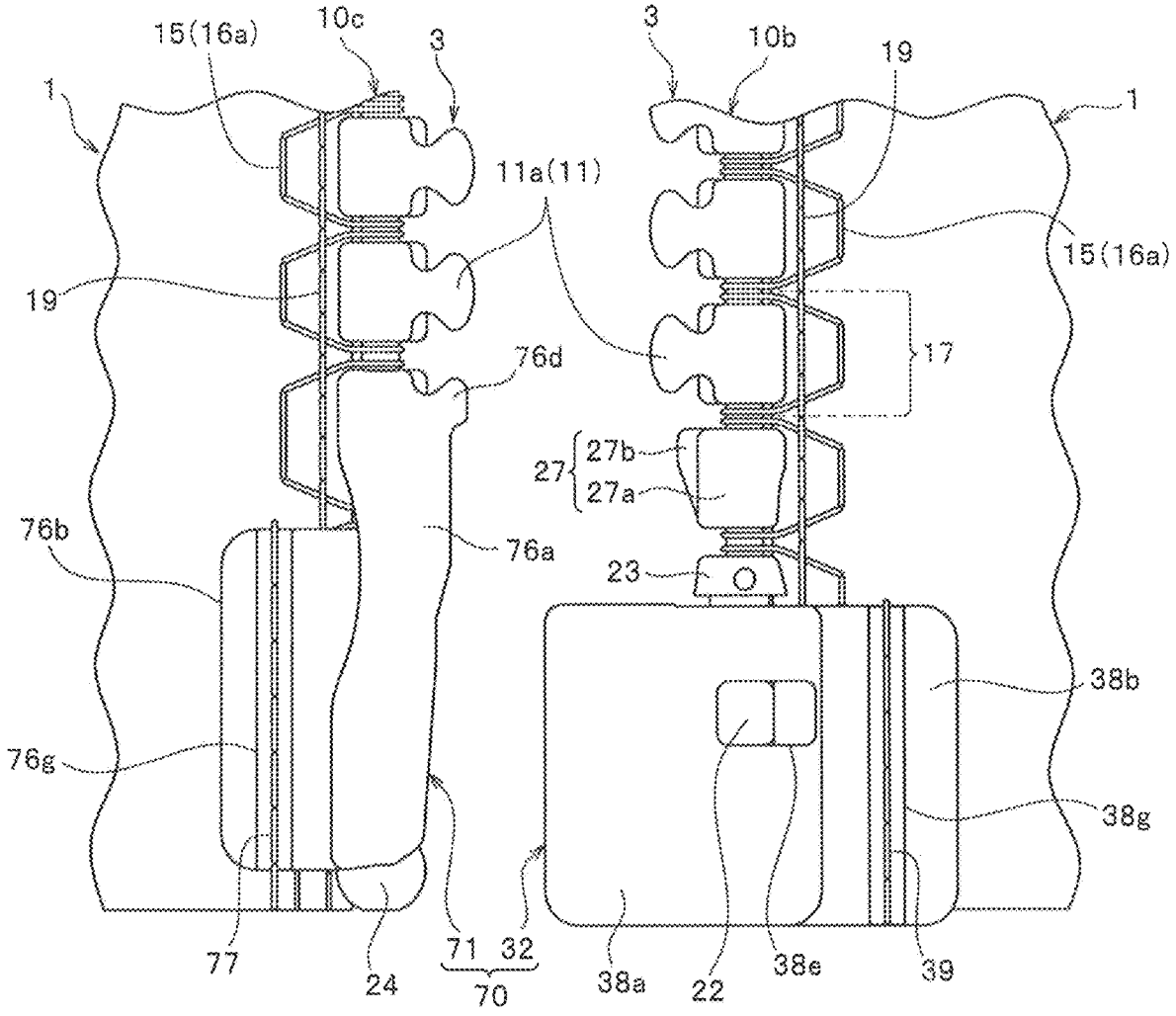
FIG. 15 is a plan view showing a slide fastener-attached product (clothing item) according to Embodiment 2 of the present invention in a state that a separable rear end stop is separated.
Figure 16:
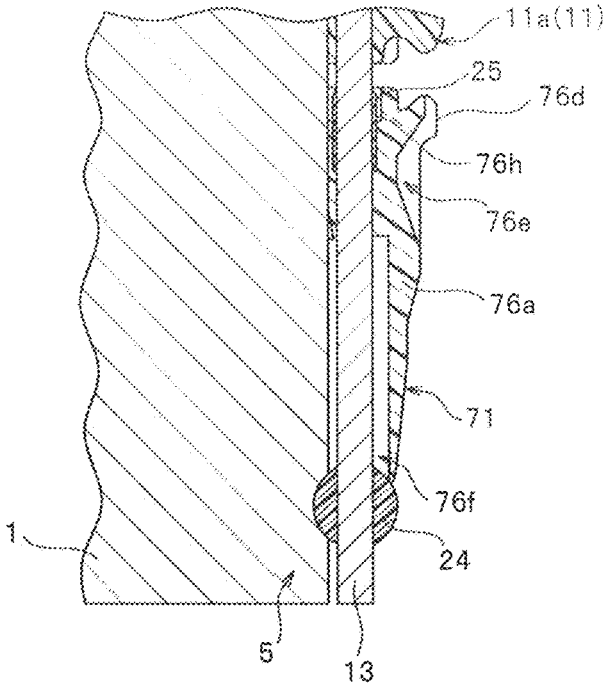
FIG. 16 is a cross sectional view showing a cross section orthogonal to a vertical direction of an element member and an insert pin portion.
Figure 17:
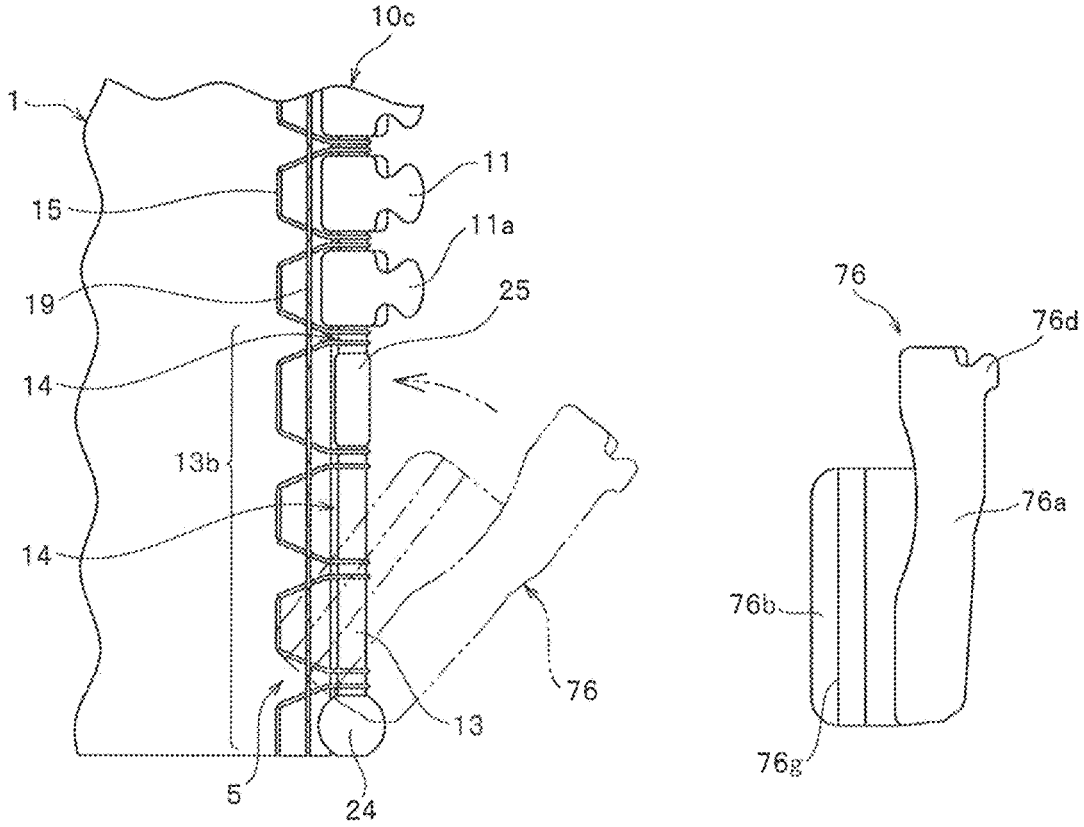
FIG. 17 is an explanatory drawing schematically explaining a movement of positioning an insert pin member of Embodiment 2 on a member attaching portion.
Figure 18:
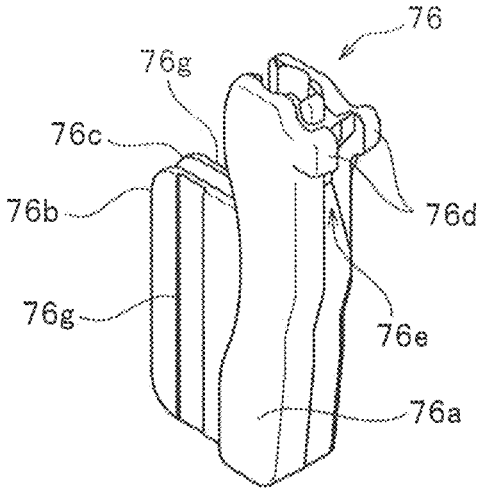
FIG. 18 is a perspective view of the insert pin member.
Figure 19:
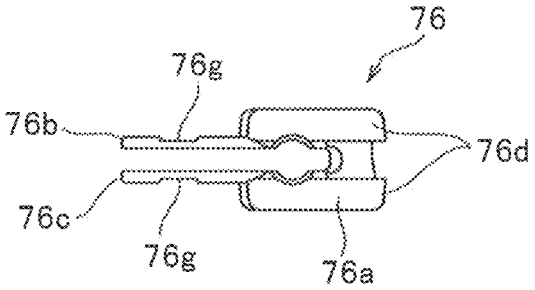
FIG. 19 is a front view of the insert pin member viewed from the front side where the fastener element is disposed.

FIG. 15 is a plan view showing a state in which the separable rear end stop is separated regarding a slide fastener-attached clothing item according to Embodiment 2. FIG. 16 is a cross-sectional view showing a cross section orthogonal to a vertical direction of an element member and an insert pin portion. FIG. 17 is an explanatory drawing schematically explaining a movement when positioning an insert pin member of Embodiment 2 on a member attaching portion. FIG. 18 and FIG. 19 are a perspective view and a front view showing the insert pin member.

Although the slide fastener-attached clothing item of Embodiment 2 is different from the slide fastener-attached clothing item of the aforementioned Embodiment 1 in that a forth anchor element 24 and a fifth anchor element 25 described later instead of the first anchor elements 21 in the above-mentioned Embodiment 1 are provided as anchor elements provided on a left side element member 10*c*, and that a shape of an insert pin portion 71 (insert pin member 76) is different, the structures other than the above are formed substantially the same manner as the slide fastener-attached clothing item of the above-described Embodiment 1.

Therefore, in Embodiment 2, components and members having substantially the same structure as those of the above-described Embodiment 1 are denoted by the same reference signs, and the explanation thereof is omitted. In addition, in a descriptions for Embodiment 3 and thereafter, which will be described later, the same reference signs are used for components and members having substantially the same structure as those of Embodiments explained earlier, and the explanation thereof will be omitted.

The left side element member 10*c* used in Embodiment 2 includes a plurality of independent fastener elements 11, a single string-like fixing member 13 connecting the plurality of fastener elements 11 at constant intervals, and a fourth anchor element 24 and a fifth anchor element 25 disposed on the extending portion 13*b* of the fixing member 13. Further, in the left side extending portion 13*b*, a portion where the fourth anchor element 24 and the fifth anchor element 25 are not disposed is formed as an exposed portion 14. In this case, an overall length dimension of the left side extending portion 13*b* including the exposed portion 14 is set to be larger than a size of an attaching pitch between the two fastener elements 11 adjacent in a length direction, and preferably larger than twice of the attaching pitch.

The fourth anchor element 24 of Embodiment 2 is disposed at a rear end part of the fixing member in the left side element member 10*c* and the fifth anchor element 25 is disposed adjacent to an end part fastener element 11*a* in the left side element member 10*c*. In this case, an interval between the fifth anchor element 25 and the end part fastener element 11*a* is the same size as the attaching interval of the fastener elements 11 in the left side element member 10*c*. Thereby, when attaching the left side element member 10*c* to an element attaching edge portion 2 of the cloth 1 with a zigzag-shaped sewn portion for fixing 15 using a zigzag stitch sewing machine, a region of the extending portion 13*b* of the fixing member 13 can be sewn with the same stitching pattern as in a region of the element holding portion 13*a* without interference of a sewing needle with the fifth anchor element 25. As a result, a member attaching portion 5 in which the extending portion 13*b* of the fixing member 13 is fixed to the element attaching edge portion 2 of the cloth 1 is formed at a rear side of the end part fastener element 11*a* in the left side cloth 1 and at a facing side edge part facing to a box body portion 32.

In Embodiment 2, the fourth anchor element 24 has a spherical shape bulging in a radial direction of the fixing member 13 from the extending portion 13*b* of the fixing member 13. The fifth anchor element 25 has a columnar shape bulging in a radial direction of the fixing member 13 from the extending portion 13*b* of the fixing member 13.

As shown in FIGS. 16 to 19, an insert pin member 76 of Embodiment 2 includes an insert pin main body portion 76*a* wrapping a part of the extending portion 13*b* of the fixing member 13 along the fixing member 13, a first insert pin fin portion 76*b* extending in a width direction from a side edge part of the insert pin main body portion 76*a* and disposed on an upper surface of the element attaching edge portion 2, a second insert pin fin portion 76*c* extending in a width direction from a side edge part of the insert pin main body portion 76*a* and disposed on a lower surface of the element attaching edge portion 2, and a coupling portion 76*d* integrally provided on a front end part of the insert pin main body portion 76*a* and to be coupled with the end part fastener element 11*a* in the right side element member 10*b*. In Embodiment 2, the first insert pin fin portion 76*b*, the second insert pin fin portion 76*c*, and the coupling portion 76*d* of the insert pin member 76 are formed to be in a substantially same manner as the corresponding portions of the insert pin member 36 of the above-mentioned Embodiment 1.

In the insert pin member 76 of Embodiment 2, an insert pin side concave portion 76*e* accepting a box body side insertion portion 27 provided on the right side element member 10*b* is formed along a length direction at a facing side surface part of the insert pin main body portion 76*a* facing to the box body portion 32.

As shown in FIG. 16, an anchor accommodating concave portion on rear end side 76*f* for accommodating and holding a part of the four anchor element 24, and for sliding contacting with the fourth anchor element 24 is provided on an inner peripheral surface of a rear end part in the insert pin main body portion 76*a* of Embodiment 2. An anchor accommodating concave portion on front end side 76*h* for accommodating and holding the fifth anchor element 25 is provided on an inner peripheral surface of a front end part in the insert pin main body portion 76*a* of Embodiment 2.

When the insert pin member 76 of Embodiment 2 as described above is attached to the member attaching portion 5 formed on the left side cloth 1, as shown in FIG. 17, firstly, the insert pin member 76 is elastically deformed so as to have a slight interval between the first insert pin fin portion 76*b* and the second insert pin fin portion 76*c*, and the member attaching portion 5 of the cloth 1 is covered with the first insert pin fin portion 76*b* and the second insert pin fin portion 76*c* such that the member attaching portion 5 is obliquely interposed between the first insert pin fin portion 76*b* and the second insert pin fin portion 76*c*. At this time, a part of the fourth anchor element 24 of the element member 10 is accommodated in the anchor accommodating concave portion on rear end side 76*f* of the insert pin main body portion 76*a*.

Subsequently, as shown by an imaginary line in FIG. 17, the insert pin main body portion 76*a* is rotated in a counterclockwise direction in a plan view while sliding contacting with the fourth anchor element 24 of the element member 10. Thereby, while covering the member attaching portion 5 of the cloth 1 with the insert pin member 76, the extending portion 13*b* of the fixing member 13 is accommodated and held in the insert pin main body portion 76*a*, and the fifth anchor element 25 of the element member 10 is inserted into the anchor accommodating concave portion on front end side 76*h* of the insert pin main body portion 76*a* and accommodated therein. As a result, the insert pin member 76 can be stably positioned at a predetermined position with respect to the member attaching portion 5 of the cloth 1, and the insert pin member 76 can be temporarily fixed to the position.

Subsequently, the member attaching portion 5 of the cloth 1 and the insert pin member 76 temporarily fixed to the member attaching portion 5 are sewn together with lock stitches using a sewing machine in the same manner as in the above-mentioned Embodiment 1. As a result, the insert pin side sewn portion 77 shown in FIG. 15 is formed, and the insert pin member 76 is sewn and fixed to the member attaching portion 5 of the cloth 1 with the insert pin side sewn portion 77. In this case, the insert pin side sewn portion 77 is formed within the accommodating concave groove portions 76*g* of the first insert pin fin portion 76*b* and the accommodating concave groove portion 76*g* of the second insert pin fin portion 76*c*. Thereby, the insert pin portion 71 formed of the insert pin member 76 can be appropriately provided on the member attaching portion 5 of the cloth 1 so as to be continuous rearward from the left side element row 3.

In the insert pin portion 71 of Embodiment 2 thus provided, in a state in which the insert pin member 76 is fixed to the member attaching portion 5, the insert pin main body portion 76*a* is formed to have a height dimension capable of being inserted into the element guide pass of the slider 60. In Embodiment 2, the right side element member 10*b* and the box body portion 32 are formed in the same manner as in the above-described Embodiment 1.

The slide fastener-attached clothing item of Embodiment 2 having the insert pin portion 71 as described above is formed without a fastener tape, and the separable rear end stop 70 is formed of the insert pin portion 71 and the box body portion 32. Therefore, also in the slide fastener-attached clothing item of the above-mentioned Embodiment 2, the same effect as in the slide fastener-attached clothing item of Embodiment 1 described above can be obtained.

Embodiment 3

Figure 20:
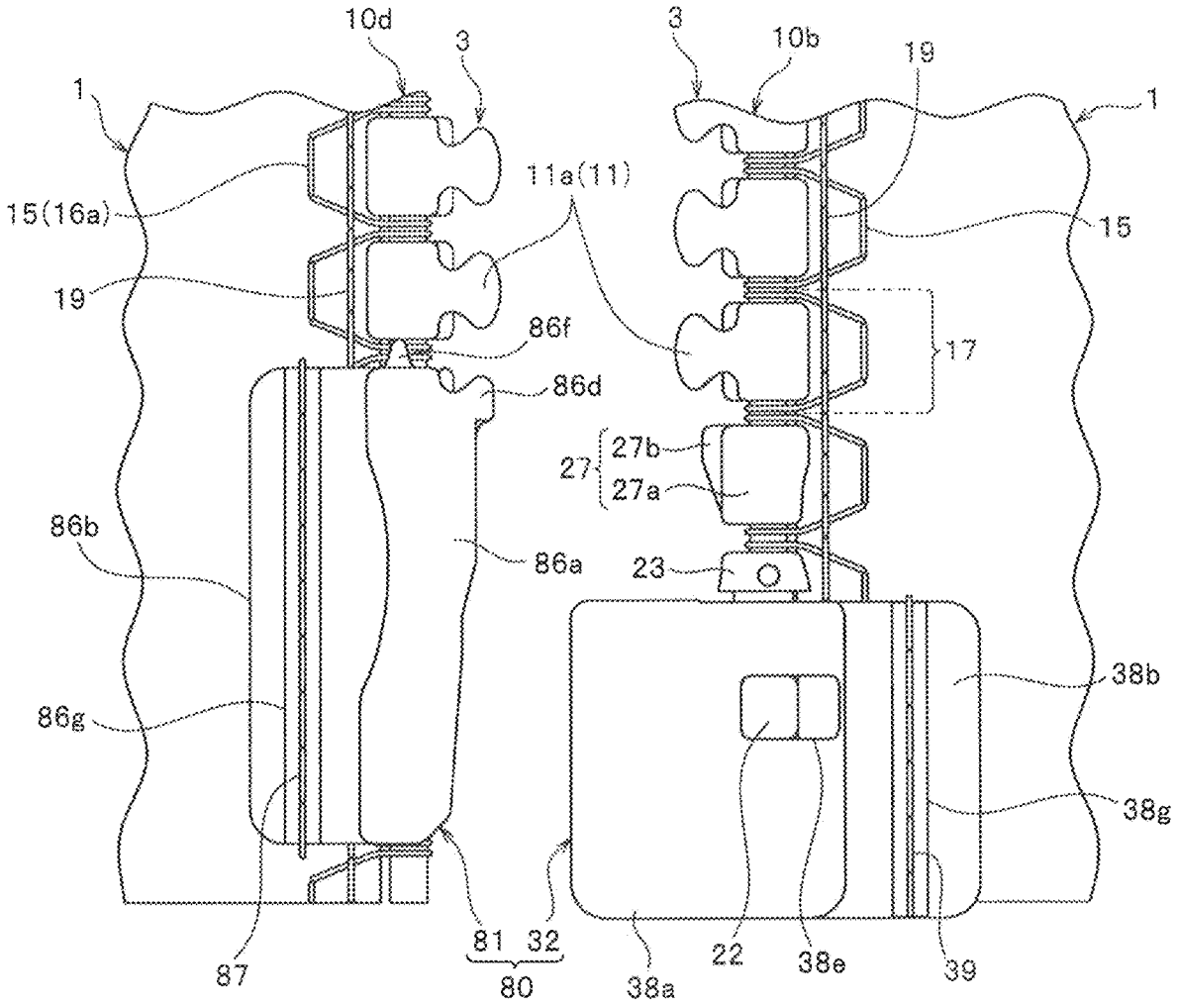
FIG. 20 is a plan view showing a state in which a separable rear end stop of a slide fastener-attached product according to Embodiment 3 of the present invention is separated.
Figure 21:
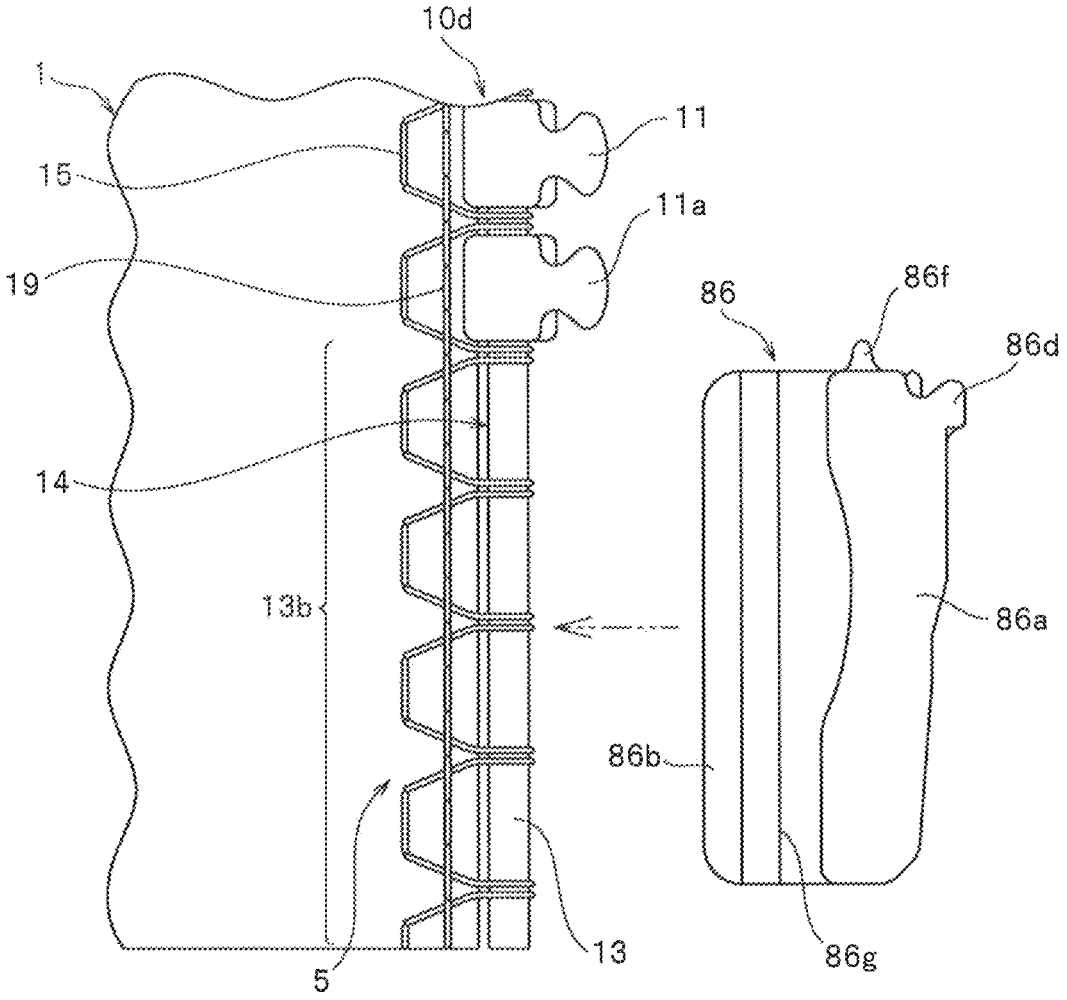
FIG. 21 is a plan view showing a state before an insert pin member of Embodiment 3 is attached to a member attaching portion.

FIG. 20 is a plan view showing a state in which a separable rear end stop of a slide fastener-attached clothing item according to Embodiment 3 is separated. FIG. 21 is a plan view showing a state before an insert pin member of Embodiment 3 is attached to a member attaching portion.

In the slide fastener-attached clothing item of Embodiment 3, any anchor element is not disposed on the left side element member 10*d*, and a front protruding portion 86*f* in contact with an end part fastener element 11*a* is provided on an insert pin portion 81 (insert pin member 86).

Specifically, as shown in FIG. 21, a left side element member 10*d* used in Embodiment 3 includes a plurality of independent fastener elements 11 and a single string-like fixing member 13 connecting the plurality of fastener elements 11 at constant intervals. Whereas no molded body is provided on an extending portion 13*b* of the fixing member 13, and the only extending portion 13*b* of the fixing member 13 extends rearward of the end part fastener element 11*a*. That is, in Embodiment 3, the entire extending portion 13*b* is formed as an exposed portion 14.

Therefore, an element member 10 of Embodiment 3 is attached to an element attaching edge portion 2 of the cloth 1 with a zigzag-shaped sewn portion for fixing 15 using a zigzag stitch sewing machine, thereby, the extending portion 13*b* of the fixing member 13 is fixed to the element attaching edge portion 2 of the cloth 1 with the sewn portion for fixing 15 on a rear side of the end part fastener element 11*a*. As a result, a member attaching portion 5 is formed behind the end part fastener element 11*a* in the left side cloth 1 and at a facing side edge part facing to the box body portion 32.

The insert pin member 86 of Embodiment 3 includes an insert pin main body portion 86*a* wrapping a part of the extending portion 13*b* of the fixing member 13 along the fixing member 13, a first insert pin fin portion 86*b* extending in a width direction from a side edge part of the insert pin main body portion 86*a* and disposed on an upper surface of the element attaching edge portion 2, a second insert pin fin portion (not shown) extending in a width direction from a side edge part of the insert pin main body portion 86*a* and disposed on a lower surface of the element attaching edge portion 2, and a coupling portion 86*d* integrally provided at a front end part of the insert pin main body portion 86*a* and to be coupled with the end part fastener element 11*a* of the right side element member 10*b*. Further, at an facing side surface part of the insert pin main body portion 86*a* facing to the box body portion 32, an insert pin side concave portion (not shown) accepting a box body side insertion portion 27 provided on the right side element member 10*b* is formed along a length direction.

Although neither anchor accommodating hole portion nor anchor accommodating concave portion for accommodating anchor elements is provided on the insert pin main body portion 86*a* of Embodiment 3, a front protruding portion 86*f* protruding frontward from a front end part of the insert pin main body portion 86*a* and positioning the insert pin member 86 by contacting with the end part fastener element 11*a* of the left side element member 10*d* is provided.

When the insert pin member 86 of Embodiment 3 as described above is attached to the member attaching portion 5 formed on the left side cloth 1, the insert pin member 86 is elastically deformed so as to have a slight interval between the first insert pin fin portion 86*b* and the second insert pin fin portion. While making the front protruding portion 86*f* of the insert pin member 86 contacted with the end part fastener element 11*a* of the left side element member 10*d*, the member attaching portion 5 of the cloth 1 is covered with the insert pin member 86 such that the member attaching portion 5 is inserted between the first insert pin fin portion 86*b* and the second insert pin fin portion. Thereby, the insert pin member 86 can be stably set at a predetermined position with respect to the member attaching portion 5 of the cloth 1.

Subsequently, the member attaching portion 5 of the cloth 1 and the insert pin member 86 set to the member attaching portion 5 are sewn together with lock stitches using a sewing machine in the same manner as in the above-mentioned Embodiment 1, so that the insert pin side sewn portion 87 is formed, and the insert pin member 86 is sewn and fixed to the member attaching portion 5 of the cloth 1 with the insert pin side sewn portion 87. In this case, the insert pin side sewn portion 87 is formed within the accommodating concave groove portions 86*g* of the first insert pin fin portion 86*b* and the accommodating concave groove portion 86*g* of the second insert pin fin portion. As a result, the insert pin portion 81 can be appropriately provided on the member attaching portion 5 of the cloth 1 so as to be continuous with the left side element row 3.

The slide fastener-attached clothing item of Embodiment 3 having such an insert pin portion 81 is formed without a fastener tape, and a separable rear end stop 80 is formed of the insert pin portion 81 and the box body portion 32. Therefore, also in the slide fastener-attached clothing item of Embodiment 3, the same effect as in the slide fastener-attached clothing item of Embodiment 1 described above can be obtained.

In Embodiments 1 to 3 described above, the right side element member 10*b* and the box body member 38 described above are attached to the facing side edge part on rear side of the right side cloth 1, so that the box body portion 32 and the box body side insertion portion 27 are provided. However, in the slide fastener-attached clothing item of Embodiments 1 to 3, a right side element member 10*g* and a box body member 78 shown in FIGS. 22 and 23 instead of the above-mentioned right side element member 10*b* and the box body member 38 are also used. Thereby, it is also possible to form a separable rear end stop provided with a box pin-integrated type box body portion (box body portion with a box pin) formed of the box body member 78.

Here, the right side element member 10*g* and the box body member 78 shown in FIGS. 22 and 23 will be described.

Figure 22:
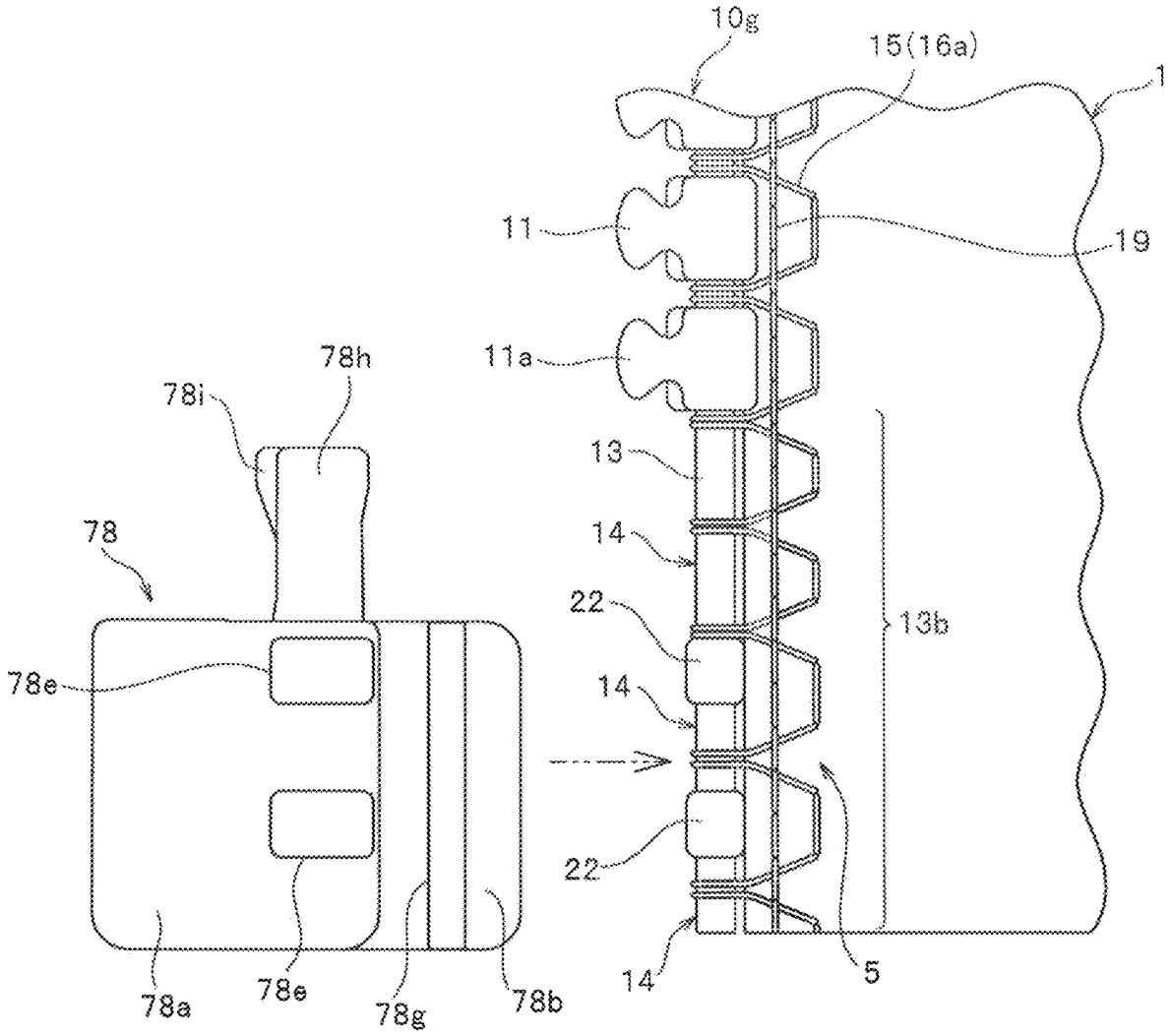
FIG. 22 is a plan view showing a main portion of right side element member and box body member which can be used instead of the right side element member and the box member of Embodiments 1-3.

The right side element member 10*g* shown in FIG. 22 includes a plurality of independent fastener elements 11, a single string-like fixing member 13 connecting the plurality of fastener elements 11 at constant intervals, and two second anchor elements 22 disposed on the extending portion 13*b* of the fixing member 13. In this case, the two second anchor elements 22 are formed in the same manner as the second anchor element 22 described in the aforementioned Embodiment 1.

The right side element member 10*g* is attached to the element attaching edge portion 2 of the cloth 1 with a zigzag-shaped sewn portion for fixing 15 and an auxiliary sewn portion 19 using a zigzag stitch sewing machine, thereby, the extending portion 13*b* of the fixing member 13 is fixed to the element attaching edge portion 2 of the cloth 1 on a rear side of the end part fastener element 11*a*. As a result, the member attaching portion 5 is formed on a rear side of the end part fastener element 11*a* in the right side cloth 1 and at a facing side edge part facing to the insert pin portions 31, 71, 81.

Figure 23:
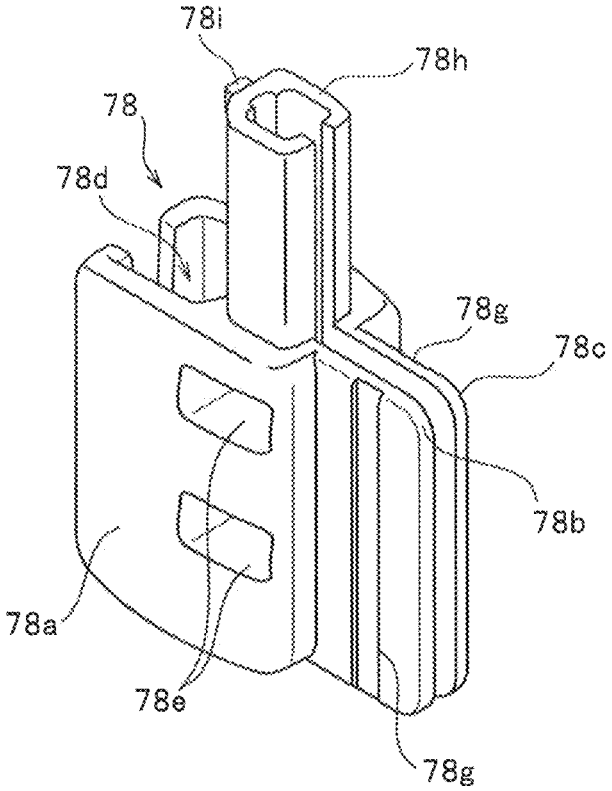
FIG. 23 is a perspective view of the box body member.

The box body member 78 with a box pin shown in FIGS. 22 and 23 includes a box body main body portion (box main body portion) 78*a* wrapping at least a rear end part of the extending portion 13*b* of the fixing member 13, a first box fin portion 78*b* extending in a width direction from a side edge part of the box body main body portion 78*a* and disposed on an upper surface of the element attaching edge portion, a second box fin portion 78*c* extending in a width direction from a side edge part of the box body main body portion 78*a* and disposed on a lower surface of the element attaching edge portion, a box pin main body portion 78*h* extending frontward from the box body main body portion 78*a* and wrapping the extending portion 13*b* of the fixing member 13, and a thin plate-like box pin side insertion portion 78*i* protruding from a front end part of the box pin main body portion 78*h* along a width direction.

In this case, the box pin side insertion portion 78*i* of the box body member 78 is inserted into the insert pin side concave portions 36*e*, 76*e* of the insert pin portions 31, 71, 81 when the insert pin portions 31, 71, 81 of the separable rear end stop are inserted and accommodated in the box body main body portion 78*a*, thereby, it is possible to stabilize a positional relationship between the insert pin portions 31, 71, 81 and the box body portion with the box pin.

The box body main body portion 78*a* of the box body member 78 has a substantially rectangular parallelepiped or cubic outer shape. In a left side half portion of the box body main body portion 78*a*, an insert pin accommodating portion 78*d* is provided from a front end edge of the box body main body portion 78*a* rearward in the same manner as the box body main body portion 38*a* described in Embodiment 1. Further, in a right side half portion of the box body main body portion 78*a*, two box body side anchor accommodating hole portions 78*e* for accommodating the second anchor elements 22 are provided.

The first box fin portion 78*b* and the second box fin portion 78*c* of the box body member 78 are formed substantially in the same manner as in Embodiment 1 described above, and an accommodating concave groove portion 78*g* for accommodating a box body side sewn portion to be described later is provided along a length direction in an upper surface of the first box fin portion 78*b* and a lower surface of the second box fin portion 78*c*

The box pin main body portion 78*h* of the box body member 78 has a shape in which a cross section orthogonal to a length direction is substantially C-shaped and is integrally formed with the box body main body portion 78*a*. In this case, an accommodating holding portion (space portion) for accommodating and wrapping a part of the member attaching portion 5 formed on the cloth 1 is continuously formed along a length direction on the box body main body portion 78*a* and the box pin main body portion 78*h*.

The box body member 78 as described above is fixed to the member attaching portion 5 of the cloth 1 by the same method as the box body member 38 described in Embodiment 1. That is, first, the member attaching portion 5 formed on the right side cloth 1 is covered with the box body member 78 and the two second anchor elements 22 are accommodated in the two box body side anchor accommodating hole portions 78*e* provided on the box body main body portion 78*a* to position the box body member 78. Thereafter, the box body side sewn portion (not shown) is formed with lock stitches and the box body member 78 is sewn and fixed to the member attaching portion 5 of the cloth 1 with the box body side sewn portion, using a sewing machine. Thereby, a box body portion with a box pin in which a box pin portion formed of the box pin main body portion 78*h* is integrated with the box body portion formed of the box body main body portion 78*a* can be provided at a predetermined position of the member attaching portion 5 of the right side cloth 1.

Also the separable rear end stop provided with the box body portion with a box pin formed of the box body member 78 as described above and each insert pin portion 31, 71, 81 in Embodiments 1 to 2 described above is formed on a slide fastener-attached clothing item, thereby, the same effect as the slide fastener-attached clothing item of above-described Embodiments 1 to 3 can be obtained.

Embodiment 4

Figure 24:
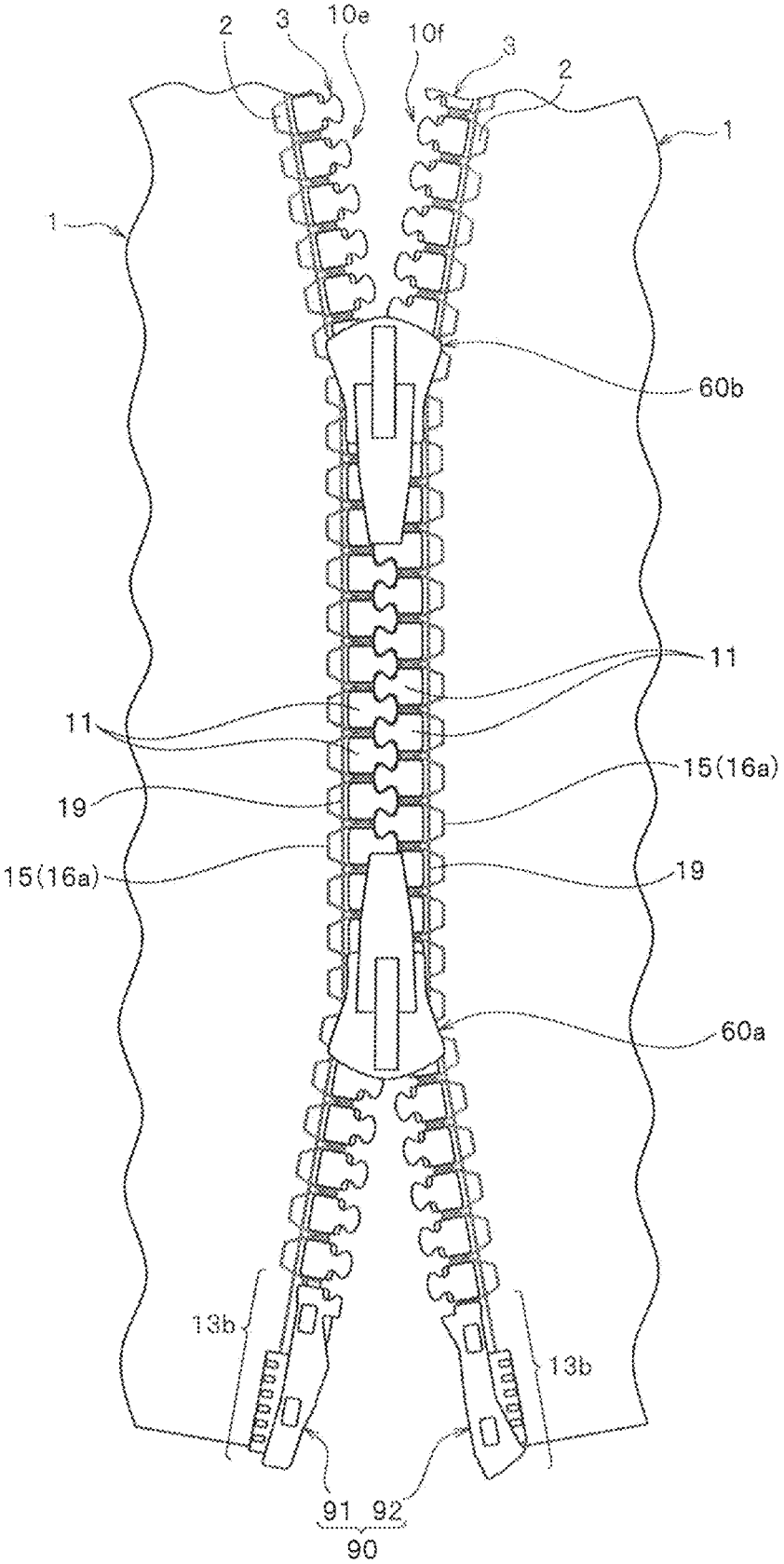
FIG. 24 is a plan view schematically showing a main portion of a slide fastener-attached product (clothing item) according to Embodiment 4 of the present invention.
Figure 25:
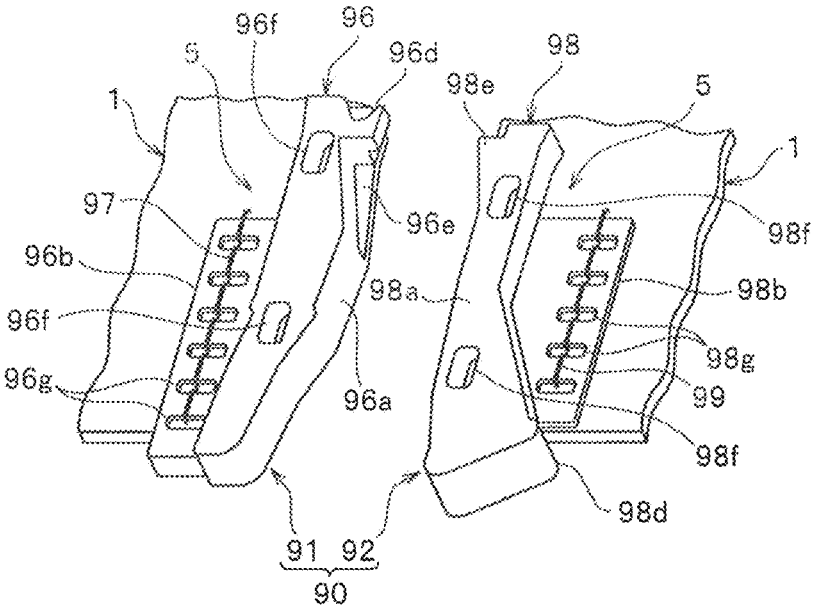
FIG. 25 is a perspective view schematically showing an insert pin portion and a box pin portion of Embodiment 4.
Figure 26:
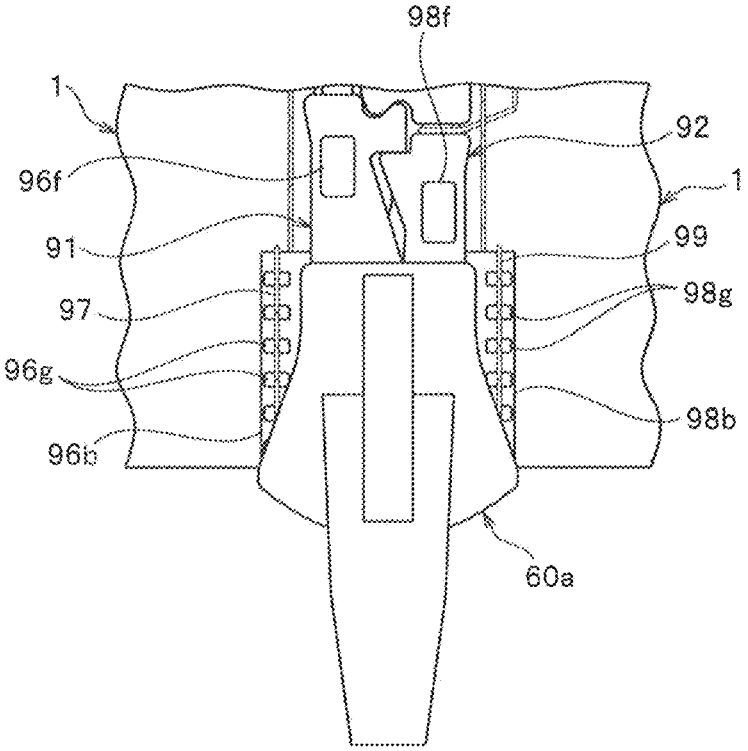
FIG. 26 is a plan view showing a positional relationship of the insert pin portion, the box pin portion, and a first slider in a state where right and left element rows are coupled with each other in Embodiment 4.

FIG. 24 is a plan view schematically showing a main part of a slide fastener-attached clothing item according to Embodiment 4. FIG. 25 is a perspective view schematically showing an insert pin portion and a box pin portion of Embodiment 4. FIG. 26 is a plan view showing a positional relationship between the insert pin portion, the box pin portion, and a first slider in a state where right and left element rows are coupled with each other in Embodiment 4. In FIGS. 25 and 26, a fastener element 11, a sewn portion for fixing 15, and an auxiliary sewn portion 19 are not shown in order to clearly show the structure of the separable rear end stop.

A slide fastener of Embodiment 4 includes right and left pair of fastener stringers having an element row 3 formed by directly fixing an element member 10 to a cloth 1 of a clothing item, a rear side first slider 60*a* and a front side second slider 60*b* capable of coupling and separating the right and left fastener stringers, and a separable rear end stop 90 having an insert pin portion 91 and a box pin portion 92 which are disposed adjacent to rear end parts of the right and left element rows 3. In this case, the corresponding two sliders, first slider 60*a* and second slider 60*b*, have substantially the same structure as the slider 60 used in the above-described Embodiment 1, and are attached to the element rows 3 slidably in a posture that rear mouths face to each other.

The separable rear end stop 90 provided on the slide fastener-attached clothing item of Embodiment 4 includes the insert pin portion 91 and the box pin portion 92 disposed at a position facing to each other. The separable rear end stop 90 is formed as a reverse opening type separable rear end stop having no box body portion capable of inserting the insert pin portion 91, unlike the above-described Embodiments 1 to 3.

Right and left element members 10*e*, 10*f* in Embodiment 4 include a plurality of independent fastener elements 11, a fixing member 13 connecting the plurality of fastener elements 11, and two sixth anchor elements (not shown) disposed on the extending portion 13*b* of the fixing member 13. In this case, the sixth anchor element of Embodiment 4 has the same shape and size as the first anchor element 21 of Embodiment 1 described above, or is formed in a columnar shape having a smaller radius than that of the first anchor element 21.

The right side element member 10*f* of Embodiment 4 has an attaching position of the fastener elements 11 and the sixth anchor elements deviated in a length direction with respect to the left side element member 10*e*, but is formed in a bilaterally symmetrical form. The extending portion 13*b* of the left side element member 10*e* and the extending portion 13*b* of the right side element member 10*f* are respectively provided with exposed portions 14 in which the sixth anchor elements are not disposed.

The separable rear end stop 90 of Embodiment 4 includes the insert pin portion 91 provided on a member attaching portion 5 of a left side cloth 1 and a box pin portion 92 provided on a member attaching portion 5 of a right side cloth 1. The insert pin portion 91 and the box pin portion 92 of Embodiment 4 are formed by sewing and attaching an insert pin member 96 and a box pin member 98 made of synthetic resin such as nylon to the member attaching portion 5 of the cloth 1, respectively.

The insert pin member 96 of Embodiment 4 includes an insert pin main body portion 96*a* wrapping the extending portion 13*b* of the fixing member 13, a first insert pin fin portion 96*b* extending from a side edge part of the insert pin main body portion 96*a* in a width direction and disposed on an upper surface of an element attaching edge portion 2, a second insert pin fin portion (not shown) extending from a side edge part of the insert pin main body portion 96*a* in a width direction and disposed on a lower surface of the element attaching edge portion 2, and a coupling portion 96*d* integrally provided at a front end part of the insert pin main body portion 96*a*.

On a facing side surface part of the insert pin main body portion 96*a* of Embodiment 4 facing to the box pin portion 92, an insert pin side concave portion 96*e* capable of inserting and accommodating a box pin side insertion portion 98*e* described later of the box pin portion 92, is formed on a rear side of the coupling portion 96*d*. Two insert pin side anchor accommodating hole portions 96*f* for accommodating two unillustrated sixth anchor elements provided on the left side element member 10*e* are respectively provided on an upper surface portion and a lower surface portion of the insert pin main body portion 96*a*.

The first insert pin fin portion 96*b* and the second insert pin fin portion of the insert pin member 96 in Embodiment 4 are connected to each other at a rear end part. Further, in the first insert pin fin portion 96*b* and the second insert pin fin portion, a plurality of accommodating hole portions 96*g* for making a sewing needle pierced when fixing the insert pin member 96 to the cloth 1 by forming an insert pin side sewn portion 97 and for accommodating a part of the insert pin side sewn portion 97 is provided so as to be in a line in a length direction.

The box pin member 98 of Embodiment 4 is formed as a box member of the separable rear end stop 90. The box pin member 98 includes a box pin main body portion (box main body portion) 98*a* wrapping the extending portion 13*b* of the fixing member 13, a stopper portion 98*d* integrally formed at a rear end part of the box pin main body portion 98*a*, bulging from the lower end part of the box pin main body portion 98*a* in a width direction and contacting a rear side first slider 60*a*, a first box fin portion 98*b* extending from a side edge part of the box pin main body portion 98*a* and the stopper portion 98*d* and disposed on an upper surface of the element attaching edge portion 2, a second box fin portion (not shown) extending from the side edge part of the box pin main body portion 98*a* and the stopper portion 98*d* in a width direction and disposed on a lower surface of the element attaching edge portion 2, and a box pin side insertion portion 98*e* protruding toward the insert pin portion 91 from a side surface part facing to the insert pin at a front end part of the box pin main body portion 98*a*.

Two box pin side anchor accommodating hole portions 98*f* for accommodating two unillustrated sixth anchor elements provided on the right side element member 10*f* are respectively provided on an upper surface portion and a lower surface portion of the box pin main body portion 98*a*. Further, in the first box fin portion 98*b* and the second box fin portion, a plurality of accommodating hole portions 98*g* for making a sewing needle pierced when fixing the box pin member 98 to the cloth 1 by forming a box pin side sewn portion (box side sewn portion) 99 and for accommodating a part of the box pin side sewn portion 99 is provided so as to be in a line in a length direction.

A method of attaching the insert pin member 96 and the box pin member 98 of Embodiment 4 as described above to the member attaching portions 5 formed on the right and left cloths 1 respectively is substantially the same as the case when the insert pin members 36, 76, 86 of the aforementioned Embodiments 1 to 3 are attached to the member attaching portion 5 of the cloth 1 respectively. For example, in the case of attaching the box pin member 98 of Embodiment 4 to the member attaching portion 5 of the right side cloth 1, first, the box pin member 98 is elastically deformed to have a slight interval between the first box fin portion 98*b* and the second box fin portion, and covers the member attaching portion 5 of the cloth 1 such that the member attaching portion 5 is inserted between the first box fin portion 98*b* and the second box fin portion.

At this time, the two sixth anchor elements provided on the extending portion 13*b* of the fixing member 13 are inserted and accommodated in each box pin side anchor accommodating hole portion 98*f* formed on the box pin member 98. Thereby, the box pin member 98 is stably positioned at a predetermined position with respect to the member attaching portion 5 of the cloth 1.

Subsequently, the member attaching portion 5 of the cloth 1 and the box pin member 98 are sewn together with lock stitches using a sewing machine to form the box pin side sewn portion 99, and the box pin member 98 is sewn and fixed to the member attaching portion 5 of the cloth 1 with the box pin side sewn portion 99. As a result, the box pin portion 92 formed of the box pin member 98 can be appropriately provided on the member attaching portion 5 of the cloth 1 so as to be continuous with the right side element row 3. The insert pin member 96 of Embodiment 4 is also sewn and fixed to the member attaching portion 5 of the cloth 1 by the same method as that of the box pin member 98, thereby the insert pin portion 91 formed of the insert pin member 96 can be appropriately provided so as to be continuous with the left side element row 3.

The slide fastener-attached clothing item of Embodiment 4 having the insert pin portion 91 and the box pin portion 92 as described above is formed without a fastener tape, and the separable rear end stop 90 is formed of the insert pin portion 91 and the box pin portion 92. Therefore, even with the slide fastener-attached clothing item of Embodiment 4, the same effect as that of the slide fastener-attached clothing item of Embodiment 1 described above can be obtained.

In the above-described slide fastener-attached clothing item according to Embodiments 1 to 4, the element member 10 is firmly fixed to the element attaching edge portion 2 of the cloth 1 by forming two sewn portions which are the sewn portion for fixing 15 formed by a zigzag stitch sewing machine and the auxiliary sewn portion 19 formed by a lock stitch sewing machine.

Figure 27:
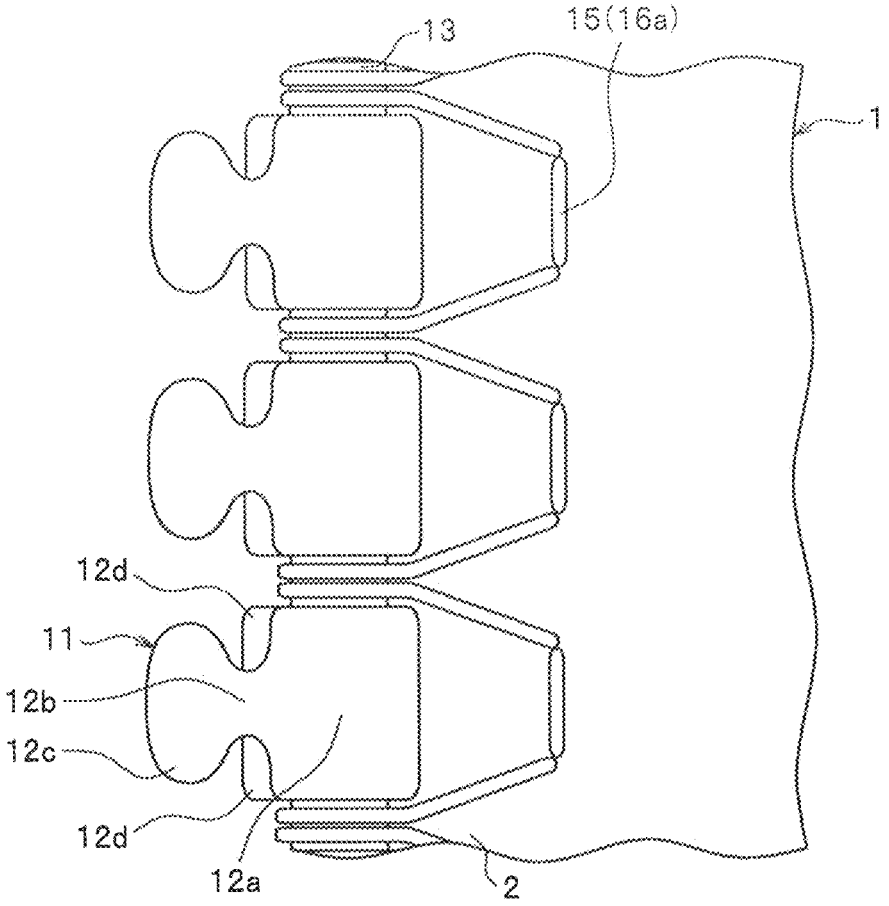
FIG. 27 is a plan view of a main portion showing a main portion of a slide fastener-attached product (clothing item) according to a first modification example of the present invention.

However, in the present invention, as shown in FIG. 27 showing a main part of a slide fastener-attached clothing item according to a first modification example of the present invention, the element member 10 may be fixed to the element attaching edge portion 2 of the cloth 1 only with the sewn portion for fixing 15 formed in a zigzag shape by the zigzag stitch sewing machine, without forming the above-mentioned auxiliary sewn portion 19 formed with lock stitches sewing machine. In this case, the extending portion 13*b* of the fixing member 13 in the element member 10 is also fixed to the element attaching edge portion 2 of the cloth 1 only with the sewn portion for fixing 15.

Further, in the case of the first modification example, it is preferable to use a welded thread (also referred to as a fusible thread) having a core-sheath structure instead of the normal sewing thread as in Embodiment 1 for at least one of the upper thread (needle thread) 16*a* and the lower thread (bobbin thread) 16*b* forming the sewn portion for fixing 15.

In the welded thread having the core-sheath structure, a core portion of the welded thread is formed of a fiber material which does not melt even when heated to a predetermined temperature or higher, or a fiber material which has heat shrinkability contracted by heating. The sheath portion of the welded thread is formed of a fiber material having heat fusibility capable of being melted by being heated to a predetermined temperature or higher.

Since such a welded thread having the core-sheath structure for at least one of the upper thread 16*a* and the lower thread 16*b* of the sewn portion for fixing 15 is used, and heat treatment is performed after the formation of the sewn portion for fixing 15, it is possible to firmly fix the element member 10 with the sewn portion for fixing 15 even when the auxiliary sewn portion 19 is not formed as in the case of Embodiment 1 or the like described above. Further, it is also possible to effectively prevent looseness from occurring in the upper thread 16*a* and the lower thread 16*b* of the sewn portion for fixing 15.

Figure 28:
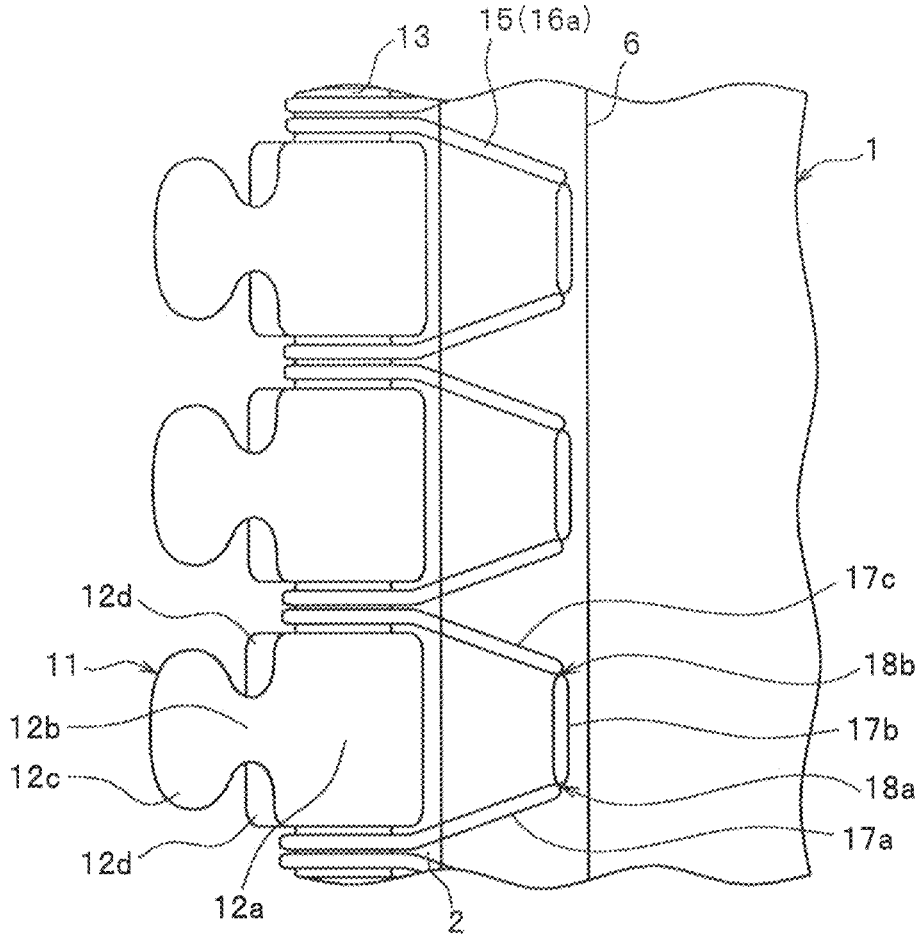
FIG. 28 is a plan view of a main portion showing a main portion of a slide fastener-attached product (clothing item) according to a second modification example of the present invention.

Further, in the present invention, as showing a main part of a slide fastener-attached clothing item according to second modification example of the present invention in FIG. 28, without forming the aforementioned auxiliary sewn portion 19 formed by a lock stitch sewing machine, it is also possible that a transparent film member (tape member) 6 for fixing the sewn portion for fixing 15 to the element attaching edge portion 2 of the cloth 1 is affixed to the sewn portion for fixing 15 formed in a zigzag shape by a zigzag stitch sewing machine. The film member 6 can also be referred to as a thread fixing film member for fixing the sewing thread of the sewn portion for fixing 15.

The film member 6 is formed by applying an adhesive agent or a gluing agent to one film surface of the film member 6. After the sewn portion for fixing 15 is formed by conducting a sewing by a zigzag stitch sewing machine, the film member 6 is affixed to at least one of a top surface and a back surface of the element attaching edge portion 2 so as to cover at least a part of the sewn portion for fixing 15 including a first piercing position 18*a* and a second piercing position 18*b* of the sewn portion for fixing 15.

This makes it possible to firmly fix at least one of the upper thread 16*a* and the lower thread 16*b* of the sewn portion for fixing 15 to the element attaching edge portion 2. Therefore, even when the above-described auxiliary sewn portion 19 is not formed on the sewn portion for fixing 15, a fixing of the element member 10 with the sewn portion for fixing 15 can be strengthened. In this second modification example, instead of affixing the film member 6 as described above, it is also possible to bond and firmly fix the upper thread 16*a* and the lower thread 16*b* of the sewn portion for fixing 15 to the element attaching edge portion 2 by applying or coating an adhesive agent in a region where the film member 6 is affixed, As shown in FIG. 2 and the like, the zigzag-shaped sewn portion for fixing 15 formed by a zigzag stitch sewing machine in Embodiments 1 to 4 described above is formed by repeating the unit running area 17 with the predetermined stitching pattern such that a part formed inside of the fastener element 11 in the cloth 1 has an isosceles trapezoid shape.

However, in the present invention, the shape (stitching pattern) of the unit running area 17 formed on the sewn portion for fixing 15 is not limited to the above. For example, as long as the sewn portion for fixing pierces the element attaching edge portion 2 of the cloth 1 at a position apart from the fastener element 11 to be inside of the cloth 1 and the sewn portion for fixing 15 supports the fixing member 13 including the extending portion 13*b* of the element member 10 so as to wrap it, it may be formed in other shapes.

Figure 29:
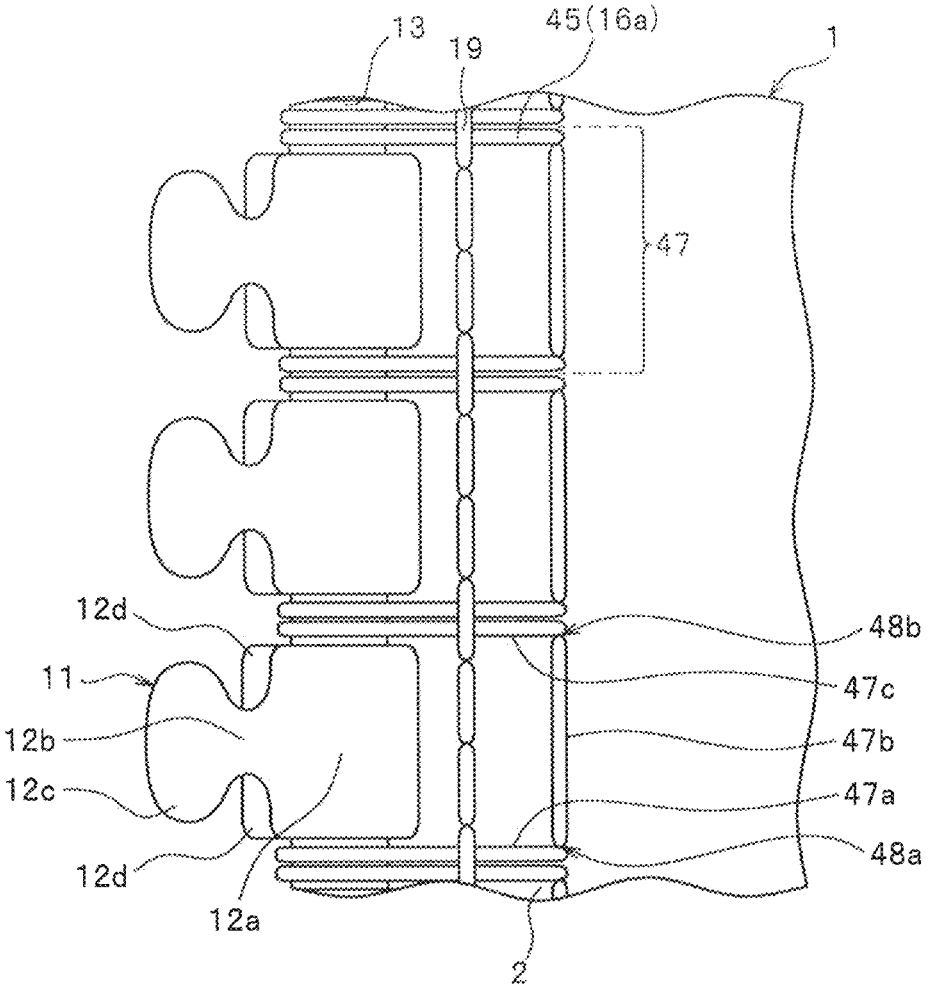
FIG. 29 is a plan view of a main portion showing a main portion of a slide fastener-attached product (clothing item) according to a third modification example of the present invention.
Figure 30:
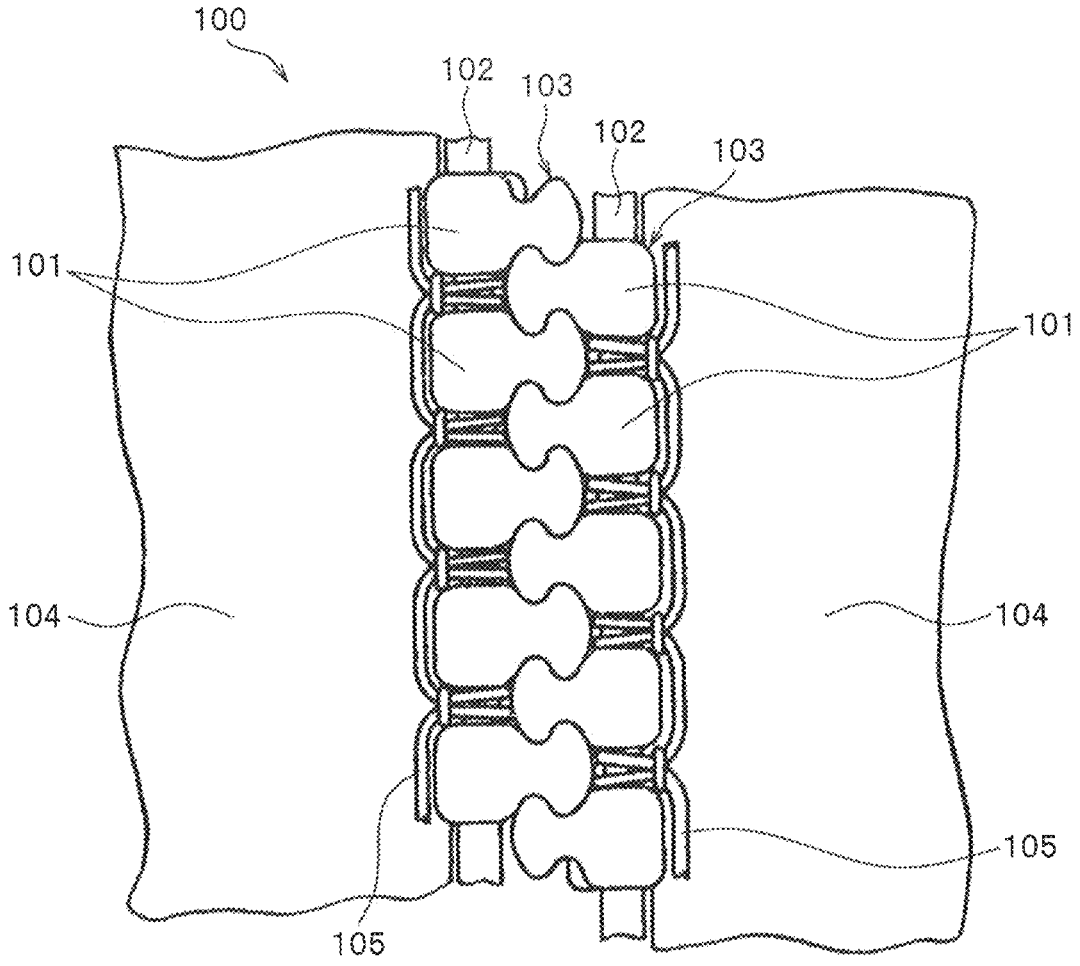
FIG. 30 is a plan view of a main portion showing a main portion of a conventional slide fastener in which an element member is sewn to a fastener tape.

For example, as showing a main portion of a slide fastener-attached clothing item according to third modification example of the present invention in FIG. 29, a unit running area 47 of a sewn portion for fixing 45 formed by a zigzag stitch sewing machine may include a first running portion 47*a* in which an upper thread 16*a* and a lower thread 16*b* run linearly along a width direction from an outer peripheral crossing position where an upper thread 16*a* and a lower thread 16*b* cross on an outer peripheral surface of a fixing member 13 to a first piercing position 48*a*, a second running portion 47*b* in which the upper thread 16*a* and the lower thread 16*b* run linearly along a length direction from the first piercing position 48*a* to a next second piercing position 48*b*, and a third running portion 47*c* in which the upper thread 16*a* and the lower thread 16*b* run linearly along a width direction from the second piercing position 48*b* to the next outer peripheral crossing position.

Even when the sewn portion for fixing 45 is formed as shown in FIG. 29, the sewn portion for fixing 45 pierces the element attaching edge portion 2 of the cloth 1 and supports the fixing member 13 of the element member 10 so as to wrap it, so that the element member 10 can be firmly and stably fixed to the element attaching edge portion 2 of the cloth 1.

Further, according to the present invention, it is also possible to separate a piercing position where the sewn portion for fixing pierces the element attaching edge portion further from a side surface part toward an inside of each element in the cloth than in the case of Embodiment 1. In this case, in each unit running area of the sewn portion for fixing, the number of piercing positions at which the sewn portion for fixing pierces the element attaching edge portion can be reduced to one to form the sewn portion for fixing in a zigzag shape, instead of two as shown in FIG. 2, etc. Further, in each unit running area, it is also possible to increase the number of piercing positions at which the sewn portion for fixing pierces the element attaching edge portion to three, for example, or more.

Furthermore, in Embodiments 1 to 4 described above, the first insert pin fin portions 36*b*, 76*b*, 86*b*, 96*b* and the second insert pin fin portions 36*c*, 76*c* of the insert pin member 36, 76, 86, 96, the first box fin portions 38*b*, 78*b* and the second box fin portions 38*c*, 78*c* of the box body member 38, 78, and the first box fin portion 98*b* and the second box fin portion of the box pin member 98 are sewn to the member attaching portion 5 formed on the facing side edge part on the rear end side of the cloth 1 with each sewn portion of the sewing thread.

However, in the present invention, the first insert pin fin portions 36*b*, 76*b*, 86*b*, 96*b* and the second insert pin fin portions 36*c*, 76*c* of the insert pin members 36, 76, 86, 96, the first box fin portions 38*b*, 78*b* and the second box fin portions 38*c*, 78*c* of the box body members 38, 78, and the first box fin portion 98*b* and the second box fin portion of the box pin member 98 can be fixed with respect to the member attaching portion formed at a rear end part of the cloth using fixing means such as adhesion with an adhesive agent, or welding by heating or ultrasonic or the like. Further, in the present invention, it is also possible to form an insert pin portion or a box portion (box body portion or box pin portion) by directly injection-molding synthetic resin with respect to the member attaching portion formed at the lower end part of the cloth.

Further, in the present invention, when the insert pin member and the box member (box body member and box pin member) are made of metal, for example, it is also possible to form an insert pin portion and a box portion by positioning the insert pin member and the box member at a predetermined position with respect to the member attaching portion of the cloth using an anchor element, then conducting a processing (so-called crimping process) for plastically deforming a part of the insert pin member by pressing the part and the box member to fix the insert pin member and the box member to the member attaching portion of the cloth.

Furthermore, in the present invention, it is also possible to provide one or a plurality of penetrating holes penetrating from an upper surface to a lower surface on the member attaching portion of the cloth, and a positioning pin portion (protrusion portion) to be inserted through the penetrating hole on the insert pin member and the box member. As a result, it is possible to more stably position the insert pin member and the box member with respect to the member attaching portion of the cloth, and to increase the attaching strength (fixing strength) of the insert pin member and the box member with respect to the member attaching portion of the cloth.

Further, in Embodiments 1 to 4 described above, the side edge part of the cloth 1 is folded back in a U-shape to form the element attaching edge portion 2, thereby the strength of the element attaching edge portion 2 is enhanced. In addition, when a cut end edge (side end edge) of the cloth 1 has a fray, it is possible to hide it on a back side of the element attaching edge portion 2 so as not to be seen.

However, in the present invention, the element attaching edge portion may be formed in a state in which the side edge part of the cloth 1 is straightened in a width direction without folding in a U-shape. Further, in a case of forming the element attaching edge portion by straightening the side edge part of the cloth straight in a width direction, impregnating the side edge part of the cloth with a reinforcement agent or affixing reinforcing film member made of synthetic resin to the side edge part of the cloth so as to wrap the side edge part therein, thereby, it is possible to stably enhance the strength of the element attaching edge portion formed straight.

In this case, the reinforcement agent to impregnate the cloth 5 is a curable adhesive, and the reinforcement agent such as single curable adhesive, two-pack curable adhesive, instant adhesive, hot melt adhesive, emulsion adhesive, or light curing adhesive which cures by ultraviolet ray or electron beam can be used. The reinforcement film member to be applied on the cloth 5 is a film-type member which can enhance the strength of the cloth 5 by applying. It is preferable to use a film member having low elasticity or no elasticity as the reinforcement film member.

Since the element attaching edge portion is reinforced by impregnating the reinforcement agent and affixing the reinforcing film member as described above, even when the upper thread and the lower thread of the sewn portion for fixing pierce the element attaching edge portion, for example, it makes less possible that the element attaching edge portion is cut by the upper thread and the lower thread. As a result, the durability of the element attaching edge portion can be enhanced.

In addition, since the element member is firmly fixed to the element attaching edge portion in a straight state, the position and posture of each element fixed to the element attaching edge portion are stabilized, and the extending portion of the fixing member is firmly fixed to the element attaching edge portion of the cloth, so that the member attaching portion for fixing the insert pin member and the like is stably formed. Further, by impregnating the reinforcement agent and affixing the reinforcing film member on the element attaching edge portion, it makes less possible that a fray of thread occurs at the side end edge of the element attaching edge portion.

REFERENCE SIGNS

1: cloth (fastener attached member)
2: element attaching edge portion
3: element row
5: member attaching portion
6: film member (tape member)
10: element member
10*a*: left side element member (first element member)
10*b*: right side element member (second element member)
10*c*, 10*d*: left side element member
10*e*: left side element member
10*f*, 10*g*: right side element member
11: fastener element
11*a*: end part fastener element
12*a*: body portion
12*b*: neck portion
12*c*: coupling head portion
12*d*: protruded piece portion
12*e*: insertion concave portion
12*f*: concave groove portion
13: fixing member
13*a*: element holding portion
13*b*: extending portion
14: exposed portion
15: sewn portion for fixing (sewing line for fixing)
16*a*: upper thread (needle thread)
16*b*: lower thread (bobbin thread)
17: unit running area
17*a*: first running portion
17*b*: second running portion
17*c*: third running portion
18*a*: first piercing position
18*b*: second piercing position
19: auxiliary sewn portion
21: first anchor element
22: second anchor element
23: third anchor element
23*a*: columnar portion
23*b*: enlarged diameter portion
24: fourth anchor element
25: fifth anchor element
27: box body side insertion portion
27*a*: fixing portion
27*b*: insertion piece portion
30: separable rear end stop
31: insert pin portion
32: box body portion (box portion)
36: insert pin member
36*a*: insert pin main body portion

36*b*: first insert pin fin portion
36*c*: second insert pin fin portion
36*d*: coupling portion
36*e*: insert pin side concave portion
36*f*: anchor accommodating hole portion
36*g*: accommodating concave groove portion
37: insert pin side sewn portion
38: box body member
38*a*: box body main body portion (box main body portion)
38*b*: first box fin portion
38*c*: second box fin portion
38*d*: insert pin accommodating portion
38*e*: box body side anchor accommodating hole portion
38*f*: box body side anchor accommodating concave portion
38*g*: accommodating concave groove portion
39: box body side sewn portion (box side sewn portion)
45: sewn portion for fixing (sewing line for fixing)
47: unit running area
47*a*: first running portion
47*b*: second running portion
47*c*: third running portion
48*a*: first piercing position
48*b*: second piercing position
60: slider
60*a*: first slider
60*b*: second slider
61: slider body
62: upper wing plate
63: pull tab attaching portion
66: pull tab
70: separable rear end stop
71: insert pin portion
76: insert pin member
76*a*: insert pin main body portion
76*b*: first insert pin fin portion
76*c*: second insert pin fin portion
76*d*: coupling portion
76*e*: insert pin side concave portion
76*f*: anchor accommodating concave portion on rear end side
76*g*: accommodating concave groove portion
76*h*: anchor accommodating concave portion on front end side
77: insert pin side sewn portion
78: box body member
78*a*: box body main body portion (box main body portion)
78*b*: first box fin portion
78*c*: second box fin portion
78*d*: insert pin accommodating portion
78*e*: box body side anchor accommodating hole portion
78*g*: accommodating concave groove portion
78*h*: box pin main body portion
78*i*: box pin side insertion portion
80: separable rear end stop
81: insert pin portion
86: insert pin member
86*a*: insert pin main body portion
86*b*: first insert pin fin portion
86*d*: coupling portion
86*f*: front protruding portion
86*g*: accommodating concave groove portion
87: insert pin side sewn portion
90: separable rear end stop
91: insert pin portion
92: box pin portion
96: insert pin member
96*a*: insert pin main body portion
96*b*: first insert pin fin portion
96*d*: coupling portion
96*e*: insert pin side concave portion
96*f*: insert pin side anchor accommodating hole portion
96*g*: accommodating hole portion
97: insert pin side sewn portion
98: box pin member
98*a*: box pin main body portion (box main body portion)
98*b*: first box fin portion
98*d*: stopper portion
98*e*: box pin side insertion portion
98*f*: box pin side anchor accommodating hole portion
98*g*: accommodating hole portion
99: box body side sewn portion (box side sewn portion)

The invention claimed is:

1. A slide fastener-attached product comprising:

a pair of element members in which fastener elements are attached to a fixing member and a fastener attached member having a pair of element attaching edge portions to which the element member is attached at positions facing to each other, wherein:

the fixing member includes, in a length direction of the element member, an element holding portion to which the fastener elements are attached and an extending portion extending further in one direction of the length direction than an end part fastener element disposed on one end part of the fastener elements in the length direction, the element member is fixed to the element attaching edge portion of the fastener attached member with at least one sewing thread, the extending portion of the fixing member is fixed to the element attaching edge portion with the at least one sewing thread, at least one component part of a separable rear end stop of a slide fastener is attached to a member attaching portion that includes a part of the extending portion.

2. The slide fastener-attached product according to claim 1, wherein:

the member attaching portion further includes at least a part of the element attaching edge portion.

3. The slide fastener-attached product according to claim 1, wherein:

the at least one sewing thread pierces the element attaching edge portion and the at least one sewing thread holds the fixing member, thereby the element member including the extending portion of the fixing member is directly fixed to the element attaching edge portion at a position along the element attaching edge portion on an outside of the element attaching edge portion in a width direction of the element member.

4. The slide fastener-attached product according to claim 3, wherein:

a position in which the at least one sewing thread pierces the element attaching edge portion is apart from the fastener element of the element member in a width direction of the element member to be inside of the element attaching edge portion.

5. The slide fastener-attached product according to claim 1, wherein:

the at least one sewing thread is formed to be bent in a zigzag shape with respect to a length direction of the element member with lock stitches.

6. The slide fastener-attached product according to claim 1, wherein:

the at least one sewing thread repeats a predetermined stitching pattern for each fastener element, and the extending portion of the fixing member is fixed to the element attaching edge portion by repeating the stitching pattern.

7. The slide fastener-attached product according to claim 1, wherein:

the component part of the separable rear end stop is sewn to the member attaching portion.

8. The slide fastener-attached product according to claim 1, wherein:

a pair of the member attaching portions is formed at positions facing to each other, an insert pin member forming an insert pin portion of the separable rear end stop is fixed to one of the member attaching portions as the component part, and a box member forming a box portion of the separable rear end stop is fixed to the other of the member attaching portions as the component part.

9. The slide fastener-attached product according to claim 8, wherein:

the insert pin member includes an insert pin main body portion along the fixing member to wrap the fixing member and a first insert pin fin portion extending in a width direction from the insert pin main body portion and disposed on a first surface of the element attaching edge portion, the first insert pin fin portion is sewn to the element attaching edge portion with an insert pin side sewn portion, the box member includes a box main body portion along the fixing member to wrap the fixing member and a first box fin portion extending in a width direction from the box main body portion and disposed on a first surface of the element attaching edge portion, and the first box fin portion is sewn to the element attaching edge portion with a box side sewn portion.

10. The slide fastener-attached product according to claim 9, wherein:

the insert pin member includes a second insert pin fin portion extending in a width direction from the insert pin main body portion and disposed on a second surface of the element attaching edge portion, the second insert pin fin portion is sewn to the element attaching edge portion with the insert pin side sewn portion, the box member includes a second box fin portion extending in a width direction from the box main body portion and disposed on a second surface of the element attaching edge portion, and the second box fin portion is sewn to the element attaching edge portion with the box side sewn portion.

11. The slide fastener-attached product according to claim 10, wherein:

an accommodating concave groove portion accommodating the insert pin side sewn portion is disposed along a length direction on the first insert pin fin portion and the second insert pin fin portion of the insert pin member, and an accommodating concave groove portion accommodating the box pin side sewn portion is disposed along a length direction on the first box fin portion and the second box fin portion of the box member.

12. The slide fastener-attached product according to claim 1, wherein:

at least one anchor element positioning the component part is disposed on the extending portion of the fixing member, the anchor element has a shape bulging from the fixing member in an orthogonal direction with respect to a length direction of the fixing member, and at least one anchor accommodating hole portion or anchor accommodating concave portion capable of inserting and accommodating the anchor element is disposed on the component part.

13. The slide fastener-attached product according to claim 12, wherein:

the anchor element has a columnar, spherical or hemispherical shape centered on a central axis along a length direction of the fixing member, or a shape by combining at least two of them.

14. The slide fastener-attached product according to claim 8, wherein:

the box portion includes at least a box body main body portion provided with an insert pin accommodating portion capable of inserting and accommodating the insert pin portion and contacting and stopping a slider, and the slider is attached slidably to element rows formed of a plurality of the fastener elements in a posture that a rear mouth of the slider faces to the box body main body portion.

15. The slide fastener-attached product according to claim 8, wherein:

a first slider and a second slider are slidably attached to element rows formed of a plurality of the fastener elements in a posture that rear mouths of respective sliders face to each other, and the box portion includes a box pin main body portion disposed continuously to the element row and a stopper portion disposed integrally with the box pin main body portion and stopping by contacting one of the first slider and the second slider.

16. An element member comprising:

a plurality of fastener elements; and a fixing member to which the fastener elements are attached, wherein:

the fixing member includes, in a length direction of the element member, an element holding portion to which the fastener elements are attached and an extending portion extending further in one direction of the length direction than an end part fastener element disposed on one end part of the fastener elements in the length direction, and the extending portion includes an exposed portion where the fixing member is exposed.

17. The element member according to claim 16, wherein:

a dimension of the extending portion including the exposed portion in a length direction is set to be larger than that of an attaching pitch of the fastener elements in the length direction.

18. The element member according to claim 16, wherein:

at least one anchor element positioning a component part attached to the extending portion is disposed on the extending portion of the fixing member, and the anchor element has a shape bulging from the fixing member in an orthogonal direction with respect to a length direction of the fixing member.

19. A manufacturing method of a slide fastener-attached product, the method including:

forming an element member in which fastener elements are attached to a fixing member and which has, in a length direction, an element holding portion to which the fastener elements are attached and an extending portion extending further in one direction of the length direction than an end part fastener element disposed on one end part of the fastener elements in the length direction, forming a fastener attached member including an element attaching edge portion, and forming a member attaching portion including the extending portion by sewing the fastener attached member and the element member using a sewing machine and fixing at least the extending portion of the fixing member to the element attaching edge portion of the fastener attached member with at least one sewing thread.

20. The manufacturing method of the slide fastener-attached product according to claim 19, including fixing a component part forming a separable rear end stop of a slide fastener to the member attaching portion.

* * * * *